US011543185B2

(12) United States Patent
Onaka et al.

(10) Patent No.: US 11,543,185 B2
(45) Date of Patent: Jan. 3, 2023

(54) AIR-CONDITIONING APPARATUS

(71) Applicant: Mitsubishi Electric Corporation, Chiyoda-ku (JP)

(72) Inventors: Yoji Onaka, Chiyoda-ku (JP); Takashi Matsumoto, Chiyoda-ku (JP); Kosuke Miyawaki, Chiyoda-ku (JP); Hiroyuki Okano, Chiyoda-ku (JP); Takanori Koike, Chiyoda-ku (JP); Osamu Morimoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 544 days.

(21) Appl. No.: 16/484,732

(22) PCT Filed: Mar. 24, 2017

(86) PCT No.: PCT/JP2017/012014

§ 371 (c)(1),
(2) Date: Aug. 8, 2019

(87) PCT Pub. No.: WO2018/173256

PCT Pub. Date: Sep. 27, 2018

(65) Prior Publication Data

US 2020/0041178 A1 Feb. 6, 2020

(51) Int. Cl.

| | |
|---|---|
| ***F25B 41/00*** | (2021.01) |
| ***F28D 1/053*** | (2006.01) |
| ***F28F 9/02*** | (2006.01) |

(52) U.S. Cl.

CPC ..... *F28D 1/05316* (2013.01); *F28F 9/02* (2013.01)

(58) Field of Classification Search

CPC ..... F28F 9/02; F28F 9/0207; F28F 9/0275; F28F 9/026; F28F 9/0282; F28F 9/028

See application file for complete search history.

(56) References Cited

U.S. PATENT DOCUMENTS

| | | | | |
|---|---|---|---|---|
| 2015/0027672 | A1* | 1/2015 | Jindou | F28F 13/06 165/143 |
| 2016/0047580 | A1* | 2/2016 | Cho | F25B 21/02 62/529 |
| 2017/0082332 | A1 | 3/2017 | Onaka et al. | |

FOREIGN PATENT DOCUMENTS

| | | | |
|---|---|---|---|
| JP | 5626254 | B2 | 11/2014 |
| WO | WO 2015/178097 | A1 | 11/2015 |

OTHER PUBLICATIONS

International Search Report dated Jun. 6, 2017 in PCT/JP2017/012014 filed Mar. 24, 2017.

(Continued)

*Primary Examiner* — Nael N Babaa
(74) *Attorney, Agent, or Firm* — Xsensus LLP

(57) ABSTRACT

The air-conditioning apparatus includes a heat exchanger including a plurality of heat transfer tubes and a header manifold an axial fan and a refrigerant circuit. When the distance from the center of the flow space in the horizontal plane is represented on a scale of 0 to 100%, where 0% represents the center of the flow space and 100% is the position of the wall surface of the header manifold, among the plurality of branch tubes located within a height range that allows the blade to rotate, the majority of the branch tubes located at or below the height of the boss are connected to the header manifold such that their distal ends are positioned at 0 to 50% of the distance from the center, and the majority of the branch tubes located above the height of the boss are connected to the header manifold such that their distal ends are positioned at more than 50% of the distance from the center.

14 Claims, 40 Drawing Sheets

(56) References Cited

OTHER PUBLICATIONS

Byun, H.-W et al., "Two-phase refrigerant distribution in an intermediate header of a parallel flow minichannel heat exchanger," International Journal of Refrigeration, No. 59, 2015, pp. 14-28.
Zou, Y. et al., "Effects of fluid properties on two-phase flow and refrigerant distribution in the vertical header of a reversible microchannel heat exchanger—Comparing R245fa, R134a, R410A, and R32," Applied Thermal Engineering, No. 70, 2014, pp. 966-976.

* cited by examiner

AIR-CONDITIONING APPARATUS

TECHNICAL FIELD

The present invention relates to an air-conditioning apparatus, and more specifically to the structure of a heat exchanger including a distribution header.

BACKGROUND ART

In existing air-conditioning apparatuses, liquid refrigerant condensed in a heat exchanger equipped to an indoor unit and functioning as a condenser is reduced in pressure by an expansion valve, and thus turns into two-phase gas-liquid refrigerant containing both gas refrigerant and liquid refrigerant. The two-phase gas-liquid refrigerant then flows into a heat exchanger equipped to an outdoor unit and functioning as an evaporator.

When refrigerant flows in a two-phase gas-liquid state into the heat exchanger serving as an evaporator, the distribution of refrigerant to the heat exchange unit of the heat exchanger deteriorates. Accordingly, to improve the distribution performance of refrigerant, in some air-conditioning apparatuses, a header is used as a distribution unit for the heat exchanger equipped to the outdoor unit, and a partition plate, an eject port, or other such structural object is provided inside the header.

However, providing an additional structural object inside the header manifold as described above yields only a limited improvement in distribution despite a significant associated increase in cost. Accordingly, another method has been proposed in which the insertion length of branch tubes into the header manifold is adjusted (see, for example, Patent Literature 1). The method according to the invention described in Patent Literature 1 includes inserting a plurality of branch tubes at equal lengths, and optimizing the flow velocity of refrigerant in the flow space of the header manifold to thereby ensure uniform distribution of refrigerant to the heat exchanger.

CITATION LIST

Patent Literature

Patent Literature 1: Japanese Patent No. 5626254

SUMMARY OF INVENTION

Technical Problem

In general, the flow of air through the heat exchanger is unevenly distributed relative to the vertical direction of the heat exchanger. For instance, in the case of a heat exchanger in a top-flow arrangement with a fan installed over the top of the outdoor unit or the top of the heat exchanger of the outdoor unit, there is a large amount of airflow in areas of the heat exchanger closer to the fan, and the amount of airflow decreases progressively with increasing distance from the fan. This means that, even if refrigerant is uniformly distributed to the heat exchanger, this refrigerant distribution is not optimal relative to the airflow. In some cases, this can lead to deterioration of heat exchanger performance and, consequently, a decrease in the energy efficiency of the air-conditioning apparatus.

The present invention has been made to address the above-mentioned problem, and accordingly, an object thereof is to provide an air-conditioning apparatus that, although having a simple structure, allows refrigerant to be distributed in a manner optimal for the airflow through the heat exchanger.

Solution to Problem

An air-conditioning apparatus according to an embodiment of the present invention includes a heat exchanger, an axial fan, and a refrigerant circuit. The heat exchanger includes a plurality of heat transfer tubes in which refrigerant flows, the plurality of heat transfer tubes being arranged so as to be spaced apart from each other in the vertical direction, and a header manifold that has a flow space defined inside the header manifold and extending in the vertical direction, the header manifold allowing refrigerant to flow into the plurality of heat transfer tubes from a plurality of branch tubes, the plurality of branch tubes being arranged so as to be spaced apart from each other in the vertical direction. The axial fan includes a blade disposed around a boss that rotates, the blade having a rotational plane that faces the plurality of heat transfer tubes in the horizontal direction. The refrigerant circuit is a circuit to direct the refrigerant into the flow space such that the refrigerant flows upward in a two-phase gas-liquid state, and to cause the refrigerant to evaporate in the heat exchanger. The refrigerant flows in the header manifold in an annular or churn flow pattern in which gas-phase refrigerant collects at the center of the header manifold and liquid-phase refrigerant collects on the wall surface of the header manifold. When the distance from the center of the flow space in the horizontal plane is represented on a scale of 0 to 100%, where 0% is the center of the flow space and 100% is the position of the wall surface of the header manifold, among the plurality of branch tubes located within a height range that allows the blade to rotate, the majority of the branch tubes located at or below the height of the boss are inserted into the header manifold such that the distal ends of the branch tubes are positioned at 0 to 50% of the distance from the center, and the majority of the branch tubes located above the height of the boss are connected to the header manifold such that the distal ends of the branch tubes are positioned at more than 50% of the distance from the center.

An air-conditioning apparatus according to another embodiment of the present invention includes a heat exchanger, a fan, and a refrigerant circuit. The heat exchanger includes a plurality of heat transfer tubes in which refrigerant flows, the plurality of heat transfer tubes being arranged so as to be spaced apart from each other in the vertical direction, and a header manifold that has a flow space defined inside the header manifold and extending in the vertical direction, the header manifold allowing refrigerant to flow into the plurality of heat transfer tubes from a plurality of branch tubes, the plurality of branch tubes being arranged so as to be spaced apart from each other in the vertical direction. The fan is located above the plurality of heat transfer tubes. The refrigerant circuit is a circuit to direct the refrigerant into the flow space such that the refrigerant flows upward in a two-phase gas-liquid state, and to cause the refrigerant to evaporate in the heat exchanger. The refrigerant flows in the header manifold in an annular or churn flow pattern in which gas-phase refrigerant collects at the center of the header manifold and liquid-phase refrigerant collects on the wall surface of the header manifold. The header manifold includes a plurality of header manifolds disposed at different heights in the vertical direction. When the distance from the center of the flow space in the horizontal plane is represented on a scale of 0 to 100%, where 0% is the center of the flow space and 100% is the position of the wall surface of the header manifold, the majority of the branch tubes connected to the header manifold located closest to the fan are inserted such that the distal ends of the branch tubes are positioned at 0 to 50% of the distance from the center, and the majority of the branch tubes connected to the header manifold disposed below the header manifold located closest to the fan are connected such that the distal ends of the branch tubes are positioned at more than 50% of the distance from the center.

An air-conditioning apparatus according to another embodiment of the present invention includes a heat exchanger, a fan, and a refrigerant circuit. The heat exchanger includes a plurality of heat transfer tubes in which refrigerant flows, the plurality of heat transfer tubes being arranged so as to be spaced apart from each other in the vertical direction, and a header manifold that has a flow space defined inside the header manifold and extending in the vertical direction, the header manifold allowing refrigerant to flow into the plurality of heat transfer tubes from a plurality of branch tubes, the plurality of branch tubes being arranged so as to be spaced apart from each other in the vertical direction. The fan is located above the plurality of heat transfer tubes. The refrigerant circuit is a circuit to direct the refrigerant into the flow space such that the refrigerant flows upward in a two-phase gas-liquid state, and to cause the refrigerant to evaporate in the heat exchanger. The refrigerant flows in the header manifold in an annular or churn flow pattern in which gas-phase refrigerant collects at the center of the header manifold and liquid-phase refrigerant collects on the wall surface of the header manifold. When the distance from the center of the flow space in the horizontal plane is represented on a scale of 0 to 100%, where 0% is the center of the flow space and 100% is the position of the wall surface of the header manifold, the majority of the branch tubes connected to the header manifold are inserted into the header manifold such that the distal ends of the branch tubes are positioned at 0 to 50% of the distance from the center, and at least the uppermost branch tube of the branch tubes connected to the header manifold is connected to the header manifold such that the distal end of the branch tube is positioned at more than 50% of the distance from the center.

Advantageous Effects of Invention

In the air-conditioning apparatus according to an embodiment of the present invention, the branch tubes are inserted into the header manifold at lengths that are varied relative to the vertical direction of the heat exchanger depending on the positional relationship between the heat exchanger and the fan or between the heat exchanger and the axial fan. When the flow pattern of refrigerant entering the liquid header manifold is annular or churn, in an area of the header where the branch tubes are inserted so as to penetrate the liquid layer, the flow of liquid refrigerant is concentrated in an upper part of the area, and in an area of the header where the branch tubes are connected so as to be covered in the liquid layer, the flow of liquid refrigerant is concentrated in a lower part of the area. By suitably combining such areas in the vertical direction, refrigerant can be distributed in a manner suited for the distribution of air velocity in the heat exchanger. This helps enhance the performance of the heat exchanger.

DESCRIPTION OF EMBODIMENTS

Figure 1:
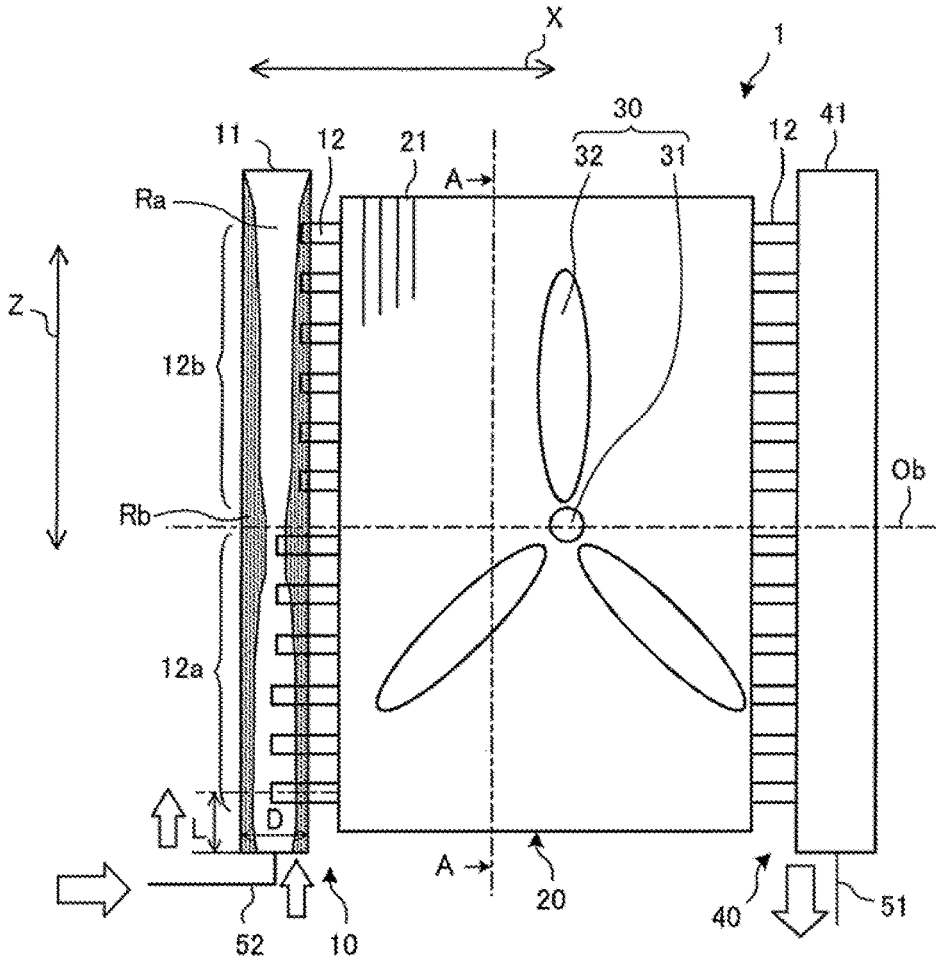
FIG. 1 schematically illustrates an example of a heat exchanger, according to Embodiment 1 of the present invention.

Embodiments of the present invention will be described below with reference to the drawings. Elements designated by the same reference signs in the drawings represent the same or corresponding elements throughout the specification. Further, the specific forms and arrangements of components described throughout the specification are illustrative only and not intended to limit the invention to the specific forms and arrangements described.

Embodiment 1

Figure 2:
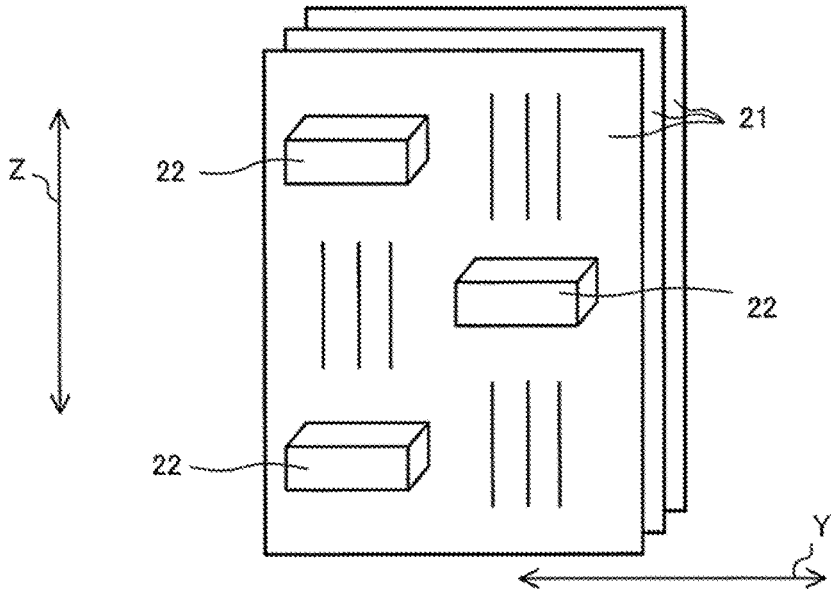
FIG. 2 illustrates heat transfer tubes, according to Embodiment 1 of the present invention.
Figure 3:
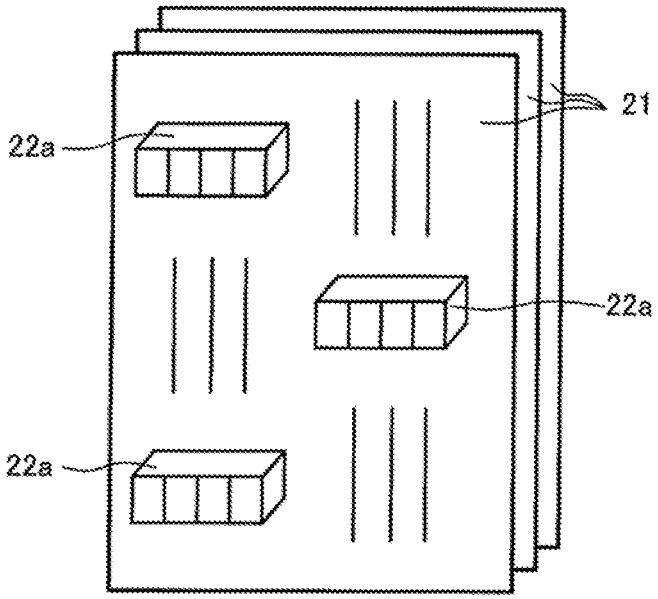
FIG. 3 illustrates an example of heat transfer tubes, according to Embodiment 1 of the present invention.
Figure 4:
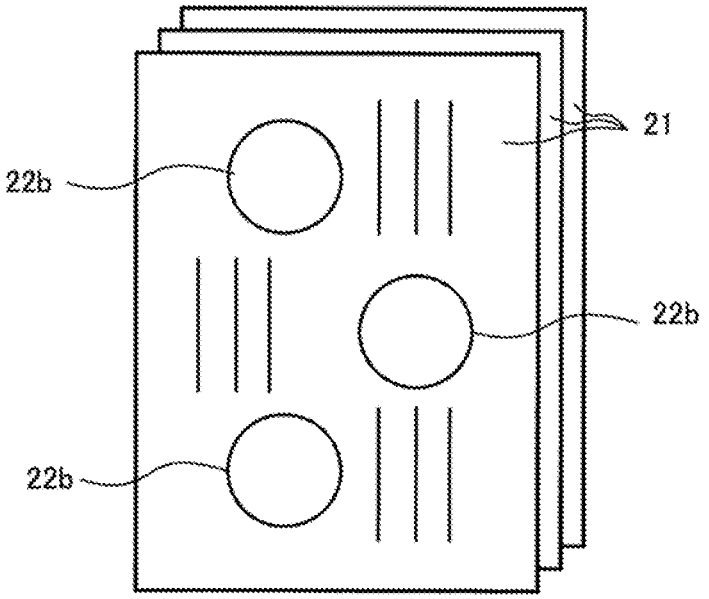
FIG. 4 illustrates another example of heat transfer tubes, according to Embodiment 1 of the present invention.

A heat exchanger 1 will be described below with reference to FIGS. 1 to 4. FIG. 1 schematically illustrates an example of a heat exchanger, according to Embodiment 1 of the present invention. FIG. 2 illustrates heat transfer tubes, according to Embodiment 1 of the present invention. FIG. 3 illustrates an example of heat transfer tubes, according to Embodiment 1 of the present invention. FIG. 4 illustrates another example of heat transfer tubes, according to Embodiment 1 of the present invention.

In Embodiment 1, the heat exchanger 1 includes components such as a liquid header 10, a gas header 40, a heat exchange unit 20, and a plurality of branch tubes 12 that connect the liquid header 10 or the gas header 40 to the heat exchange unit 20. A single axial fan 30 is disposed over the side of the heat exchanger 1. The heat exchanger 1 constitutes a portion of the refrigeration cycle of an air-conditioning apparatus.

The liquid header 10 is formed by connecting the branch tubes 12 to a liquid header main tube 11. Hereinafter, one or more liquid header main tubes 11 constituting the liquid header 10 will be sometimes collectively referred to as a header manifold. The liquid header main tube 11 has a flow space defined therein that extends in the vertical direction (arrow Z direction). The liquid header main tube 11 is in the form of a circular tube. A lower portion of the liquid header main tube 11 is connected to an inlet pipe 52 whose upstream portion is connected to a pipe of a refrigerant circuit. Liquid-phase refrigerant Rb and gas-phase refrigerant Ra are distributed in the flow space. The liquid-phase refrigerant Rb collects along the wall surface of the liquid header main tube 11 to form a liquid layer in the flow space. FIG. 1 depicts an entrance length L [m] at the inlet portion of the liquid header 10, and an inside diameter D [m] of the liquid header 10. The entrance length L [m] is defined as the distance between the position of the inlet portion of the liquid header 10 where refrigerant enters, and the position of the central axis of the branch tube 12 located closest to the inlet portion.

The gas header 40 is formed by connecting the branch tubes 12 to a gas header main tube 41, which defines a flow space therein and is in the form of a circular tube. A lower portion of the gas header 40 is connected with an outlet pipe 51 through which refrigerant exits.

FIG. 2 illustrates, in perspective view, a portion of the cross-section of the heat exchange unit 20 illustrated in FIG. 1 taken along a line A-A. As illustrated in FIG. 2, the heat exchange unit 20 includes components such as a plurality of fins 21 arranged in parallel and spaced apart from each other in the direction of the arrow X, and a plurality of heat transfer tubes 22 arranged so as to penetrate the fins 21 in the direction in which the fins 21 are arranged, and to project from either side of the arrangement of the fins 21. In FIG. 1, the heat transfer tubes 22 are arranged so as to be spaced apart from each other in the vertical direction (arrow Z direction). Each heat transfer tube 22 is connected via the corresponding branch tube 12 to the liquid header 10 at one end, and to the gas header 40 at the other end. Refrigerant flows inside the heat transfer tube 22.

Although FIG. 2 depicts each heat transfer tube 22 of the heat exchange unit 20 as a flat tube with a flat cross-section, this is not intended to limit the type or shape of the heat transfer tube 22 to be used. For example, the heat transfer tube 22 may be a flat perforated tube 22*a* with a flat cross-section having a plurality of holes defined therein as illustrated in FIG. 3. Alternatively, the heat transfer tube 22 may be formed as, for example, a circular tube 22*b* with a circular cross-section as illustrated in FIG. 4. The heat transfer tube 22 may be grooved to have a grooved surface for increased heat transfer area, or may be formed with a smooth surface to minimize an increase in pressure loss.

The axial fan 30 includes a boss 31, and blades 32 disposed around the boss 31. The axial fan 30 supplies air to the heat exchanger 1. As the boss 31 is rotated by a motor or other device, air is suctioned from one side of the axial fan 30 relative to the direction of the arrow Y, and blown out from the other side. In Embodiment 1, the axial fan 30 is disposed such that the rotational plane of the blades 32 faces the heat transfer tubes 22 of the heat exchanger 1 in the horizontal direction. Hereinafter, the height of the center of the boss 31 in the vertical direction (arrow Z direction) will be represented by a boss centerline Ob.

The branch tubes 12 are arranged so as to be spaced apart from each other in the vertical direction (arrow Z direction) to connect the liquid header 10 or the gas header 40 to the heat transfer tubes 22. Refrigerant flows inside each branch tube 12. The branch tubes 12 include branch tubes 12*a* located below the boss centerline Ob, and branch tubes 12*b* located above the boss centerline Ob, of which the branch tubes 12*a* are connected to the liquid header 10 such that the distal ends of the branch tubes 12*a* penetrate the liquid layer, and the branch tubes 12*b* are connected to the liquid header 10 such that the distal ends of the branch tubes 12*b* are covered in the liquid-phase refrigerant Rb. That is, the insertion length of the branch tubes 12*a* located below the boss centerline Ob into the liquid header main tube 11 is greater than the insertion length of the branch tubes 12*b* located above the boss centerline Ob.

Figure 5:
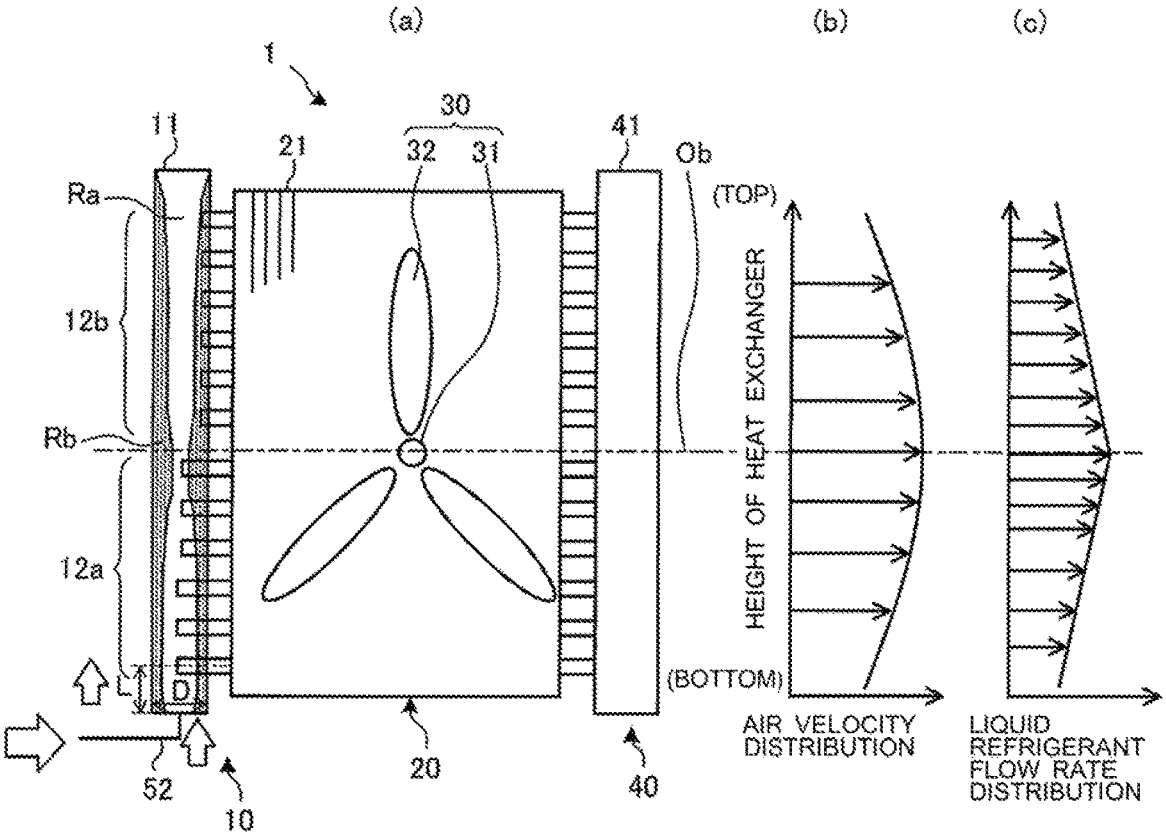
FIG. 5 explains an example of air velocity distribution in a heat exchanger and an example of liquid refrigerant distribution in a liquid header, according to Embodiment 1 of the present invention.

FIG. 5 explains an example of air velocity distribution in a heat exchanger and an example of liquid refrigerant distribution in a liquid header, according to Embodiment 1 of the present invention. FIG. 5(*a*) schematically illustrates the heat exchanger 1. FIG. 5(*b*) illustrates the velocity distribution of airflow through the heat exchanger 1. FIG. 5(*c*) illustrates the distribution of liquid refrigerant flow rate in the liquid header 10. In FIG. 5(*a*) and FIG. 5(*b*), the vertical axis is height in the heat exchanger 1 illustrated in FIG. 5(*a*).

In the case of the heat exchanger 1 of a side-flow type with a single axial fan 30 disposed over the side of the heat exchanger 1 as in Embodiment 1, the velocity of airflow is greatest at the position of the height of the boss 31 of the axial fan 30. The velocity of airflow decreases as it is brought closer to the lower end or upper end of the heat exchanger 1. By contrast, the distribution of liquid refrigerant flow rate in the liquid header 10 is such that in the area from the lower end of the heat exchanger 1 to the boss centerline Ob, the flow rate of liquid refrigerant increases as it is brought closer to the boss 31, and in the area from the boss centerline Ob to the upper end of the heat exchanger 1, the flow rate of liquid refrigerant decreases as the distance from the boss 31 increases.

The above-mentioned distribution of liquid refrigerant flow rate in the liquid header 10 is obtained as a result of the difference in the amount of insertion between the branch tubes 12*a* and 12*b*. In the area of the liquid header 10 located below the boss centerline Ob, the branch tubes 12*a* penetrate the liquid layer of refrigerant flowing in the liquid header 10, resulting in reduced distribution of liquid refrigerant toward a lower part of the area, that is, toward a lower portion of the heat exchanger 1. By contrast, in the area of the liquid header 10 located above the boss centerline Ob, the branch tubes 12*b* fall within the liquid layer of refrigerant flowing in the liquid header 10, resulting in increased distribution of liquid refrigerant in a lower part of the area, that is, at the position of the height of the boss centerline Ob. The above-mentioned configuration allows refrigerant to be distributed in the heat exchanger 1 in a manner suited for the distribution of air velocity, leading to enhanced performance of the heat exchanger 1.

FIGS. 1 and 5 depict a case in which all the branch tubes 12*a* located below the boss centerline Ob penetrate the liquid layer of refrigerant flowing in the liquid header 10, and all the branch tubes 12*b* located above the boss centerline Ob fall within the liquid layer of refrigerant flowing in the liquid header 10. However, improved distribution in the heat exchanger 1 can be obtained as long as, for example, the branch tubes 12*a* and 12*b* are connected such that a half or more of the number of branch tubes 12*a* penetrate the liquid layer of refrigerant flowing in the liquid header 10, and a half or more of the number of branch tubes 12*b* fall within the liquid layer of refrigerant flowing in the liquid header 10. In particular, the branch tubes 12*a* and 12*b* having their insertion lengths adjusted as described above are each preferably positioned in an upstream area of the liquid header 10. The reason therefor is as follows. That is, in the case of an arrangement in which the liquid header 10 is divided relative to the boss centerline Ob into upper and lower areas, structural features located upstream in each area has a greater influence on liquid distribution characteristics than does structural features located further downstream.

The following describes the connection between the liquid header 10, and the branch tubes 12*a* located below the boss centerline Ob. In FIG. 1, the branch tubes 12*a* located below the boss centerline Ob are connected to the liquid header 10 such that the distal ends of the branch tubes 12*a* are positioned at the center of the inside diameter of the liquid header main tube 11. However, as long as the distal end portion of each branch tube 12*a* penetrates the liquid layer of refrigerant flowing in the liquid header 10, the distal end portion of the branch tube 12*a* may be positioned within a certain range of area near the center of the liquid header 10. Such a certain range of area near the center will be described below.

Figure 6:
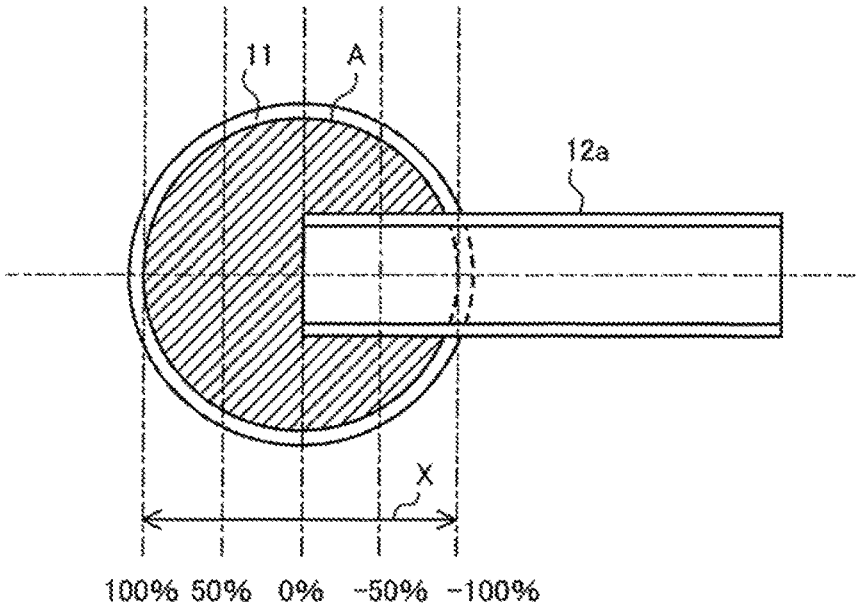
FIG. 6 illustrates the location, within a liquid header, of the distal end portion of each of a plurality of branch tubes connected below the centerline of a boss, according to Embodiment 1 of the present invention.
Figure 7:
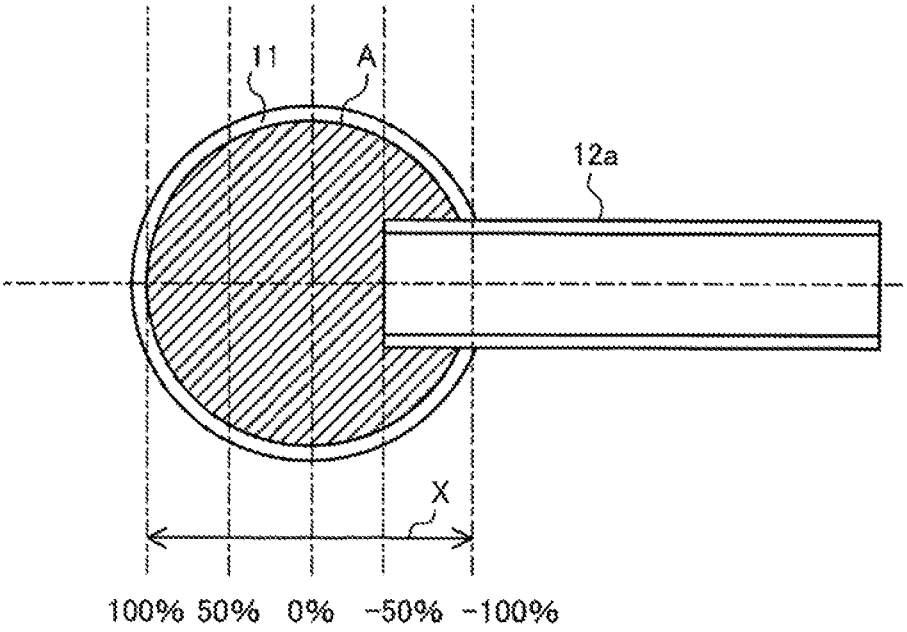
FIG. 7 illustrates an example of the location, within a liquid header, of the distal end portion of each of a plurality of branch tubes connected below the centerline of a boss, according to Embodiment 1 of the present invention.
Figure 8:
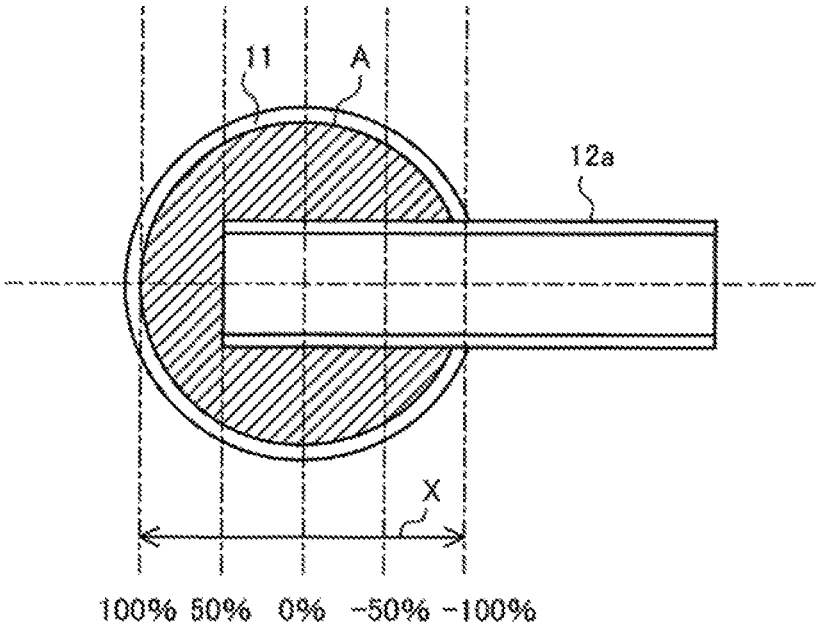
FIG. 8 illustrates another example of the location, within a liquid header, of the distal end portion of each of a plurality of branch tubes connected below the centerline of a boss, according to Embodiment 1 of the present invention.

FIG. 6 illustrates the location, within a liquid header, of the distal end portion of each of a plurality of branch tubes connected below the centerline of a boss, according to Embodiment 1 of the present invention. FIG. 7 illustrates an example of the location, within a liquid header, of the distal end portion of each of a plurality of branch tubes connected below the centerline of a boss, according to Embodiment 1 of the present invention. FIG. 8 illustrates another example of the location, within a liquid header, of the distal end portion of each of a plurality of branch tubes connected below the centerline of a boss, according to Embodiment 1 of the present invention.

The expression "near the center" as used herein means that, as illustrated in FIGS. 6, 7, and 8, when the center position in the horizontal plane of the flow space of the liquid header main tube 11 is defined as 0%, and the position of the wall surface in the horizontal plane of the flow space of the liquid header main tube 11 is defined as ±100%, the branch tube 12 is connected to the liquid header main tube 11 such that the distal end portion of the branch tube 12 falls within ±50%. Regarding the direction of the arrow X, the distal end portion of the branch tube 12 is illustrated to be located at the center position in FIG. 6, at the −50% position in FIG. 7, and at the 50% position in FIG. 8. In this case, "A" in FIGS. 6, 7, and 8 is effective channel cross-sectional area [$m^2$] in the horizontal cross-section taken at the position where the branch tube 12 is inserted.

Figure 9:
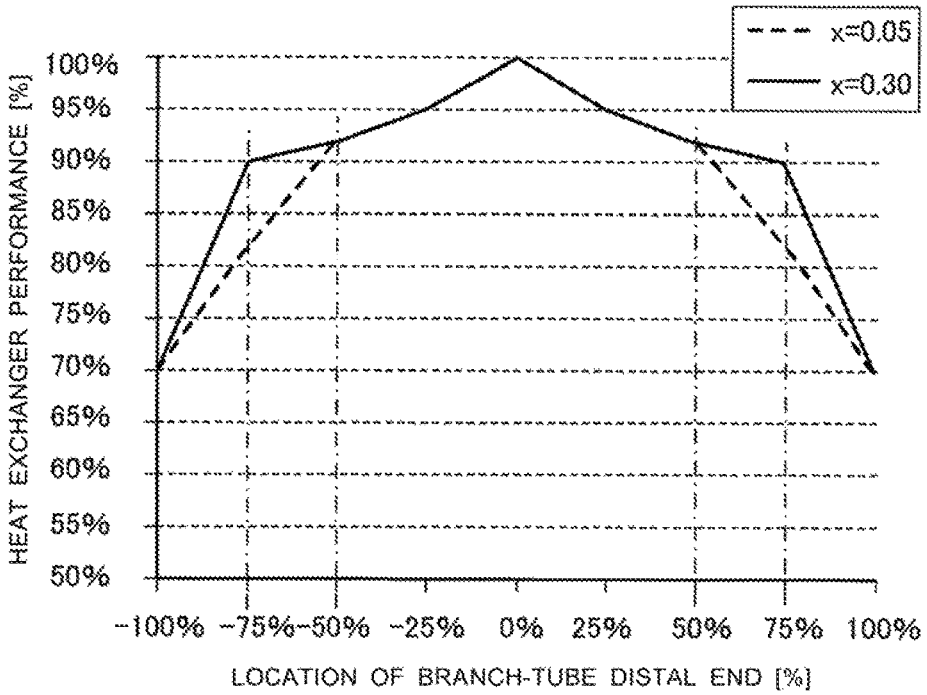
FIG. 9 illustrates an example of the relationship between the location of the distal end portion of each of a plurality of branch tubes connected below the centerline of a boss, and heat exchanger performance, according to Embodiment 1 of the present invention.

FIG. 9 illustrates an example of the relationship between the location of the distal end of each of a plurality of branch tubes connected below the centerline of a boss, and heat exchanger performance, according to Embodiment 1 of the present invention. FIG. 9 illustrates exemplary results of an experiment conducted by the inventors. The horizontal axis is the location of the distal end of each branch tube 12*a*, and the vertical axis is heat exchanger performance.

When the quality x=0.30, the performance of the heat exchanger 1 deteriorates sharply if the distal end portion of the branch tube 12*a* is located outside ±75%. When the quality x=0.05, the quality is lower and hence the liquid layer is thicker than when the quality x=0.30. Consequently, the performance of the heat exchanger 1 deteriorates sharply if the distal end portion of the branch tube 12*a* is located outside ±50%. By contrast, if the distal end portion of the branch tube 12*a* is located within ±50%, the deterioration in the performance of the heat exchanger 1 is slight.

Accordingly, assuming that the quality x=0.05 and hence the liquid layer is thick, improved distribution performance can be obtained by positioning the distal end portion of the branch tube 12 within ±50%. If the distal end portion of each branch tube 12*a* located below the boss centerline Ob is positioned within ±50%, this ensures that, in the area of the liquid header 10 from the lower end to the boss centerline Ob, a large amount of liquid refrigerant can be distributed in an upper part of the area, that is, near the position of the height of the boss centerline Ob. More desirably, if the distal end portion of the branch tube 12*a* is positioned at the center of the inside diameter of the liquid header main tube 11, that is, at the 0% position. This configuration allows more liquid refrigerant to be directed upward over a wider range of refrigerant flow rate conditions.

If the distal end portion of each branch tube 12*b* located above the boss centerline Ob lies within the range of greater than or equal to −100% and less than −50%, or within the range of greater than 50% and less than or equal to 100%, such a configuration is more desirable as this allows more liquid refrigerant to be directed downward in the area of the liquid header 10 from the boss centerline Ob to the upper end.

According to the results of an experiment and analysis conducted by the inventors, when the quality of refrigerant entering the liquid header 10 is $0.05 \leq x \leq 0.30$, the thickness δ [m] of the liquid layer approximates relatively well to $\delta = G \times (1-x) \times D / (4\ \rho_L \times U_{LS})$, where G is refrigerant flow velocity [$kg/(m^2s)$], x is refrigerant quality, D is the inside diameter [m] of the liquid header 10, $\rho_L$ is refrigerant liquid density [$kg/m^3$], and $U_{LS}$ is reference liquid apparent velocity [m/s], which is the maximum value within the variation range of the gas apparent velocity of refrigerant flowing into the flow space of the liquid header 10. Accordingly, the distal end portion of each branch tube 12*a* connected to the liquid header 10 at a position below the boss centerline Ob may be positioned anywhere as long as the distal end portion protrudes beyond the thickness δ of the liquid layer determined by the above-mentioned equation, and reaches the gas-phase refrigerant Ra in the flow space of the liquid header 10. The reference liquid apparent velocity $U_{LS}$ [m/s] is defined as $G(1-x)/\rho_L$.

A flow pattern is determined from the flow pattern chart for vertical upward flow, and set based on the reference gas apparent velocity $U_{GS}$ [m/s] of refrigerant at the maximum value within the variation range of the flow velocity of refrigerant entering the flow space of the liquid header main tube 11. Desirably, the reference gas apparent velocity $U_{GS}$ [m/s] of refrigerant entering the liquid header main tube 11 satisfies the following condition: $U_{GS} \geq \alpha \times L \times (g \times D)^{0.5}/(40.6 \times D) - 0.22\alpha \times (g \times D)^{0.5}$. Further desirably, the reference gas apparent velocity $U_{GS}$ [m/s] satisfies the following condition: $U_{GS} \geq 3.1/(\rho_G^{0.5}) \times [\sigma \times g \times (\rho_L - \rho_G)]^{0.25}$.

Figure 10:
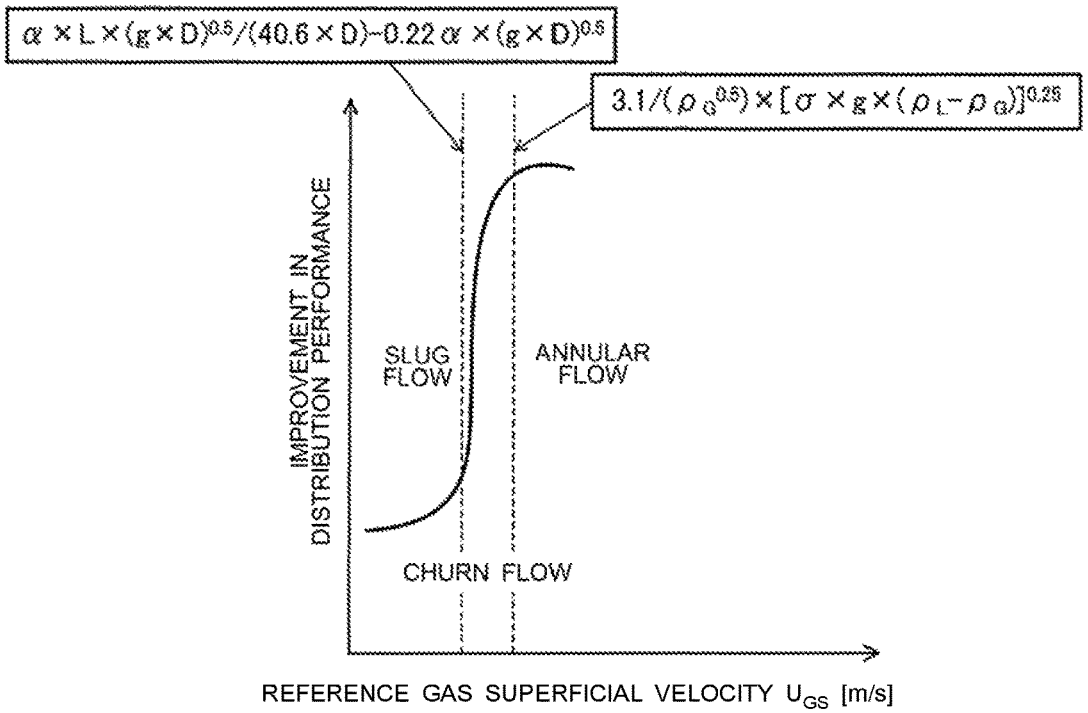
FIG. 10 illustrates the relationship among the apparent velocity of gas flow into a liquid header, improvement in distribution performance, and flow patterns, according to Embodiment 1 of the present invention.

FIG. 10 illustrates the relationship between reference gas apparent velocity $U_{GS}$ [m/s] of refrigerant and improvement in distribution performance, according to Embodiment 1 of the present invention. As illustrated in FIG. 10, when the reference gas apparent velocity $U_{GS}$ [m/s] of refrigerant falls within the above-specified range, the flow of refrigerant in the liquid header 10 follows an annular or churn flow pattern, and thus an improvement in distribution performance can be expected.

Now, $\alpha$ is defined as refrigerant void fraction $\alpha = x/[x + (\rho_G/\rho_L) \times (1-x)]$, L is defined as entrance length [m], g is defined as acceleration due to gravity [m/s$^2$], D is defined as the inside diameter [m] of the liquid header 10, x is defined as refrigerant quality, $\rho_G$ is defined as refrigerant gas density [kg/m$^3$], $\rho_L$ is defined as refrigerant liquid density [kg/m$^3$], and $\sigma$ is defined as refrigerant surface tension [N/m]. The refrigerant void fraction $\alpha$ can be measured by, for example, a method such as measurement using electrical resistance or observation based on visualization. The entrance length $L_2$ [m] at the inlet portion of the liquid header 10 is defined as the distance between the position of the inlet portion of the liquid header 10 where refrigerant enters, and the position of the central axis of the branch tube 12 located closest to the inlet portion.

The reference gas apparent velocity $U_{SG}$, which is calculated by measuring the flow velocity G of refrigerant entering the liquid header 10, refrigerant quality x, and refrigerant gas density $\rho_G$, is defined as $U_{SG} = (G \times x)/\rho_G$.

As illustrated in FIG. 10, the improvement in distribution performance is sharply increased if the following condition is satisfied: $U_{SG} \geq \alpha \times L_2 \times (g \times D)^{0.5}/(40.6 \times D) - 0.22\alpha \times (g \times D)^{0.5}$. The improvement is particularly pronounced if the following condition is satisfied: $U_{SG} \geq 3.1/(\rho_G^{0.5}) \times [\sigma \times g \times (\rho_L - \rho_G)]^{0.25}$.

If, for instance, the liquid header 10 is equipped to an air-conditioning apparatus, at the maximum value within the variation range of the flow velocity of refrigerant entering the flow space of the liquid header 10, during rated heating operation, two-phase gas-liquid refrigerant flows through the flow space of the liquid header 10 as an upward flow.

When the quality of refrigerant entering the liquid header 10 falls within the range of $0.05 \leq x \leq 0.30$, the refrigerant flows in the liquid header main tube 11 in such a flow pattern that a large amount of liquid-phase refrigerant Rb is distributed near the wall surface. This is desirable from the viewpoint of achieving a particularly large improvement in distribution performance and consequently in heat exchanger performance due to the protrusion of the branch tubes 12.

In the foregoing description, for the branch tubes 12*a* located below the boss centerline Ob, the central axis of each branch tube 12*a* that extends in the horizontal direction (arrow X direction) and the central axis of the liquid header main tube 11 that extends in the vertical direction (arrow Z direction) intersect each other. However, for example, the horizontally-extending central axis of the branch tube 12*a* may be shifted from the vertically-extending central axis of the liquid header main tube 11.

Figure 11:
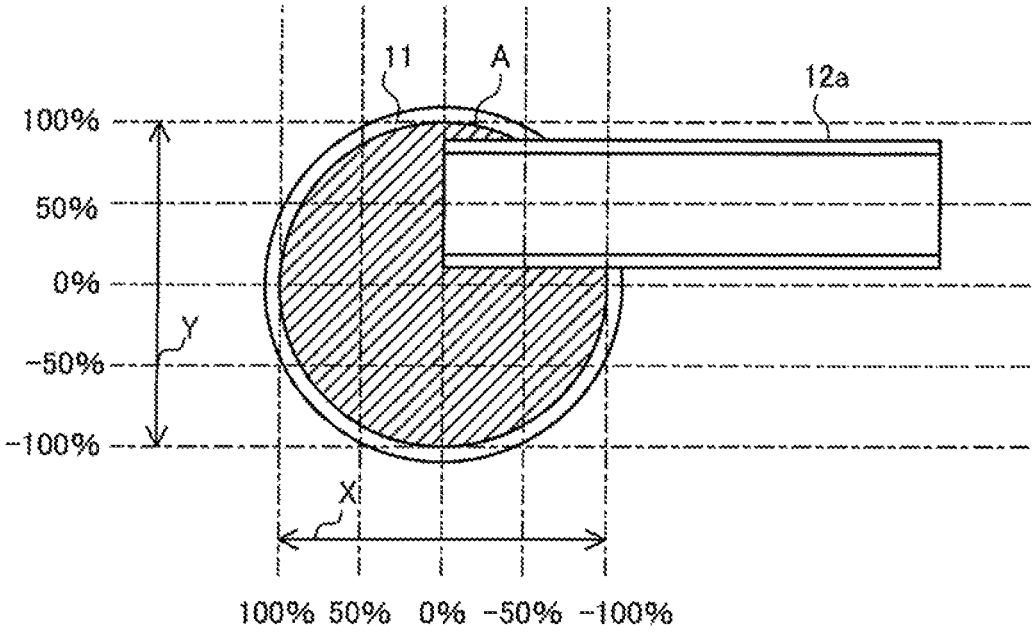
FIG. 11 illustrates another example of the location, within a liquid header, of the distal end portion of each of a plurality of branch tubes connected below the centerline of a boss, according to Embodiment 1 of the present invention.
Figure 12:
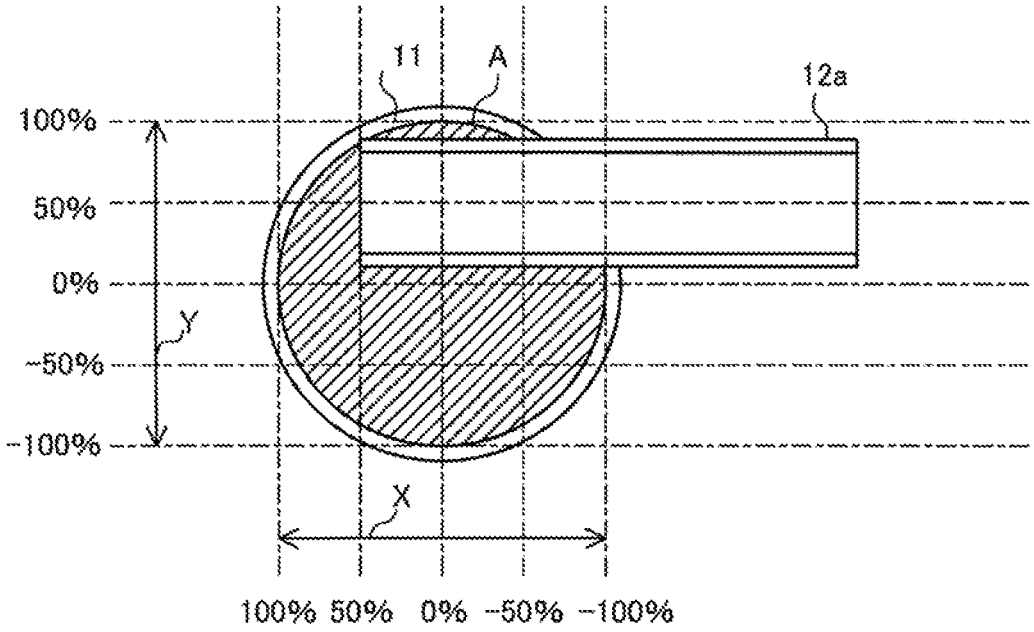
FIG. 12 illustrates another example of the location, within a liquid header, of the distal end portion of each of a plurality of branch tubes connected below the centerline of a boss, according to Embodiment 1 of the present invention.

FIG. 11 illustrates another example of the location, within the liquid header 10, of the distal end portion of each of a plurality of branch tubes connected to a portion of the liquid header 10 below the boss centerline, according to Embodiment 1 of the present invention. FIG. 12 illustrates an example of the location, within the liquid header 10, of the distal end portion of each of a plurality of branch tubes connected to a portion of the liquid header 10 below the boss centerline, according to Embodiment 1 of the present invention.

In this case, the center position in the horizontal plane of the flow space of the liquid header main tube 11 is defined as 0%. The wall surface position in the flow space of the liquid header main tube 11 in the horizontal plane is defined as ±100%. The direction of insertion of the branch tubes 12 in the horizontal plane is defined as X-direction, and the direction of width of the branch tubes 12 in the horizontal plane is defined as Y-direction.

A case is considered in which, as illustrated in FIG. 11, the central axis of each branch tube 12*a* located below the boss centerline Ob is shifted relative to the Y-direction. In this regard, the greatest improvement in distribution performance is obtained when the distal end portion of the branch tube 12*a* is located at the 0% position relative to the X-direction and when the central axis of the branch tube 12*a* is located at the 0% position relative to the Y-direction. However, as long as the central axis of the branch tube 12*a* is located within ±50%, improved distribution performance can be obtained by utilizing the characteristics of an annular or churn flow pattern. Further, when the quality of refrigerant entering the liquid header 10 falls within the range of $0.05 \leq x \leq 0.30$, improved distribution performance can be obtained by utilizing the characteristics of a flow pattern in which a large amount of liquid-phase refrigerant Rb is distributed near the wall surface of the liquid header main tube 11.

As illustrated in FIG. 12, if the central axis of each branch tube 12*a* located below the boss centerline Ob is located within ±50% relative to the Y-direction and, at the same time, the distal end portion of the branch tube 12*a* is located within ±50% relative to the X-direction, such a configuration is desirable as this allows the protrusion length to be easily controlled by connecting the branch tube 12*a* such that a portion of the branch tube 12*a* comes into contact with the inner wall of the liquid header main tube 11.

Preferably, all the branch tubes 12*a* located below the boss centerline Ob are inserted by the same amount. However, the branch tubes 12*a* may not necessarily be inserted by the same amount as long as the distal end portion of each branch tube 12*a* or the central axis of each branch tube 12*a* lies within ±50%.

The improvement in the performance of the heat exchanger 1 due to improved distribution can be increased by using a refrigerant mixture of two or more refrigerants with different boiling points selected from the group consisting of, but not limited to, an olefin-based refrigerant such as R1234yf or R1234ze(E), a HFC refrigerant such as R32, a hydrocarbon refrigerant such as propane or isobutane, $CO_2$, and dimethyl ether (DME).

The present invention is dependent on the flow pattern of refrigerant flowing in the liquid header 10 in a two-phase gas-liquid state. For this reason, it is desirable for the flow of two-phase gas-liquid refrigerant to be in a sufficiently developed state. According to an experiment conducted by the inventors, as for the entrance length L required for sufficient development of two-phase gas-liquid refrigerant, if the condition L≥5D is satisfied, where D is the inside diameter [m] of the liquid header main tube 11, the improvement in distribution performance can be increased. More desirably, the entrance length L satisfies the condition L≥10D.

Figure 13:
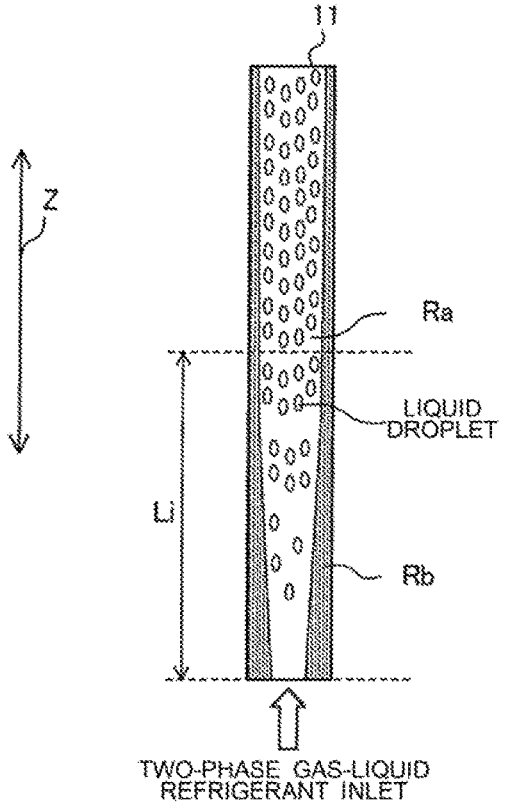
FIG. 13 schematically illustrates an entrance length Li and development of two-phase gas-liquid refrigerant in a liquid header, according to Embodiment 1 of the present invention.

FIG. 13 schematically illustrates an entrance length Li and development of two-phase gas-liquid refrigerant in a liquid header, according to Embodiment 1 of the present invention. Refrigerant in a two-phase gas-liquid state flows into the liquid header 10 as a vertical upward flow through the refrigerant inlet in a lower portion of the liquid header 10. The liquid layer is thick at the inlet portion, but gradually is reduced in thickness as liquid droplets begin to form following development of the refrigerant flow. The thickness of the liquid layer is constant in an upper portion of the liquid header 10 where the annular flow has sufficiently developed and the distance from the refrigerant inlet is greater than or equal to the entrance length Li.

Figure 14:
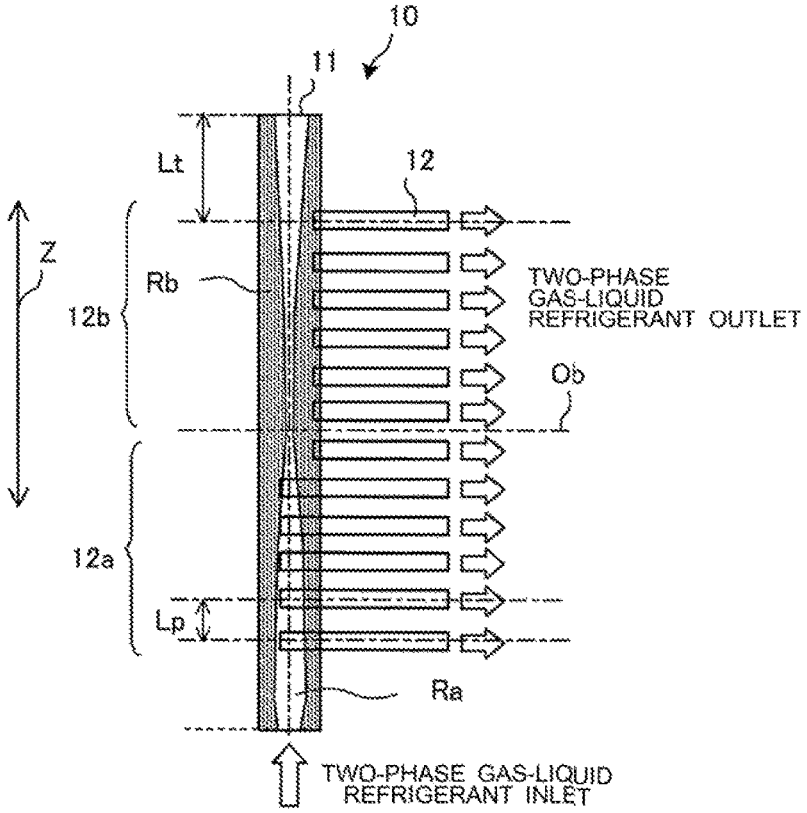
FIG. 14 schematically illustrates another example of a liquid header, according to Embodiment 1 of the present invention.

FIG. 14 schematically illustrates another example of a liquid header, according to Embodiment 1 of the present invention. When the pitch length between adjacent branch tubes 12 is defined as Lp, and the length of a stagnation region in an upper portion of the liquid header 10 is defined as Lt, the relationship Lt≥2×Lp holds. This configuration mitigates the influence of collision of two-phase gas-liquid refrigerant in an upper portion of the liquid header 10, leading to stabilized flow pattern and consequently greater improvement in distribution performance.

Figure 15:
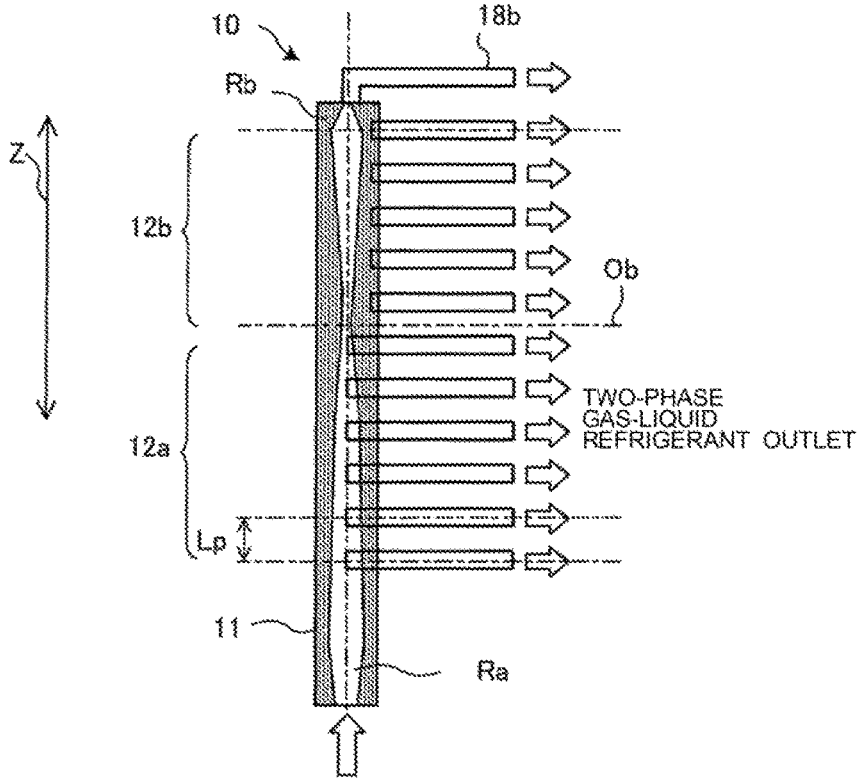
FIG. 15 schematically illustrates another example of a liquid header, according to Embodiment 1 of the present invention.

FIG. 15 schematically illustrates another example of a liquid header, according to Embodiment 1 of the present invention. In FIG. 15, an end branch tube 18*b* is connected to the upper end of the liquid header 10 from above. This configuration minimizes a decrease in dynamic pressure resulting from the collision of refrigerant in an upper portion of the liquid header 10. This leads to stabilized flow pattern and consequently greater improvement in distribution performance.

It is to be noted that the foregoing description of the branch tube 12 made regarding the location of its end portion does not apply to, for example, a branch tube such as the end branch tube 18*b* that is connected from the upper or lower end of the liquid header main tube 11.

Figure 16:
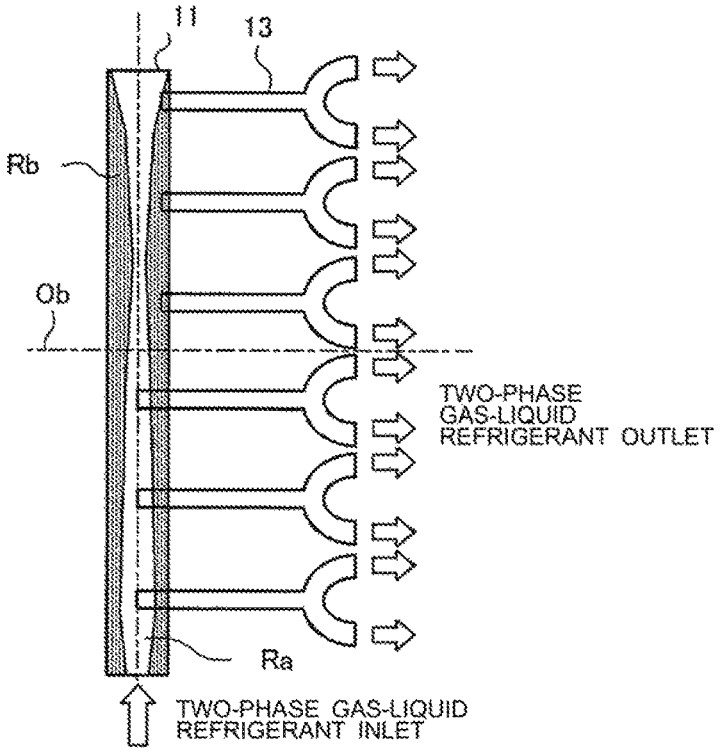
FIG. 16 schematically illustrates another example of a liquid header, according to Embodiment 1 of the present invention.

FIG. 16 schematically illustrates another example of a liquid header, according to Embodiment 1 of the present invention. FIG. 16 depicts use of bifurcated tubes 13 as the branch tubes 12. Each bifurcated tube 13 has two outlets for each inlet that receives flow from the liquid header main tube 11. Using the bifurcated tubes 13 as the branch tubes 12 helps minimize fluctuations in dynamic pressure resulting from the protrusion of the branch tubes 12*a* located below the boss centerline Ob into the liquid header main tube 11. This helps minimize fluctuations in flow pattern in the liquid header 10, leading to enhanced efficiency of the heat exchanger 1.

The foregoing description is directed to the bifurcated tubes 13 each having two inlets for each inlet. However, the configuration of the branch tubes 12 is not limited thereto. Any branch tube 12 having a larger number of outlets than inlets may be employed. FIG. 16 depicts a case in which all of the branch tubes 12 are formed as the bifurcated tubes 13. However, only one or more of the branch tubes 12 may be formed as the bifurcated tubes 13.

Figure 17:
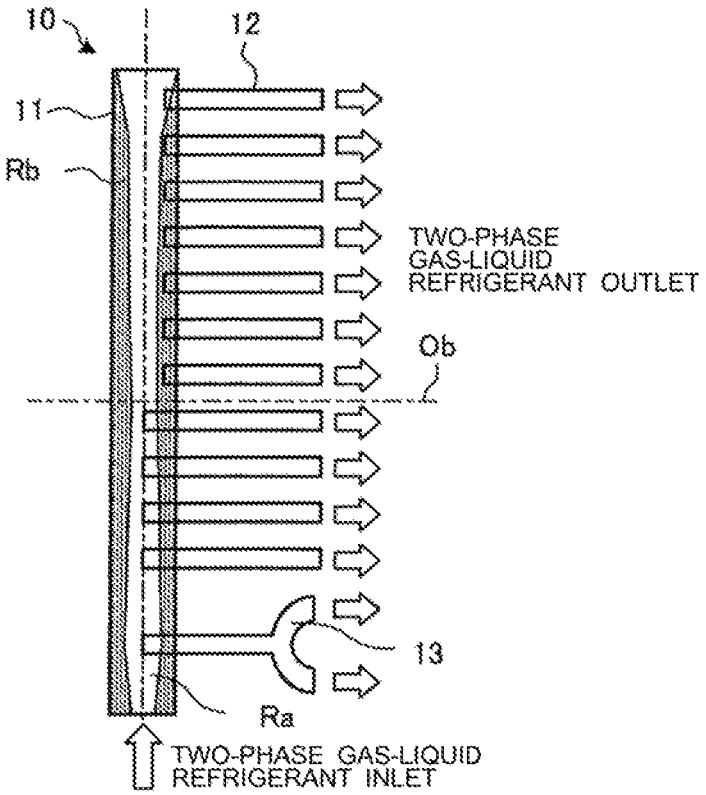
FIG. 17 schematically illustrates another example of a liquid header, according to Embodiment 1 of the present invention.

FIG. 17 schematically illustrates another example of a liquid header, according to Embodiment 1 of the present invention. FIG. 17 depicts a case in which one of the branch tubes is the bifurcated tube 13, and the other branch tubes are the branch tubes 12 with one inlet and one outlet. If the bifurcated tube 13 is used as one or more branch tubes, the bifurcated tube 13 is preferably positioned close to a lower portion of the liquid header 10 where the flow rate of refrigerant is high. This configuration is desirable from the viewpoint of efficiently minimizing a decrease in dynamic pressure resulting from the protrusion of branch tubes.

The branch tube 12 has been described above as a component of the liquid header 10. However, for example, the branch tube 12 may be formed of a portion of a heat transfer tube by extending a portion of the circular heat transfer tube 22 of the heat exchanger 1. Since the branch tube 12 may be substituted for by a portion of the heat transfer tube 22 in some cases, its inner surface may be machined to have a heat transfer-facilitating feature such as a groove.

Although the inlet pipe 52 is connected to the lower end of the liquid header main tube 11 in FIG. 1, the inlet pipe 52 may be connected to the side of the liquid header main tube 11, as long as the inlet pipe 52 is positioned within the space defined between the lower end of the liquid header main tube 11 and the branch tube 12 positioned closest to the lower end.

Figure 18:
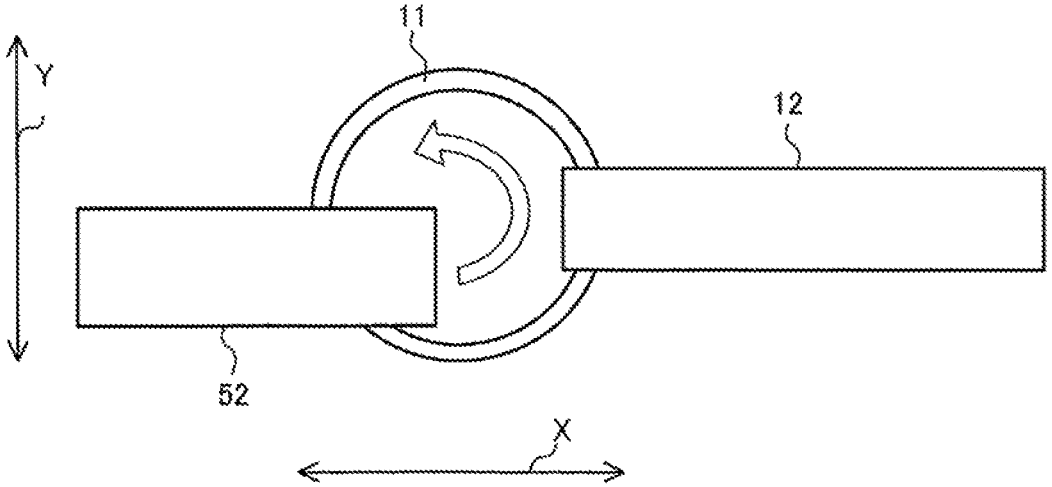
FIG. 18 illustrates an example of the location where a liquid header and an inlet pipe are connected to each other, according to Embodiment 1 of the present invention.

FIG. 18 illustrates an example of the location where a liquid header and an inlet pipe are connected to each other, according to Embodiment 1 of the present invention. As illustrated in FIG. 18, if the inlet pipe 52 is to be connected to the side of the liquid header main tube 11, the inlet pipe 52 is preferably positioned offset relative to the centerline of the liquid header main tube 11. This facilitates transition of the flow of two-phase gas-liquid refrigerant in the liquid header 10 into an annular flow, leading to improved refrigerant distribution.

As described above, in Embodiment 1, the air-conditioning apparatus includes the heat exchanger 1, the axial fan 30, and the refrigerant circuit. The heat exchanger 1 includes the heat transfer tubes 22 in which refrigerant flows, the heat transfer tubes 22 being arranged so as to be spaced apart from each other in the vertical direction, and the header manifold (liquid header main tube 11) that has a flow space defined inside the header manifold and extending in the vertical direction (arrow Z direction), the header manifold allowing refrigerant to flow into the heat transfer tubes 22 from the branch tubes 12 arranged so as to be spaced apart from each other in the vertical direction. The axial fan 30 includes the blades 32 disposed around the boss 31 that rotates. The blades 32 have a rotational plane that faces the heat transfer tubes 22 in the horizontal direction. The refrigerant circuit is a circuit to direct the refrigerant into the flow space such that the refrigerant flows upward in a two-phase gas-liquid state, and to cause the refrigerant to evaporate in the heat exchanger 1. The refrigerant flows in the header manifold in an annular or churn flow pattern in which the gas-phase refrigerant Ra collects at the center of the header manifold and the liquid-phase refrigerant Rb collects on the wall surface of the header manifold. When the distance from the center of the flow space in the horizontal plane is represented on a scale of 0 to 100%, where 0% is the center of the flow space and 100% is the position of the wall surface of the header manifold, among the branch tubes 12 located within a height range that allows the blades 32 to rotate, the majority of the branch tubes 12*a* located at or below the height of the boss 31 are connected to the header manifold such that their distal ends are positioned at 0 to 50% of the distance from the center, and the majority of the branch tubes 12*b* located above the height of the boss 31 are connected to the header manifold such that their distal ends are positioned at more than 50% of the distance from the center.

Due to the above configuration, in the air-conditioning apparatus, the branch tubes 12 are connected to the liquid header main tube 11 such that, at positions above the boss 31, the branch tubes are covered in the liquid layer, and at positions below the boss 31, the branch tubes penetrate the liquid layer. Consequently, for a case in which a large amount of liquid-phase refrigerant Rb is distributed along the wall surface inside the liquid header 10, in the area above the boss 31, a large amount of liquid refrigerant is directed toward a lower portion of the area, whereas in the area below the boss 31, a large amount of liquid refrigerant is directed toward an upper portion of the area. Therefore, in the case of the heat exchanger 1 in a side-flow arrangement, the above-mentioned configuration makes it possible to obtain a distribution of liquid refrigerant flow rate suited for the distribution of air velocity that has a peak near the height of the boss centerline Ob. As a result, in the air-conditioning apparatus, the performance of the heat exchanger 1 can be enhanced, leading to enhanced energy efficiency.

Among the branch tubes 12*a* located at a position at or below the height of the boss 31, the branch tube whose distal end position is at 0 to 50% of the distance from the center and which is located most upstream has a distal end that penetrates the liquid layer of the thickness δ [m], which is formed as the liquid-phase refrigerant Rb collects on the wall surface, and reaches the gas-phase refrigerant Ra. Among the branch tubes 12*b* located above the height of the boss 31, the branch tube whose distal end position is at more than 50% of the distance from the center and which is located most upstream has a distal end that falls within the liquid layer. The thickness δ [m] of the liquid layer is defined as $\delta = G \times (1-x) \times D/(4\rho_L \times U_{LS})$, where G is refrigerant flow velocity [kg/(m$^2$s)], x is refrigerant quality, D is the inside diameter [m] of the header manifold, $\rho_L$ is refrigerant liquid density [kg/m$^3$], and $U_{LS}$ is reference liquid apparent velocity [m/s], which is the maximum value within the variation range of gas apparent velocity of refrigerant entering the flow space of the header manifold. The reference liquid apparent velocity $U_{LS}$ [m/s] is defined as $G(1-x)/\rho_L$.

Accordingly, the branch tubes 12*a* connected below the height of the boss 31 may be inserted at any length into the liquid header 10 as long as the branch tubes 12*a* penetrate at least the liquid layer having the thickness δ [m] determined by the above-mentioned equation based on the experimental results. Consequently, the adjustable range of insertion length into the liquid header 10 can be increased.

In the heat exchanger 1, the refrigerant entering the header manifold (liquid header main tube 11) has a quality x in the range of $0.05 \leq x \leq 0.30$. This ensures that the flow of refrigerant in the liquid header 10 readily follows a flow pattern in which a large amount of liquid-phase refrigerant Rb is distributed along the wall surface of the liquid header 10. Such a configuration, when combined with the method of connecting the branch tubes 12 mentioned above, helps provide improved distribution.

Embodiment 2

Figure 19:
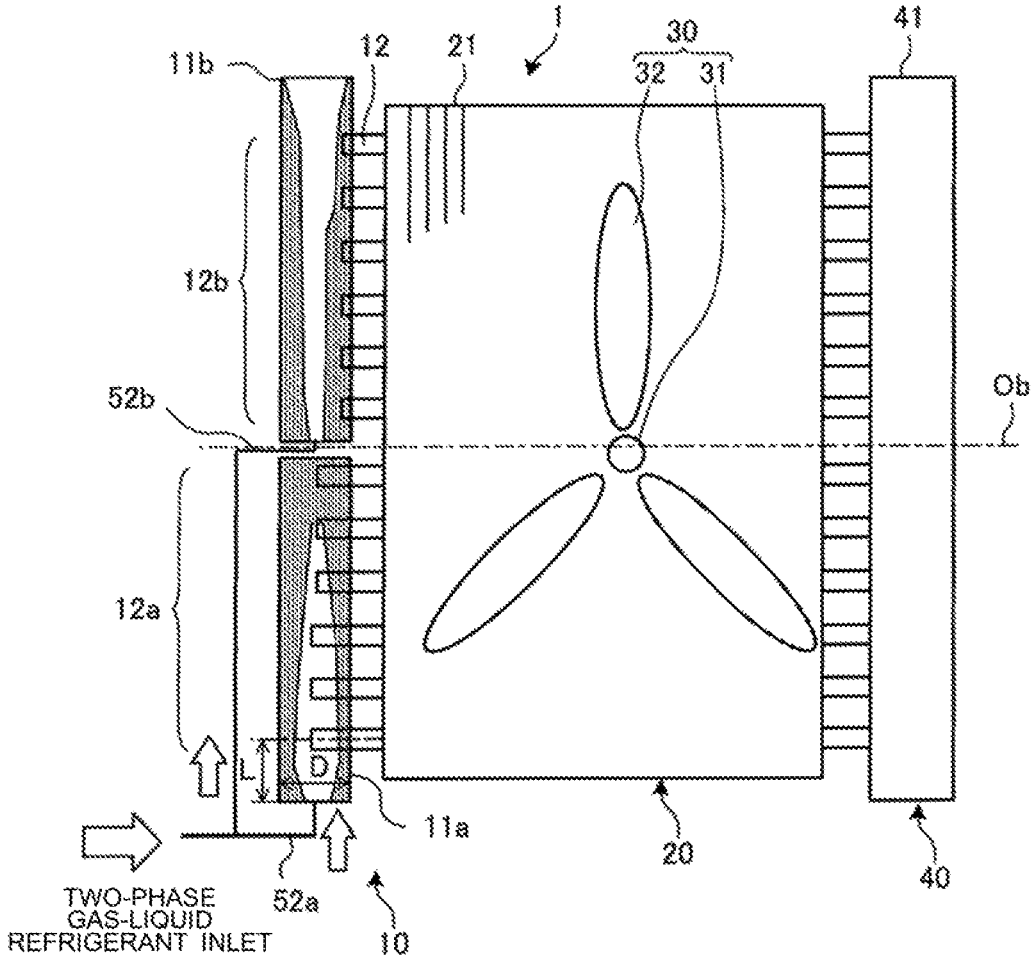
FIG. 19 schematically illustrates an example of a heat exchanger, according to Embodiment 2 of the present invention.

FIG. 19 schematically illustrates an example of a heat exchanger, according to Embodiment 2 of the present invention. In Embodiment 2, a single axial fan 30 is disposed over the side of the heat exchanger 1, and the liquid header main tube 11 of the liquid header 10 is divided in two relative to the boss centerline Ob of the boss 31 of the axial fan 30 into upper and lower parts, of which the lower part constitutes a first liquid header main tube 11*a* and the upper part constitutes a second liquid header main tube 11*b*. In the liquid header 10, the branch tubes 12*a* located below the boss centerline Ob are connected to the first liquid header main tube 11*a*. Each branch tube 12*a* is inserted up to a point near the center of the inside diameter of the first liquid header main tube 11*a* so as to penetrate the liquid layer. The branch tubes 12*b* located above the boss centerline Ob are connected to the second liquid header main tube 11*b* so as to be covered in the liquid layer. A first inlet pipe 52*a* is connected upstream of the first liquid header main tube 11*a*, and a second inlet pipe 52*b* is connected upstream of the second liquid header main tube 11*b*. Although the first inlet pipe 52*a* and the second inlet pipe 52*b* are respectively connected to the lower end of the first liquid header main tube 11*a* and the lower end of the second liquid header main tube 11*b* in FIG. 19, the first inlet pipe 52*a* and the second inlet pipe 52*b* may not necessarily be connected at the above-mentioned positions.

Figure 20:
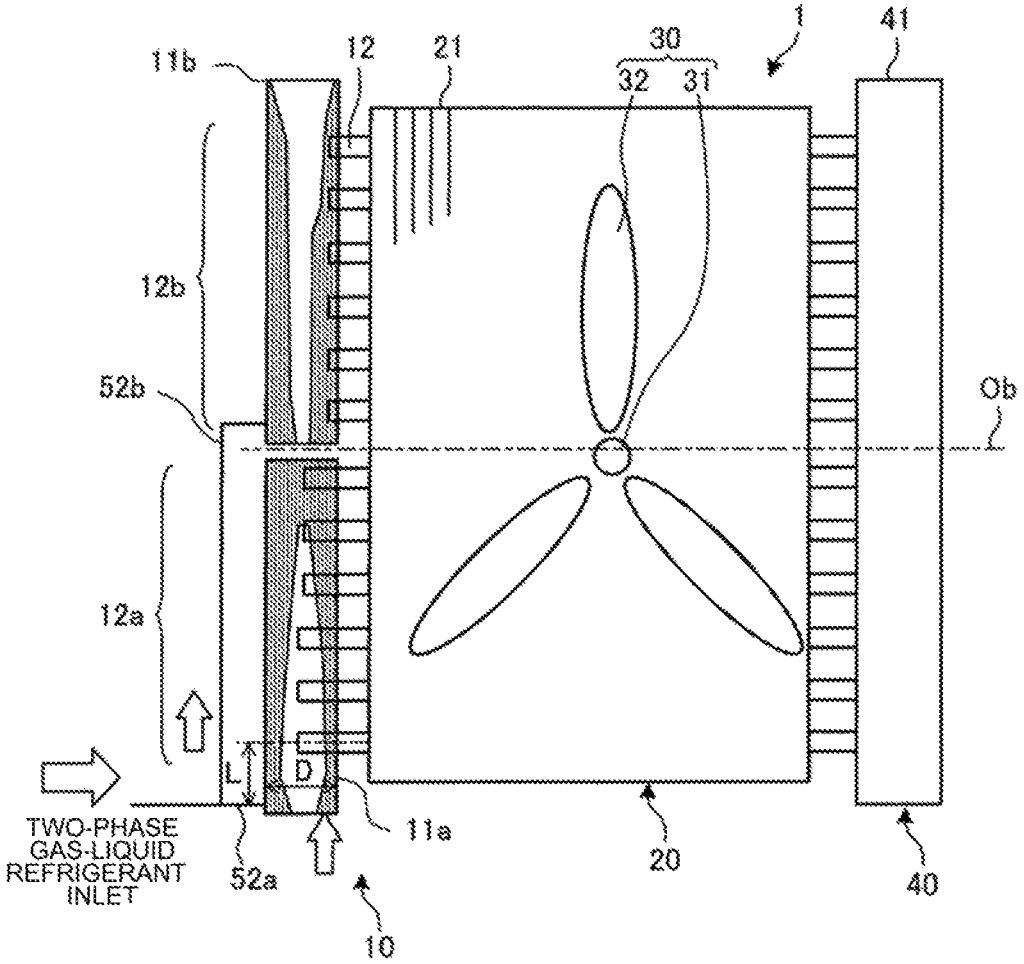
FIG. 20 schematically illustrates another example of a heat exchanger, according to Embodiment 2 of the present invention.

FIG. 20 schematically illustrates another example of a liquid header, according to Embodiment 2 of the present invention. As illustrated in FIG. 20, each inlet pipe may be connected to the side of the corresponding liquid header main tube, as long as the inlet pipe is positioned within the space defined between the lower end of the liquid header main tube and the branch tube located closest to the lower end. In particular, with regard to the second liquid header main tube 11*b*, by connecting the second inlet pipe 52*b* to the side of the second liquid header main tube 11*b*, the first liquid header main tube 11*a* and the second liquid header main tube 11*b* can be placed coaxially above and below each other. This facilitates the control of insertion of the branch tubes 12 into the liquid header 10, leading to enhanced ease of manufacture.

Figure 21:
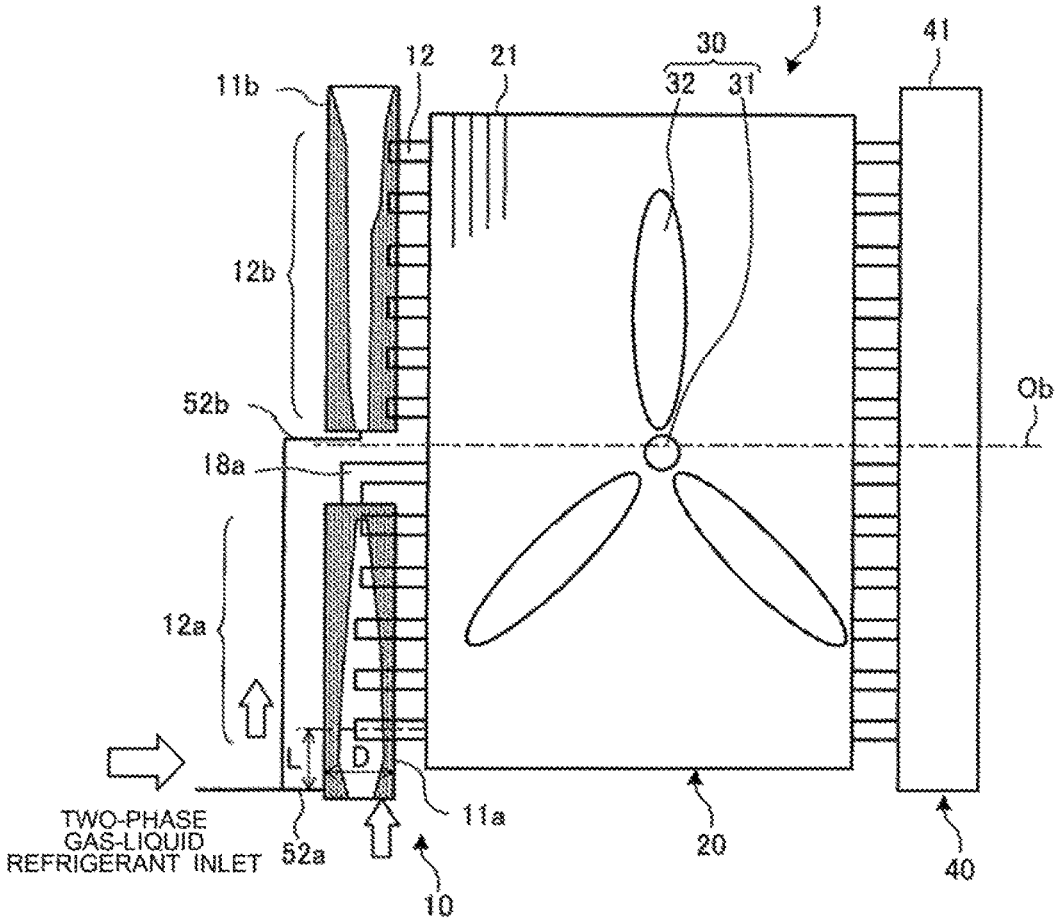
FIG. 21 schematically illustrates another example of a heat exchanger, according to Embodiment 2 of the present invention.

FIG. 21 schematically illustrates another example of a heat exchanger, according to Embodiment 2 of the present invention. In FIG. 21, an end branch tube 18*a* is connected to the upper end of the first liquid header main tube 11*a* from above. As a result, a space for connecting the second inlet pipe 52*b* to the lower end of the second liquid header main tube 11*b* can be easily provided in the liquid header 10. Further, the above-mentioned configuration allows the flow pattern to be stabilized by directing refrigerant into the second liquid header main tube 11*b* from the lower end, and also helps minimize a decrease in dynamic pressure resulting from the collision of refrigerant in an upper portion of the first liquid header main tube 11*a*.

It is to be noted that the foregoing description of the branch tube 12 made regarding the location of its distal end portion does not apply to, for example, a branch tube such as the end branch tube 18*a* that is connected from the upper or lower end of the corresponding liquid header main tube.

Although FIGS. 19 to 21 depict a case in which each branch tube 12*a* connected below the boss centerline Ob is inserted up to a point near the center of the inside diameter of the first liquid header main tube 11*a*, the branch tube 12*a* may be positioned in any manner as long as the branch tube 12*a* penetrates the thickness δ [m] of the liquid layer as in Embodiment 1.

In connecting the branch tubes 12*a* to the first liquid header main tube 11*a*, the features described above with reference to Embodiment 1, such as the equation of the thickness δ [m] of the liquid layer, the range of locations of the distal end portions of the branch tubes 12*a*, the refrigerant quality range, and the characteristics of flow patterns, can be employed to thereby achieve improved distribution performance by utilizing the characteristics of an annular or churn flow pattern.

As for the second liquid header main tube 11*b*, the branch tubes 12*b* may be connected to the second liquid header main tube 11*b* in any manner as long as their insertion length is less than the thickness δ [m] of the liquid layer.

Figure 22:
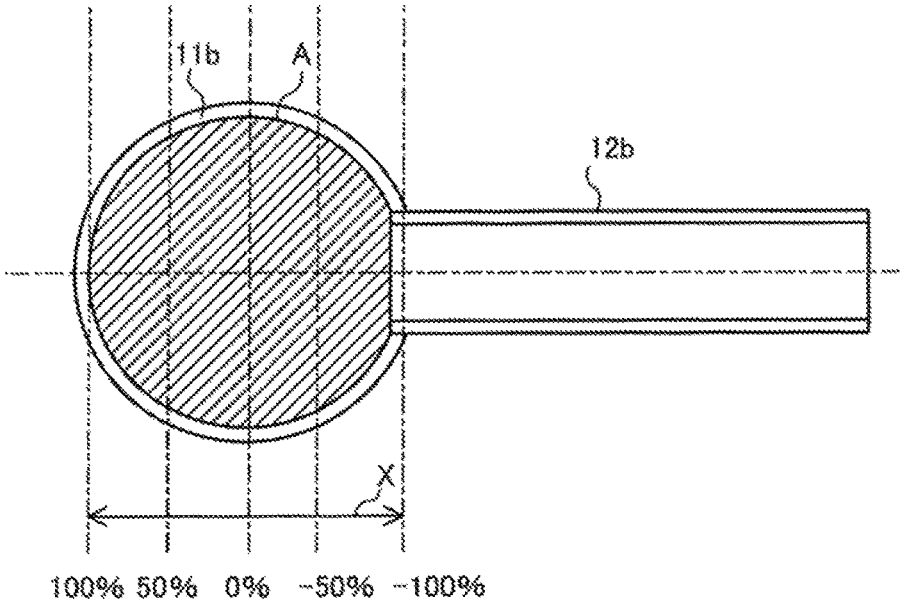
FIG. 22 illustrates the location, within a second liquid header, of the distal end portion of each of a plurality of branch tubes connected to the second liquid header, according to Embodiment 2 of the present invention.
Figure 23:
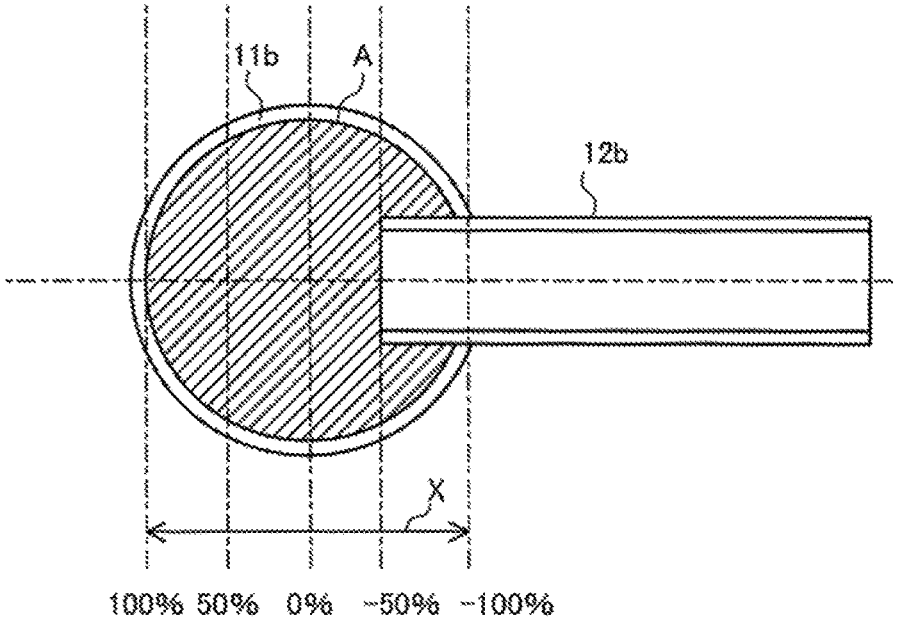
FIG. 23 illustrates an example of the location, within a second liquid header, of the distal end portion of each of a plurality of branch tubes connected to the second liquid header, according to Embodiment 2 of the present invention.
Figure 24:
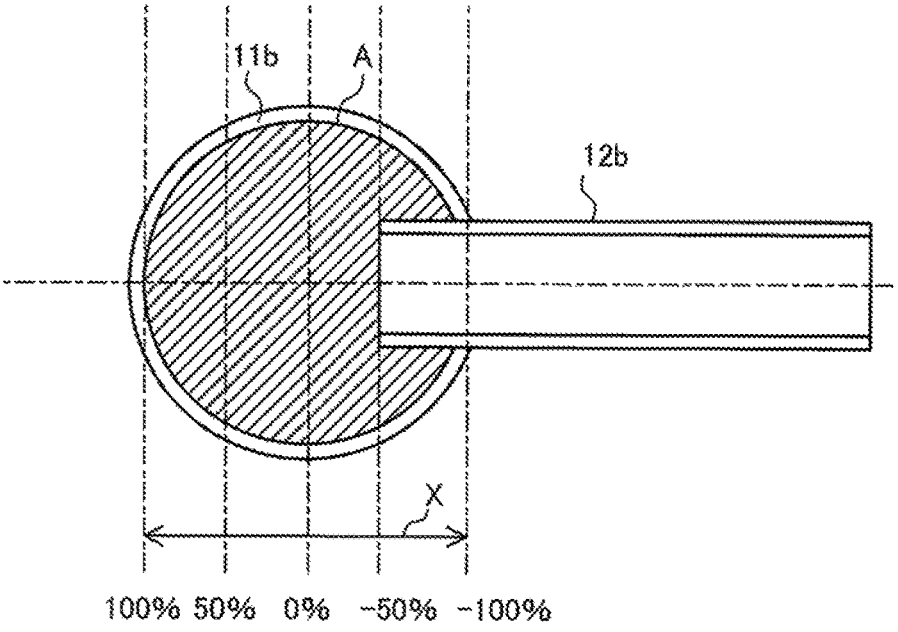
FIG. 24 illustrates another example of the location, within a second liquid header, of the distal end portion of each of a plurality of branch tubes connected to the second liquid header, according to Embodiment 2 of the present invention.

The following describes, with reference to FIGS. 22 to 24, the insertion length of the branch tubes 12*b* connected below the boss centerline Ob. FIG. 22 illustrates the location, within a second liquid header, of the distal end portion of each of a plurality of branch tubes connected to the second liquid header, according to Embodiment 2 of the present invention. FIG. 23 illustrates an example of the location, within a second liquid header, of the distal end portion of each of a plurality of branch tubes connected to the second liquid header, according to Embodiment 2 of the present invention. FIG. 24 illustrates another example of the location, within a second liquid header, of the distal end portion of each of a plurality of branch tubes connected to the second liquid header, according to Embodiment 2 of the present invention.

The center position in the horizontal plane of the flow space of the branch tubes 12*b* connected to the second liquid header main tube 11*b* is defined as 0%, and the position of the wall surface in the horizontal plane of the flow space of the second liquid header main tube 11*b* is defined as ±100%. In FIG. 22, the branch tubes 12*b* are connected along the wall surface of the second liquid header main tube 11*b*. The distal end portion of each branch tube 12*b* is inserted at the −51% position in FIG. 23, and at the 70% position in FIG. 24. As described above, the branch tubes 12*b* located in an upper portion of the liquid header 10 are preferably connected such that the distal end portions of the branch tubes 12*b* are positioned within −100% to −51% or within 51% to 100% relative to the direction of the arrow X in which the branch tubes 12*b* are inserted. In FIGS. 22 to 24, "A" is effective channel cross-sectional area [$m^2$] in the horizontal cross-section taken at the position where the branch tube 12 is inserted.

Figure 25:
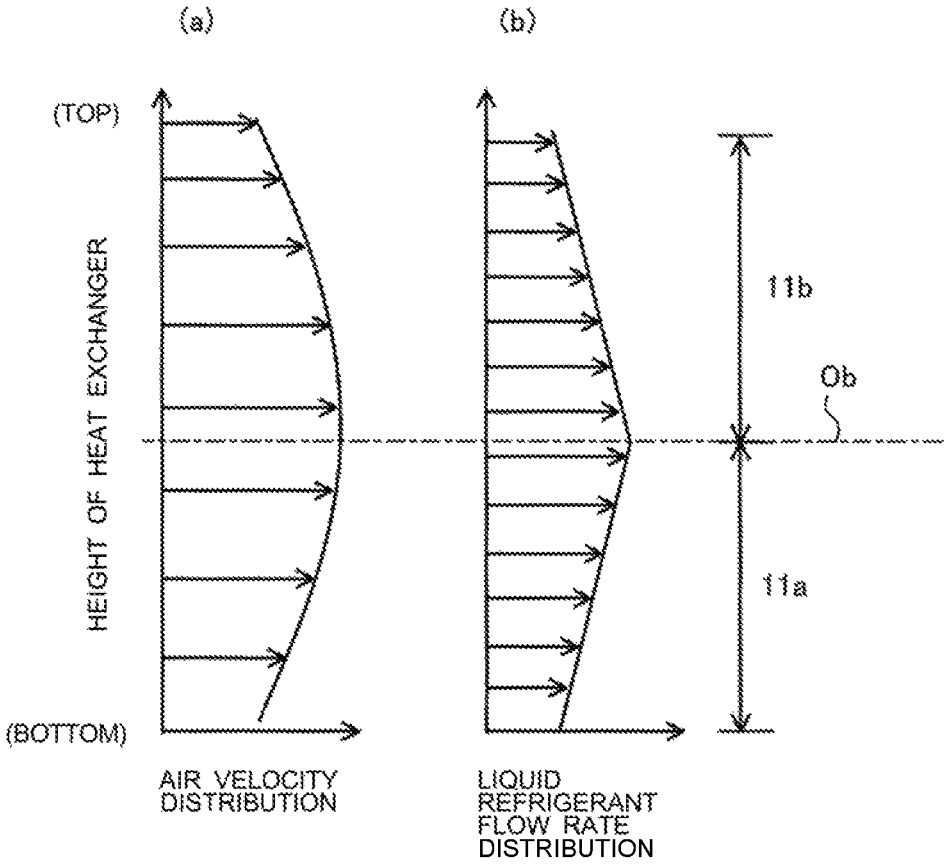
FIG. 25 illustrates the relationship between the distribution of air velocity and the distribution of liquid refrigerant flow rate, according to Embodiment 2 of the present invention.

FIG. 25 illustrates the relationship between the distribution of air velocity and the distribution of liquid refrigerant flow rate, according to Embodiment 2 of the present invention. As described above, in the case of the heat exchanger 1 of a side-flow type with the axial fan 30 disposed over the side of the heat exchanger 1, the distribution of airflow exhibits a peak near the center of the boss 31, and the airflow decreases as it is brought closer to the upper end or lower end of the heat exchanger 1. Accordingly, the liquid header 10 is divided into two relative to the boss centerline Ob of the axial fan 30 into upper and lower parts, and the branch tubes 12*a* to be connected to the lower part, that is, the first liquid header main tube 11*a*, are connected so as to penetrate the liquid layer, whereas the branch tubes 12*b* to be connected to the upper part, that is, the second liquid header main tube 11*b*, are connected so as to be covered in the liquid layer. This configuration ensures that in the first liquid header main tube 11*a*, a large amount of liquid refrigerant is distributed in an upper portion of the first liquid header main tube 11*a*, that is, near the height of the boss centerline Ob, and in the second liquid header main tube 11*b*, a large amount of liquid refrigerant is distributed in a lower portion of the second liquid header main tube 11*b*, that is, near the height of the boss centerline Ob. Therefore, refrigerant can be distributed in the heat exchanger 1 in a manner suited for the distribution of air velocity in a side-flow arrangement, leading to enhanced performance of the heat exchanger 1.

As described above, in the air-conditioning apparatus according to Embodiment 2, the branch tubes 12*b* are connected to the second liquid header main tube 11*b* located above the boss 31 such that the distal ends of the branch tubes 12*b* are covered in the liquid layer, and the branch tubes 12*a* are inserted into the first liquid header main tube 11*a* located below the boss 31 such that the distal ends of the branch tube 12*a* penetrate the liquid layer.

As in Embodiment 1, this configuration makes it possible to obtain, for the heat exchanger 1 of a side-flow type, a distribution of liquid refrigerant flow rate suited for the distribution of air velocity that has a peak near the height of the boss centerline Ob. This leads to enhanced performance of the heat exchanger 1.

According to Embodiment 2, in the header manifold (liquid header main tube 11), the flow space connected to the branch tubes 12 located within a height range that allows the blades 32 to rotate is divided into a plurality of parts in the vertical direction.

This configuration allows the branch tube insertion length to be controlled for each individual flow space, leading to enhanced ease of manufacture. Further, as compared with when the liquid header 10 includes a single flow space, the distribution of refrigerant in the heat exchanger 1 can be easily controlled to suit the distribution of air velocity by means of suitable combination of upper and lower flow spaces.

Embodiment 3

Figure 26:
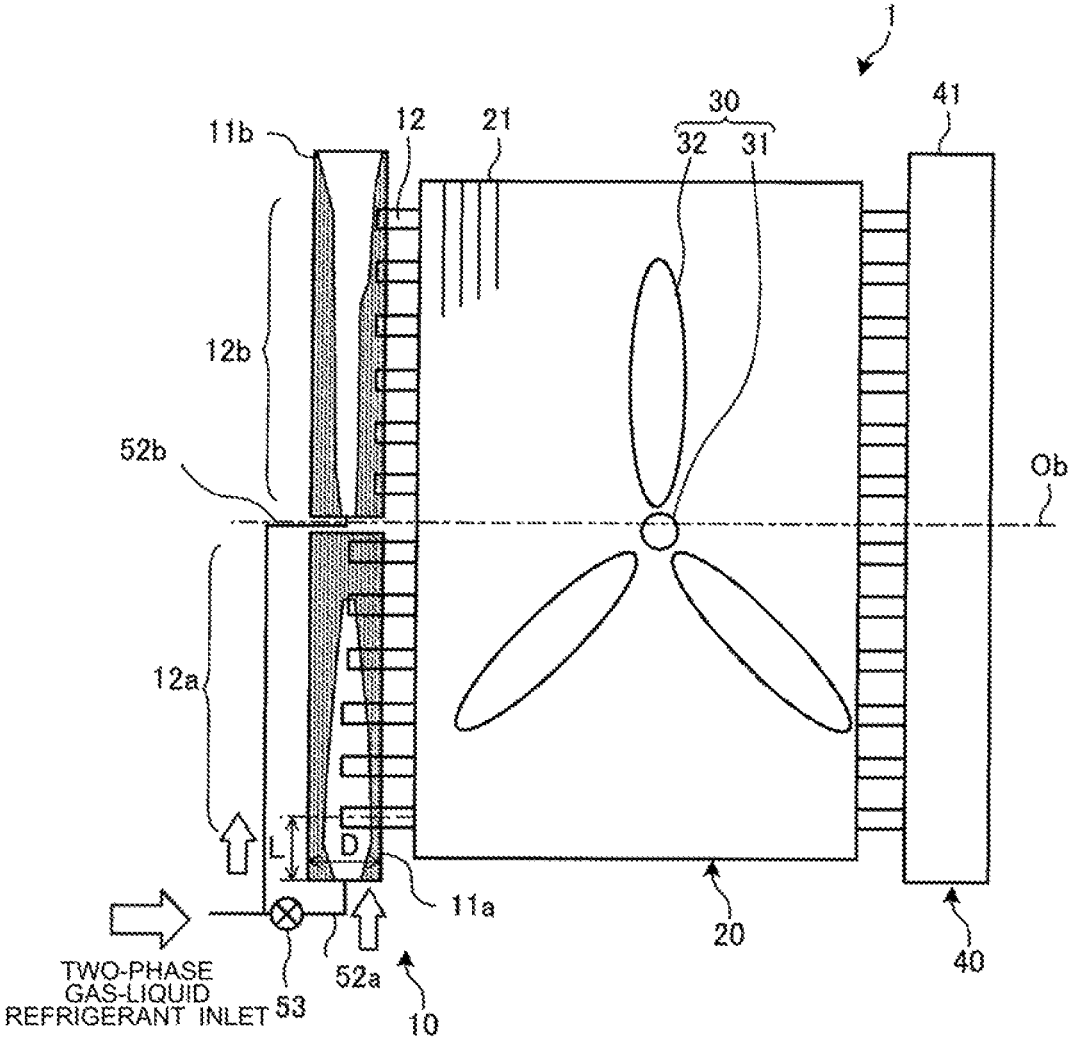
FIG. 26 schematically illustrates an example of a heat exchanger, according to Embodiment 3 of the present invention.

FIG. 26 schematically illustrates an example of a heat exchanger, according to Embodiment 3 of the present invention. In the heat exchanger 1 of a side-flow type according to Embodiment 3, as in Embodiment 2, the main tube of the liquid header 10 is divided in two into upper and lower parts. The lower part, that is, the first liquid header main tube 11*a*, is connected with the first inlet pipe 52*a*, and the upper part, that is, the second liquid header main tube 11*b*, is connected with the second inlet pipe 52*b*. In Embodiment 3, the heat exchanger 1 further includes a first flow control mechanism 53 disposed on the first inlet pipe 52*a*. In the following description of Embodiment 3, only features different from Embodiment 2 will be described, and features identical with or corresponding to those of Embodiment 2 will be designated by the same reference signs and will not be described in further detail.

The first flow control mechanism 53 allows the flow rate of refrigerant into each of the first liquid header main tube 11*a* and the second liquid header main tube 11*b* to be controlled by, for example, adjusting the opening degree of the first flow control mechanism 53. By adjusting the opening degree of the first flow control mechanism 53, the flow resistance can be varied, thus allowing the performance of the heat exchanger 1 to be enhanced over a wide operating range. If the flow resistance is increased by means of the first flow control mechanism 53, a pressure difference can be created between the upstream and downstream sides of the first flow control mechanism 53. As a result, over a wide operating range of the heat exchanger 1, the quality x of refrigerant entering the first liquid header main tube 11*a* can be controlled to be in the range of $0.05 \leq x \leq 0.30$, thus allowing for enhanced performance of the heat exchanger 1.

Although FIG. 26 depicts a case in which the first flow control mechanism 53 is disposed on the first inlet pipe 52*a* and can be adjusted in opening degree, this should not be construed restrictively. The first flow control mechanism 53 may be any flow control mechanism capable of controlling the flow resistance of each of the first inlet pipe 52*a* and the second inlet pipe 52*b*. This control may be performed by means of, for example, use of a capillary tube, pipe diameter adjustment, pipe length adjustment, or other methods.

Figure 27:
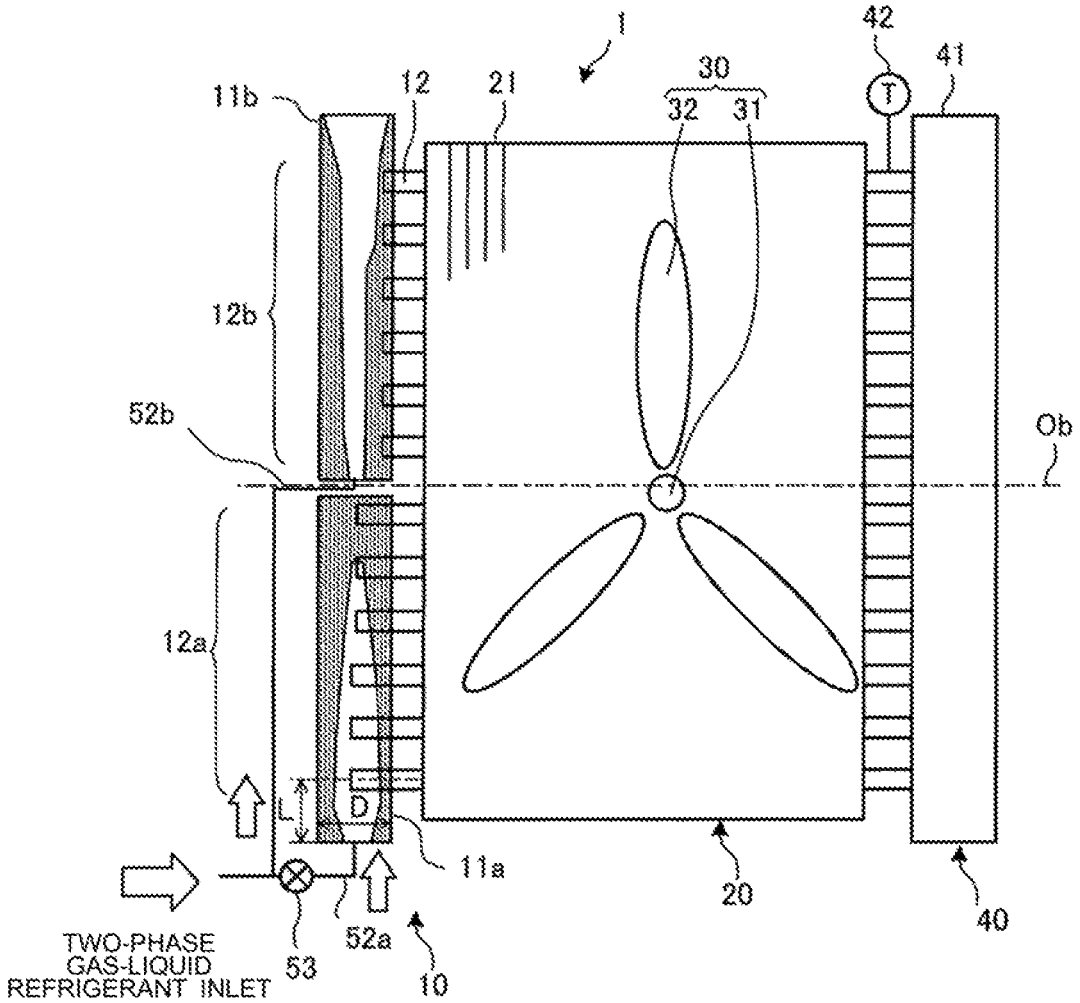
FIG. 27 schematically illustrates another example of a heat exchanger, according to Embodiment 3 of the present invention.

FIG. 27 schematically illustrates another example of a heat exchanger, according to Embodiment 3 of the present invention. The heat exchanger 1 illustrated in FIG. 27 includes an upper temperature sensor 42 provided to the uppermost one of the branch tubes 12 connected to the gas header 40. The upper temperature sensor 42 detects the temperature of the uppermost branch tube 12 connected to the gas header 40. If the detected temperature of the branch tube 12 is higher than saturation temperature, the opening degree of the first flow control mechanism 53 is controlled toward the closed position to direct more liquid refrigerant to the second liquid header main tube 11*b*, thus adjusting the distribution of refrigerant. This leads to enhanced performance of the heat exchanger 1. In this case, the saturation temperature may be defined as a saturation temperature estimated from the pressure at the refrigerant outlet of the gas header 40, or as a temperature measured at the refrigerant outlet of the gas header 40.

Figure 28:
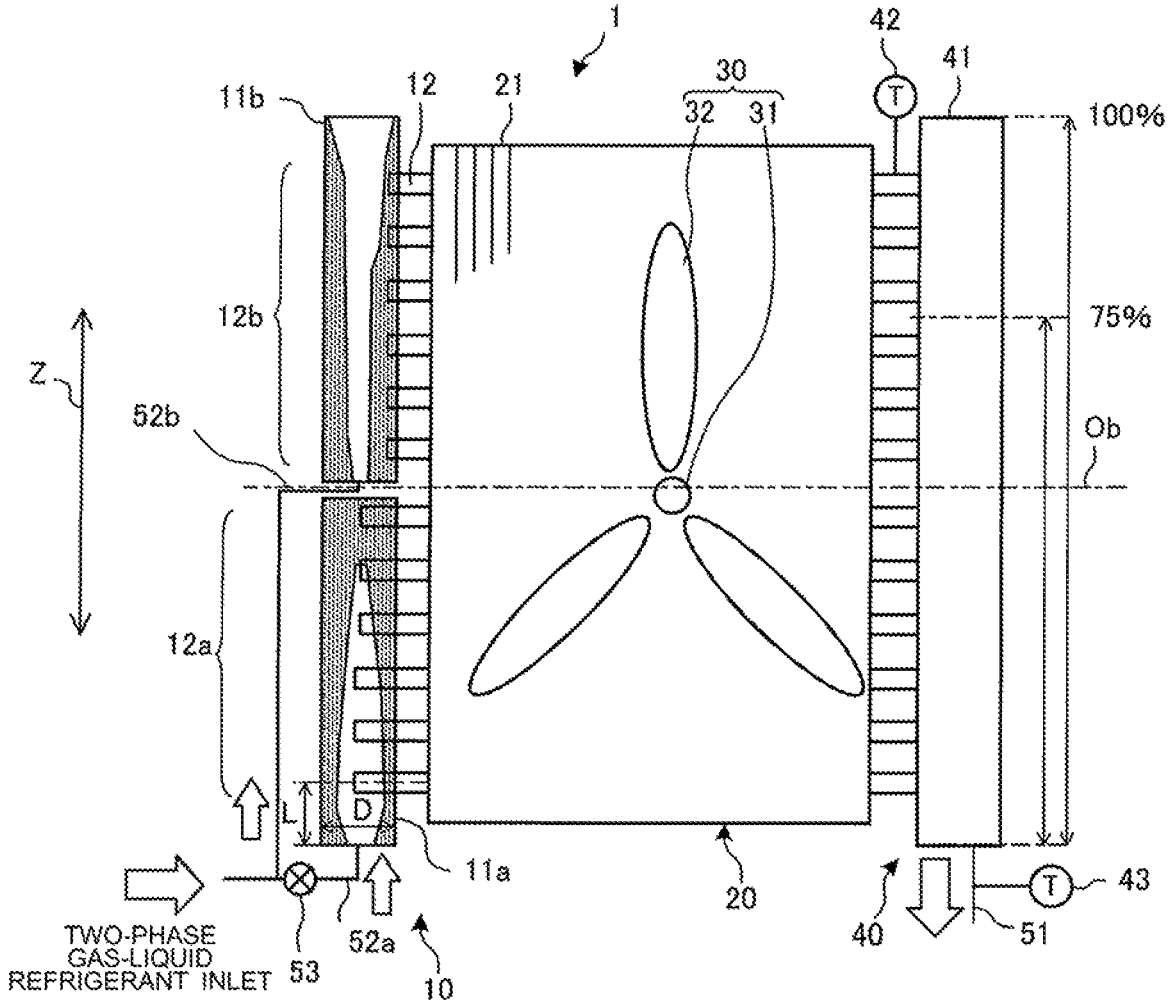
FIG. 28 schematically illustrates another example of a heat exchanger, according to Embodiment 3 of the present invention.

FIG. 28 schematically illustrates another example of a heat exchanger, according to Embodiment 3 of the present invention. The heat exchanger 1 illustrated in FIG. 28 includes an outlet temperature sensor 43 provided to the outlet pipe 51 connected to the gas header 40. The outlet temperature sensor 43 detects the temperature of refrigerant exiting the gas header 40. Although FIGS. 27 and 28 each depict a case in which the upper temperature sensor 42 is provided to the uppermost one of the branch tubes 12 connected to the gas header 40, this should not be construed restrictively. For example, when the distance along the height (along the arrow Z) of the gas header 40 is defined on a scale of 0% to 100% where 0% is the lower end of the gas header 40, the upper temperature sensor 42 may be provided to any branch tube 12 connected to an area positioned within the range of 75% to 100%.

In the case of an arrangement provided with the outlet temperature sensor 43 as illustrated in FIG. 28, letting $T_{top}$ be the temperature detected by the upper temperature sensor 42 and $T_{exit}$ be the temperature detected by the outlet temperature sensor 43, if the condition $T_{top}>T_{exit}$ holds, the opening degree of the first flow control mechanism 53 is controlled toward the closed position to direct more liquid refrigerant to the second liquid header main tube 11*b*, thus adjusting the distribution of refrigerant distribution. This leads to enhanced performance of the heat exchanger 1.

As described above, as in Embodiment 1, the configuration according to Embodiment 3 makes it possible to obtain, for the heat exchanger 1 of a side-flow type, a distribution of liquid refrigerant flow rate suited for the distribution of air velocity that has a peak near the height of the boss centerline Ob. This leads to enhanced performance of the heat exchanger 1.

Embodiment 4

Figure 29:
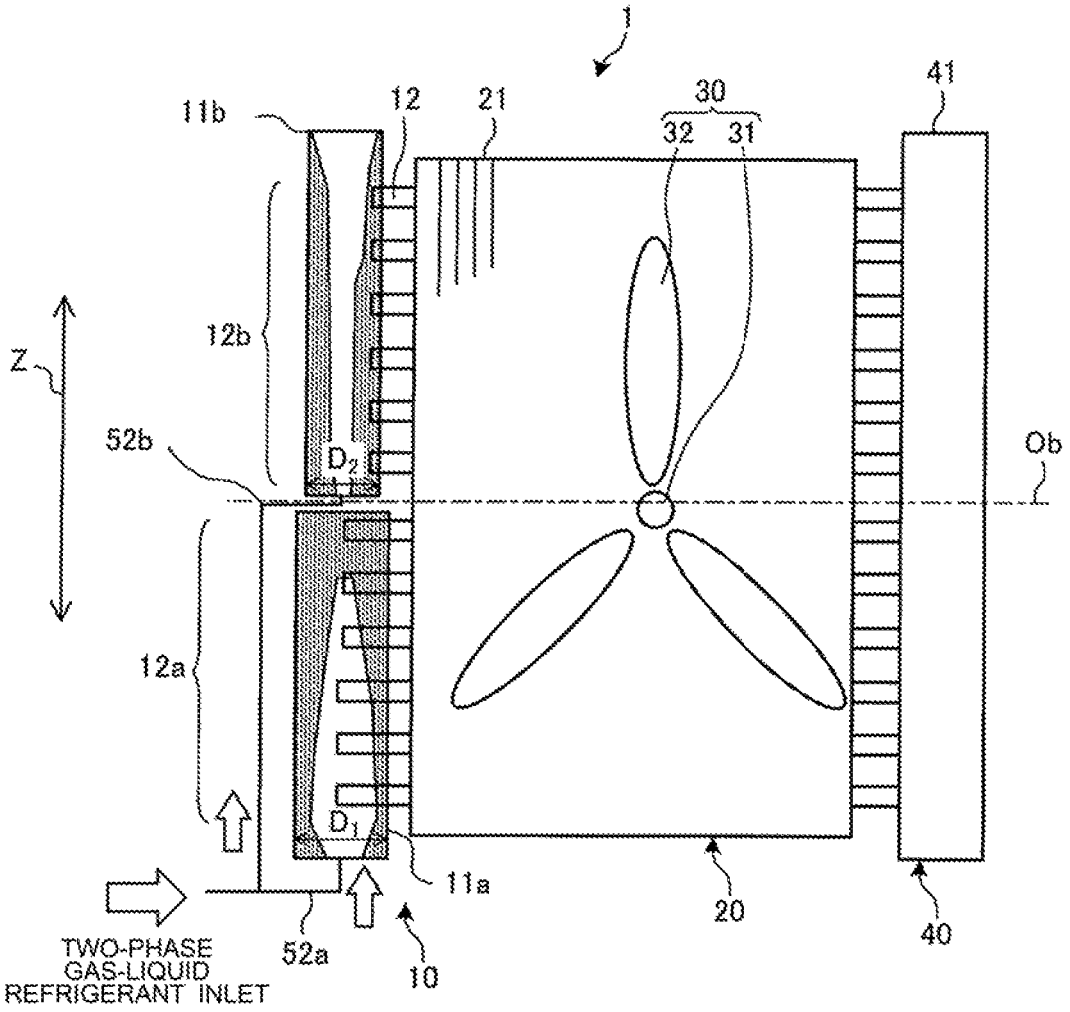
FIG. 29 schematically illustrates an example of a heat exchanger, according to Embodiment 4 of the present invention.

FIG. 29 schematically illustrates an example of a heat exchanger, according to Embodiment 4 of the present invention. In the heat exchanger 1 of a side-flow type according to Embodiment 4, as in Embodiment 2, the main tube of the liquid header 10 is divided in two into upper and lower parts. The lower part, that is, the first liquid header main tube 11*a*, is connected with the first inlet pipe 52*a*, and the upper part, that is, the second liquid header main tube 11*b* is connected with the second inlet pipe 52*b*. In Embodiment 4, the main tube of the liquid header 10 differs in size between the upper and lower parts of the liquid header 10. In the following description of Embodiment 4, only features different from Embodiment 2 will be described, and features identical with or corresponding to those of Embodiment 2 will be designated by the same reference signs and will not be described in further detail.

In the first liquid header main tube 11*a*, which is the lower-positioned liquid header main tube, each branch tube 12 is inserted so as to penetrate the liquid layer. The channel area blocked by the branch tube 12 is thus greater in the first liquid header main tube 11*a* than in the second liquid header main tube 11*b*. Accordingly, the liquid header 10 is designed to satisfy the condition $D_1>D_2$, where $D_1$ is the inside diameter [m] of the first liquid header main tube 11*a* and $D_2$ is the inside diameter [m] of the second liquid header main tube 11*b*. That is, the inside diameter $D_1$ of the first liquid header main tube 11*a*, which is located in the lower part of the liquid header 10, is made greater than the inside diameter $D_2$ of the second liquid header main tube 11*b*, which is located in the upper part of the liquid header 10. This configuration minimizes an increase in flow resistance due to the branch tubes 12.

As described above, as in Embodiment 1, the configuration according to Embodiment 4 makes it possible to obtain, for the heat exchanger 1 of a side-flow type, a distribution of liquid refrigerant flow rate suited for the distribution of air velocity that has a peak near the height of the boss centerline Ob. This leads to enhanced performance of the heat exchanger 1.

In Embodiment 3, the header manifold (liquid header main tube 11) includes a plurality of header manifolds (the first liquid header main tube 11*a* and the second liquid header main tube 11*b*) disposed at different heights in the vertical direction (arrow Z direction). The header manifolds include a lower header manifold (first liquid header main tube 11*a*) and an upper header manifold (second liquid header main tube 11*b*). The lower header manifold is a header manifold that is connected with the branch tubes 12*a* located below the height of the boss 31 among the branch tubes 12 located within the height range that allows the blades 32 to rotate. The upper header manifold is a header manifold that is connected with the branch tubes 12*b* located above the height of the boss among the branch tubes 12 located within the height range that allows the blades 32 to rotate. The flow space of the lower header manifold has the inside diameter $D_1$ greater than the inside diameter $D_2$ of the flow space of the upper header manifold.

As described above, the inside diameter $D_1$ of the first liquid header main tube 11*a* is made greater than the inside diameter $D_2$ of the second liquid header main tube 11*b*. Consequently, an increase in the flow resistance of the first liquid header main tube 11*a* due to the branch tubes 12*a* can be minimized. This helps minimize the difference in flow resistance resulting from the difference in the amount of insertion of the branch tubes 12 between the upper and lower parts of the liquid header 10, thus allowing for nearly uniform distribution of refrigerant flow into the upper and lower parts of the liquid header 10.

Although FIG. 29 depicts a case in which the first liquid header main tube 11*a* and the second liquid header main tube 11*b* are disposed with the centers of their inside diameters being aligned, the first liquid header main tube 11*a* and the second liquid header main tube 11*b* may not necessarily be disposed in such a positional relationship.

Figure 30:
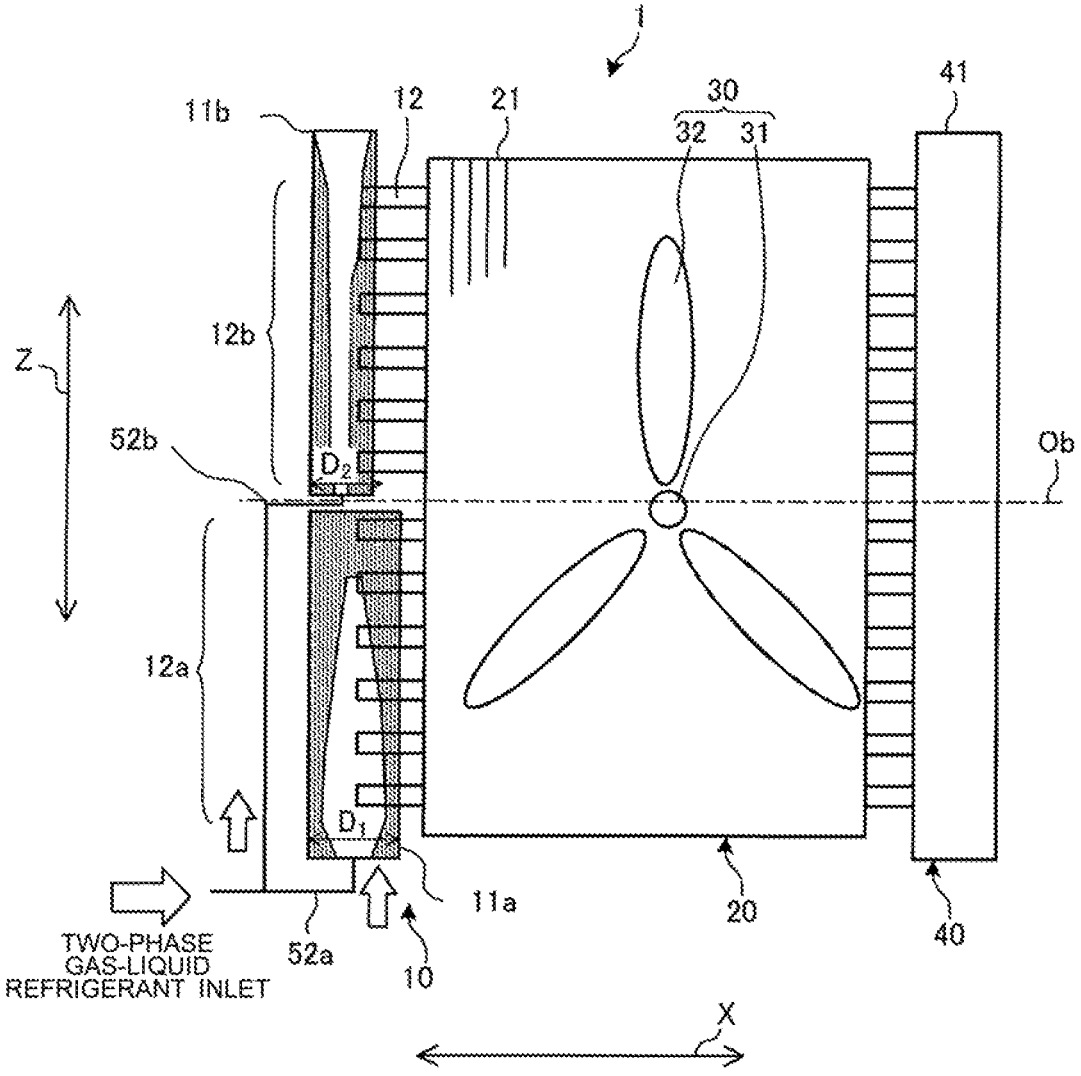
FIG. 30 schematically illustrates another example of a heat exchanger, according to Embodiment 4 of the present invention.

FIG. 30 schematically illustrates another example of a heat exchanger, according to Embodiment 4 of the present invention. For example, as illustrated in FIG. 30, the first liquid header main tube 11*a* and the second liquid header main tube 11*b* of the heat exchanger 1 may be disposed so as to be aligned at an end relative to the direction of their width (arrow X direction). In this case, since the first liquid header main tube 11*a* and the second liquid header main tube 11*b* have different inside diameters, the amount of insertion can be made to differ between the branch tubes 12*a* and 12*b*, even though these branch tubes 12 have the same length. This configuration of the heat exchanger 1 makes it possible to reduce the number and kinds of components, and also facilitates the control of the amount of insertion.

Embodiment 5

Figure 31:
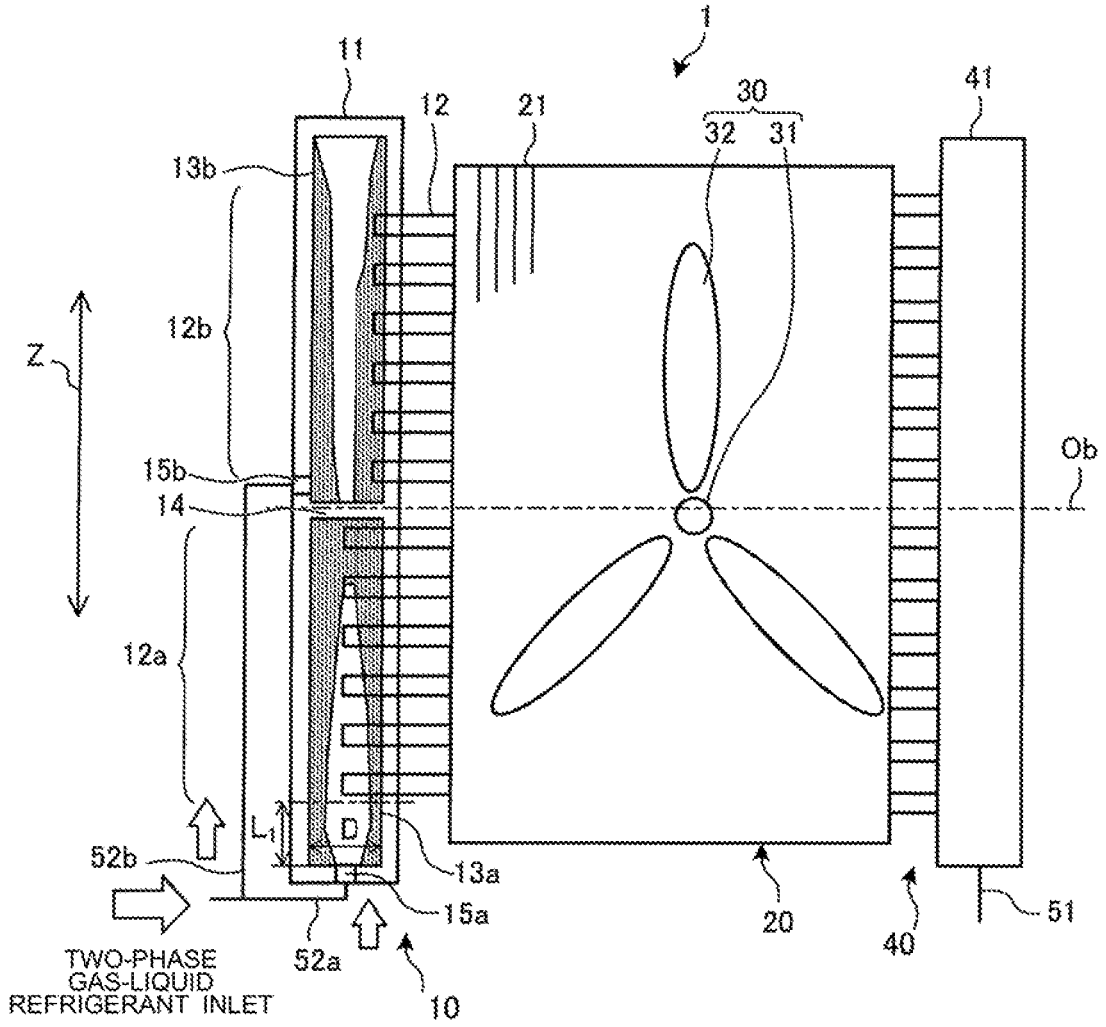
FIG. 31 schematically illustrates an example of a heat exchanger, according to Embodiment 5 of the present invention.

FIG. 31 schematically illustrates an example of a heat exchanger, according to Embodiment 5 of the present invention. In the heat exchanger 1 of a side-flow type according to Embodiment 5, the liquid header 10 includes a plurality of flow passages. In the following description, only features different from Embodiment 2 will be described, and features identical with or corresponding to those of Embodiment 2 will be designated by the same reference signs and will not be described in further detail.

As illustrated in FIG. 31, in the liquid header 10, the flow passage in the liquid header main tube 11 of the liquid header 10 is divided into a first liquid header passage 13*a* and a second liquid header passage 13*b*. The first liquid header passage 13*a* and the second liquid header passage 13*b* are obtained by dividing the above-mentioned flow passage into upper and lower parts relative to the boss centerline Ob of the axial fan 30 disposed over the side of the heat exchanger 1. Each passage defines a flow space in which refrigerant flows. A partition wall 14 is disposed between the first liquid header passage 13*a* located at the lower position and the second liquid header passage 13*b* located at the upper position to separate these passages from each other. A first inlet 15*a* that communicates with the first liquid header passage 13*a* is defined at the lower end of the liquid header main tube 11 to allow entry of refrigerant from the first inlet pipe 52*a*. In the liquid header main tube 11, a second inlet 15*b* penetrating the interior of the second liquid header passage 13*b* is defined on the side of a lower portion of the second liquid header passage 13*b* to allow entry of refrigerant from the second inlet pipe 52*b*.

The distal end portions of the branch tubes 12*a* located below the boss centerline Ob of the axial fan 30 are inserted into the liquid header 10 so as to penetrate the liquid layer, and are connected to the first liquid header passage 13*a*. The distal end portions of the branch tubes 12*b* located above the boss centerline Ob are inserted into the liquid header 10 so as to be covered in the liquid layer, and are connected to the second liquid header passage 13*b*. By using the liquid header 10 having a plurality of flow passages with different amounts of tube insertion as described above, refrigerant can be distributed in the heat exchanger 1 in a manner suited for the distribution of air velocity in a side-flow arrangement as illustrated in FIG. 25. This helps enhance the performance of the heat exchanger 1.

The liquid header 10 is preferably designed to have flow passages that satisfy the condition $D_1>D_2$, where $D_1$ is the inside diameter [m] of the first liquid header passage 13*a* and $D_2$ is the inside diameter [m] of the second liquid header passage 13*b*. This configuration helps minimize the difference in flow resistance between flow passages resulting from the difference in the amount of insertion of the branch tubes 12. This ensures nearly uniform distribution of refrigerant into individual flow passages.

With the heat exchanger 1 of a side-flow type configured as described above, a single header tube defines a plurality of flow passages. This facilitates positioning in inserting the branch tubes 12 into the header tube, thus enhancing the ease of manufacture. Further, the presence of the partition wall 14 to separate flow passages enhances the pressure resistance of the liquid header 10. Such a configuration proves advantageous for the ability to separate flow passages to achieve enhanced pressure resistance, particularly for cases in which the liquid header 10 has, for example, an elliptical shape, a rectangular shape, a D-shape, or a semi-circular shape rather than a circular shape in horizontal cross-section.

As described above, the quality x of refrigerant entering the liquid header 10 is controlled to fall within the range of $0.05 \leq x \leq 0.30$. This configuration results in a flow pattern in which a large amount of liquid-phase refrigerant Rb is distributed along the wall surface of the first liquid header passage 13*a*, thus realizing improved distribution.

As described above, as in Embodiment 1, the configuration according to Embodiment 5 makes it possible to obtain, for the heat exchanger 1 of a side-flow type, a distribution of liquid refrigerant flow rate suited for the distribution of air velocity that has a peak near the height of the boss centerline Ob. This leads to enhanced performance of the heat exchanger 1.

According to Embodiment 5, in the header manifold (liquid header main tube 11), the flow space connected to the branch tubes 12 located within a height range that allows the blades to rotate is divided into a plurality of parts in the vertical direction. As a result, the insertion length of branch tubes can be controlled for each individual flow space, leading to enhanced ease of manufacture. Further, as compared with a case when the liquid header 10 includes a single flow space, the distribution of refrigerant in the heat exchanger 1 can be easily controlled to suit the distribution of air velocity by means of suitable combination of upper and lower flow spaces.

Embodiment 6

Figure 32:
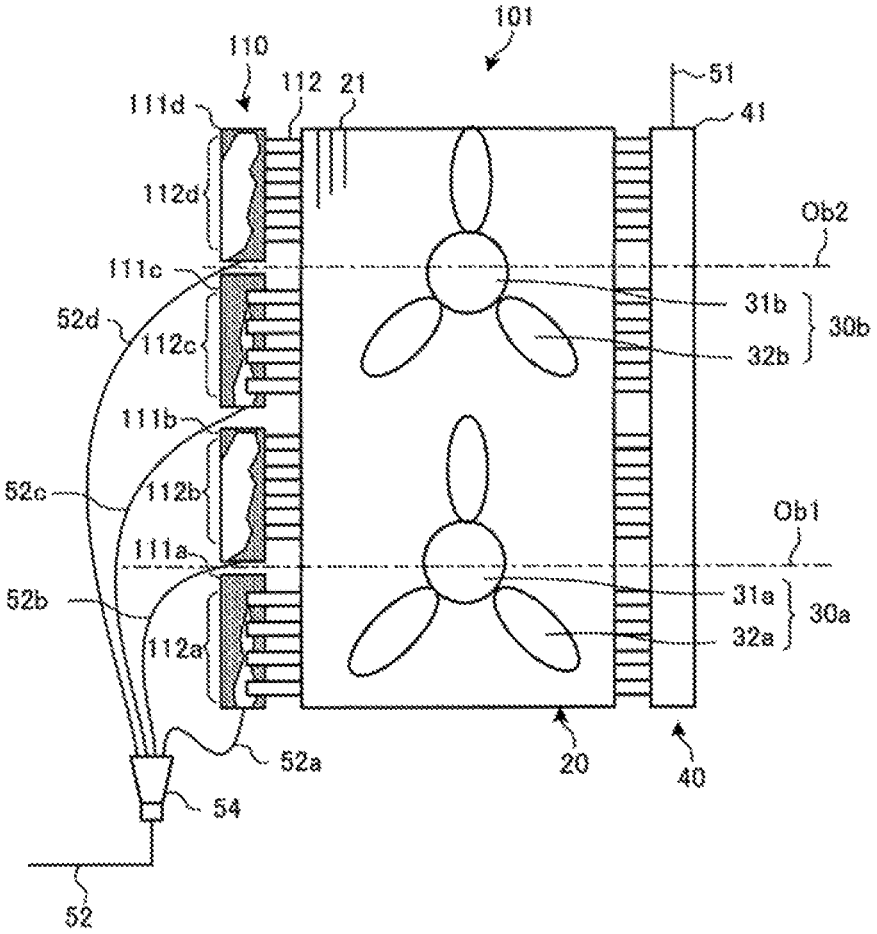
FIG. 32 schematically illustrates an example of a heat exchanger, according to Embodiment 6 of the present invention.

FIG. 32 schematically illustrates an example of a heat exchanger, according to Embodiment 6 of the present invention. A heat exchanger 101 according to Embodiment 6, which is a side-flow type heat exchanger, includes two axial fans 30*a* and 30*b* disposed above and below each other over the side of the heat exchanger 101. In Embodiment 6, a liquid header 110 is divided in two into upper and lower parts relative to each of the respective centerlines Ob1 and Ob2 of bosses 31*a* and 31*b*. The liquid header 110 is thus made up of four main tubes. In the following description, only features different from Embodiment 2 will be described, and features identical or corresponding to those of Embodiment 2 will be designated by the same reference signs and will not be described in further detail.

The two axial fans 30*a* and 30*b* are disposed such that the respective rotational planes of blades 32*a* and 32*b* face the heat transfer tubes 22 in the horizontal direction. Within the height range corresponding to the rotational plane of the axial fan 30*a*, which is the lower-positioned one of the two axial fans, the liquid header 110 is divided into a first liquid header main tube 111*a* and a second liquid header main tube 111*b* respectively located below and above the boss centerline Ob1, and within the height range corresponding to the rotational plane of the axial fan 30*b*, which is the upper-positioned one of the two axial fans, the liquid header 110 is divided into a third liquid header main tube 111*c* and a fourth liquid header main tube 111*d* respectively located below and above the boss centerline Ob2.

A distributor 54 is disposed upstream of the liquid header 110 to uniformly distribute refrigerant to the first liquid header main tube 111*a*, the second liquid header main tube 111*b*, the third liquid header main tube 111*c*, and the fourth liquid header main tube 111*d*. The distributor 54 and each liquid header main tube are connected by the corresponding one of first, second, third, and fourth inlet pipes 52*a*, 52*b*, 52*c*, and 52*d* through which refrigerant flows.

In FIG. 32, the outlet pipe 51 is connected to an upper portion of the gas header 40 to facilitate flow of liquid refrigerant to an upper part of the liquid header 110. The outlet pipe 51 may not necessarily be connected at the above-mentioned position. As in Embodiment 1, the outlet pipe 51 may be connected to a lower portion of the gas header 40.

In Embodiment 6, of the two liquid header main tubes located above and below the boss centerline Ob1 of the axial fan 30*a*, which is the lower axial fan, the lower liquid header main tube, that is, the first liquid header main tube 111*a*, is connected with a plurality of branch tubes 112*a*. Each branch tube 112*a* is inserted up to a point near the center of the inside diameter of the first liquid header main tube 111*a* such that its distal end portion penetrates the liquid layer. The second liquid header main tube 111*b*, which is located above the boss centerline Ob1, is connected with a plurality of branch tubes 112*b*. Each branch tube 112*b* is connected such that its distal end portion is covered in the liquid-phase refrigerant Rb.

Similarly, of the two liquid header main tubes located above and below the boss centerline Ob2 of the axial fan 30*b*, which is the upper axial fan, the lower liquid header main tube, that is, the third liquid header main tube 111*c*, is connected with a plurality of branch tubes 112*c*. Each branch tube 112*c* is inserted up to a point near the center of the inside diameter of the third liquid header main tube 111*c* such that its distal end portion penetrates the liquid layer. The fourth liquid header main tube 111*d*, which is located above the boss centerline Ob2, is connected with a plurality of branch tubes 112*d*. Each branch tube 112*d* is connected such that its distal end portion is covered in the liquid-phase refrigerant Rb.

In this case, by controlling the quality x of refrigerant entering the liquid header 110 to be in the range of $0.05 \leq x \leq 0.30$, a flow pattern is obtained in which a large amount of liquid-phase refrigerant Rb is distributed near the wall of each liquid header main tube. This makes it possible to obtain, for the heat exchanger 101, a distribution of refrigerant suited for the distribution of airflow in the case of a side-flow arrangement in which the two axial fans 30*a* and 30*b* are disposed above and below each other.

Figure 33:
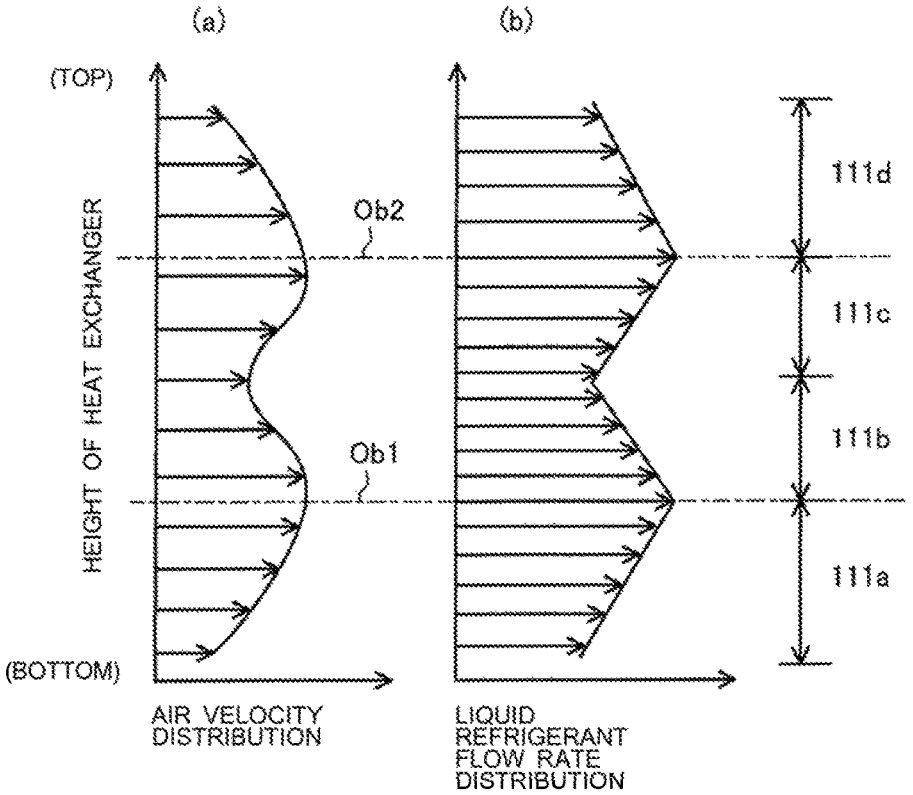
FIG. 33 explains an example of air velocity distribution in a heat exchanger and an example of liquid refrigerant distribution in a liquid header, according to Embodiment 6 of the present invention.

FIG. 33 explains an example of air velocity distribution in a heat exchanger and an example of liquid refrigerant distribution in a liquid header, according to Embodiment 6. In FIG. 33(*a*) and FIG. 33(*b*), the vertical axis is height in the vertical direction (arrow Z direction) of the heat exchanger 101, and the two horizontal axes represent the distribution of air velocity in the heat exchanger 101 and the distribution of liquid refrigerant flow rate in the liquid header 110. As illustrated in FIG. 33, also in the case of an arrangement including a plurality of axial fans, that is, the axial fans 30*a* and 30*b*, the air velocity distribution has a peak at the height of the boss 31*a* or 31*b* of each axial fan.

As described above, the liquid header 110 of the heat exchanger 101 is divided into upper and lower parts relative to each of the boss centerlines Ob1 and Ob2, and the amount of insertion of the branch tubes 12 is made to differ between the upper and lower parts. This configuration makes it possible to obtain a distribution of refrigerant as illustrated in FIG. 33 that is suited for the distribution of airflow in the case of a side-flow arrangement in which the two axial fans 30*a* and 30*b* are disposed above and below each other.

Now, let $D_1$ be the inside diameter [m] of the first liquid header main tube 111*a*, $D_2$ be the inside diameter [m] of the second liquid header main tube 111*b*, $D_3$ be the inside diameter [m] of the third liquid header main tube 111*c*, and $D_4$ be the inside diameter [m] of the fourth liquid header main tube 111*d*. In this case, if $D_1 > D_2$ and $D_3 > D_4$, such a configuration is more desirable from the viewpoint of reducing the difference in flow resistance between liquid header main tubes resulting from the difference in the amount of insertion of the branch tubes 12.

Figure 34:
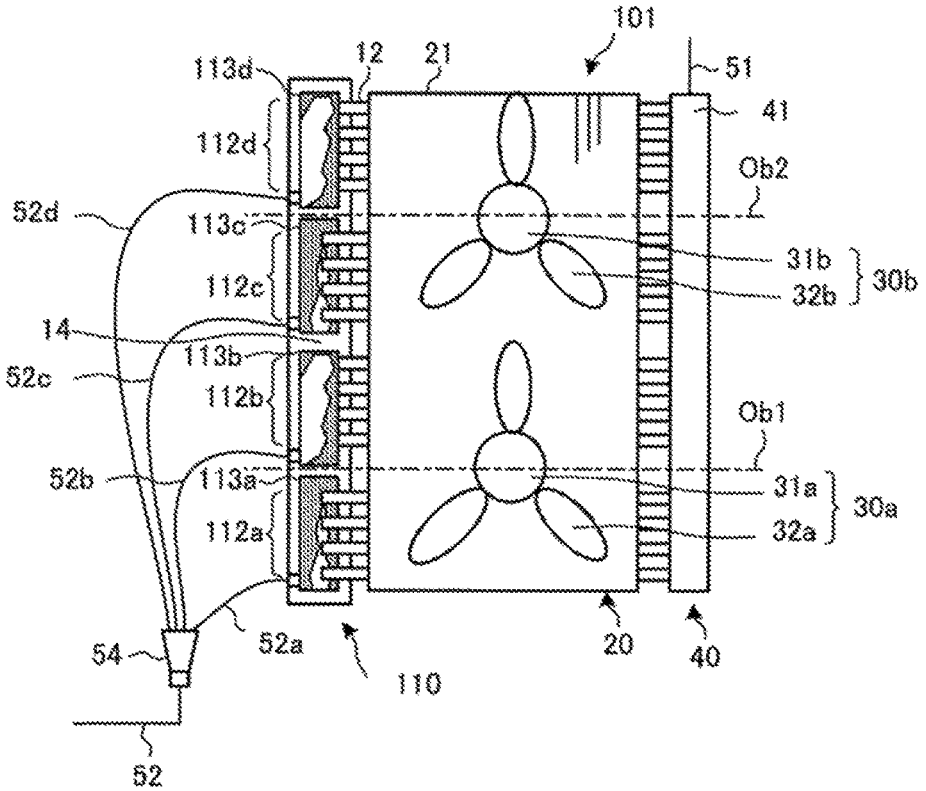
FIG. 34 illustrates another example of a heat exchanger, according to Embodiment 6 of the present invention.

FIG. 34 illustrates another example of a heat exchanger, according to Embodiment 6 of the present invention. In FIG. 32 mentioned above, the liquid header 110 is divided into four liquid header main tubes located above and below each other. Alternatively, as illustrated in FIG. 34, the flow passage within a single liquid header 110 may be divided in four into a first liquid header passage 113*a*, a second liquid header passage 113*b*, a third liquid header passage 113*c*, and a fourth liquid header passage 113*d*. In this case, the liquid header 110 is made up of a single header tube. This configuration facilitates the control the amount of insertion of the branch tubes 12 into the liquid header 110, leading to enhanced ease of manufacture. Further, the presence of the partition wall 14 between flow passages enhances pressure resistance of the liquid header 110.

As described above, as in Embodiment 1, the configuration according to Embodiment 6 makes it possible to obtain, for the heat exchanger 101 of a side-flow type, a distribution of liquid refrigerant flow rate suited for the distribution of air velocity that has a peak near the height of each of the boss centerlines Ob1 and Ob2. This leads to enhanced performance of the heat exchanger 101.

In Embodiment 6, the axial fan 30 includes the axial fans 30*a* and 30*b* disposed at different heights in the vertical direction (arrow Z direction). Among a plurality of branch tubes 112 located within a height range that allows the blades 32*a* or 32*b* of each axial fan to rotate, the majority of the branch tubes 112*a* or 112*c* located below the height of the boss 31*a* or 31*b* of the axial fan are inserted into the header manifold (the first liquid header main tube 111*a* or the third liquid header main tube 111*c*) such that the distal ends of these branch tubes are positioned at 0 to 50% of the distance from the center of the header manifold, and the majority of the branch tubes 112*b* or 112*d* located above the height of the boss 31*a* or 31*b* of the axial fan are connected to the header manifold such that the distal ends of these branch tubes are positioned at more than 50% of the distance from the center of the header manifold.

As a result of the above-mentioned configuration, for each of the axial fans 30*a* and 30*b*, the insertion length of the branch tubes 12 is made to differ between the portion of the liquid header 110 located above the height of the boss 31*a* or 31*b* and the portion of the liquid header 110 located below the height of the boss 31*a* or 31*b*. Consequently, even in the case of the heat exchanger 101 of a side-flow type with the axial fans 30*a* and 30*b* disposed above and below each other, refrigerant can be distributed in a manner suited for the velocity distribution of air passing through the heat exchanger 101. This leads to enhanced performance of the heat exchanger 101.

Embodiment 7

Embodiment 7 of the present invention will be described below. In the following, a description will not be given of features overlapping those of Embodiments 1 to 6, and features identical or corresponding to those of Embodiments 1 to 6 will be designated by the same reference signs. In Embodiment 7, the liquid header main tube 11 of the liquid header 10 has a flow passage that is non-circular in horizontal cross-section.

Figure 35:
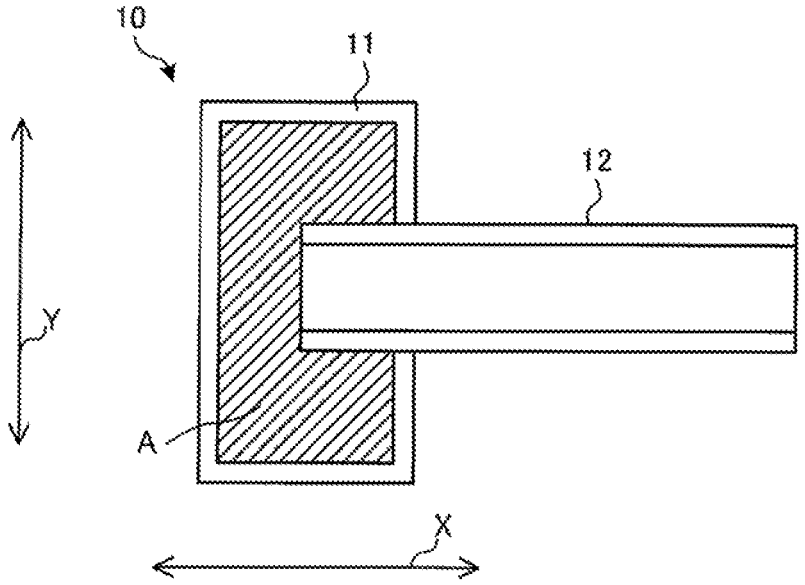
FIG. 35 is a schematic cross-sectional view of an example of a liquid header, according to Embodiment 7 of the present invention.
Figure 36:
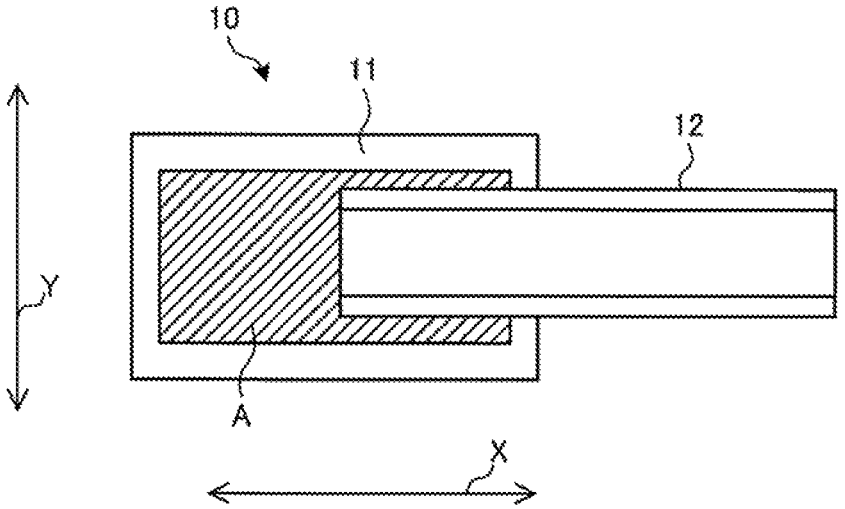
FIG. 36 is a schematic cross-sectional view of another example of a liquid header, according to Embodiment 7 of the present invention.
Figure 37:
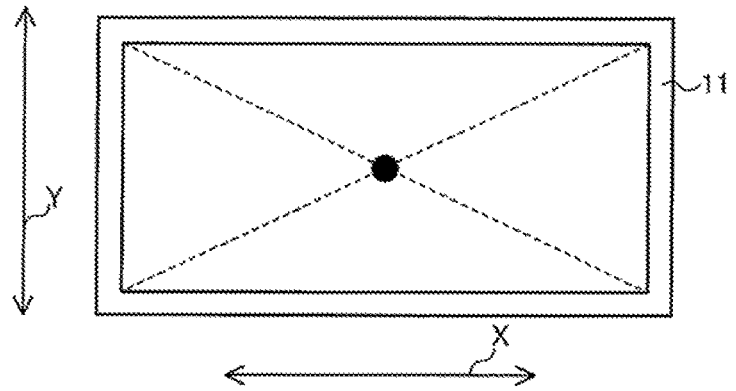
FIG. 37 explains an example of the center position of a liquid header, according to Embodiment 7 of the present invention.

First, a case in which the liquid header main tube 11 is rectangular in horizontal cross-section will be described with reference to FIGS. 35 to 37. FIG. 35 is a schematic cross-sectional view of an example of a liquid header, according to Embodiment 7 of the present invention. FIG. 36 is a schematic cross-sectional view of another example of a liquid header, according to Embodiment 7 of the present invention. FIG. 37 explains an example of the center position of a liquid header, according to Embodiment 7 of the present invention.

FIGS. 35 and 36 each illustrate a case in which the liquid header main tube 11 is rectangular in horizontal cross-section, and the liquid header 10 has a flow passage in a rectangular shape. In the case of such a rectangular passage as well, the branch tubes 12 to be connected to the portion of the liquid header main tube 11 below the boss centerline Ob are connected so as to penetrate the liquid layer. This configuration makes it possible to achieve distribution of refrigerant suited for the distribution of air velocity in the heat exchanger 1 of a side-flow type, leading to improved distribution.

Further, as illustrated in FIG. 35, the liquid header 10 is formed in a rectangular shape in horizontal cross-section. As compared with forming the liquid header 10 in a circular shape in horizontal cross-section, this configuration makes it possible to reduce the dimension in the direction of width (arrow X direction) across the sides of the liquid header 10, which is the direction in which the branch tube 12 is inserted. This proves advantageous from the viewpoint of space saving.

In the case of the liquid header 10 that is rectangular in horizontal cross-section, the respective joint surfaces of the liquid header main tube 11 and branch tube 12 are at right angles to each other. Joining of these two metal components is generally performed by brazing. Therefore, if the liquid header 10 is rectangular in horizontal cross-section, this facilitates brazing of the respective joint surfaces of the two metal components during the brazing process. This leads to enhanced quality of the resulting joint.

In Embodiments 1 to 6 mentioned above, the center position in the horizontal plane of the flow space needs to be defined to indicate where the distal end of each branch tube 12 is located within the liquid header 10. In this regard, if the flow passage in the liquid header 10 is a rectangular passage, the center position in the horizontal plane of the flow space of the liquid header 10 is defined as the intersection of the diagonals of the rectangular passage as illustrated in FIG. 37. It is considered that the flow pattern is determined in this case by using the diameter of the equivalent circle corresponding to the channel cross-sectional area A of the rectangular passage.

As for the working fluid in the heat exchanger 1, a low pressure fluorocarbon refrigerant such as R134a, an HFO refrigerant such as R1234yf or R1234ze(E), dimethyl ether (DME), or a hydrocarbon-based refrigerant such as propane, or other such refrigerant may be used as a pure refrigerant or as a component of a refrigerant mixture. From the viewpoint of pressure resistance, using a refrigerant mixture is more desirable as this allows pressure to be minimized.

Figure 38:
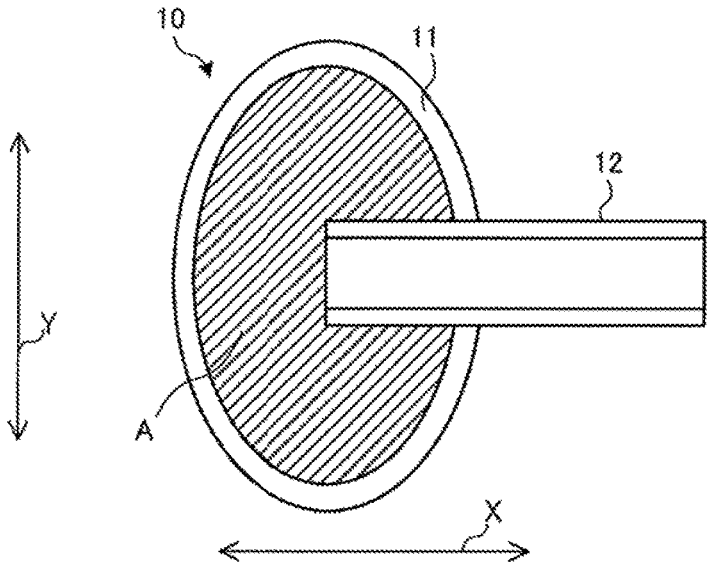
FIG. 38 is a schematic cross-sectional view of another example of a liquid header, according to Embodiment 7 of the present invention.
Figure 39:
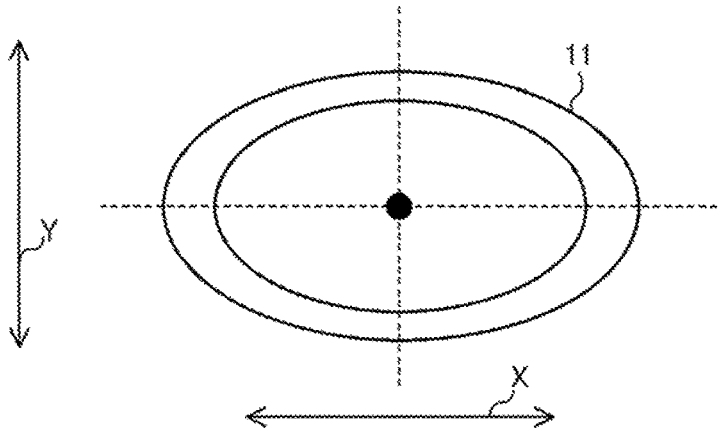
FIG. 39 explains an example of the center position of a liquid header, according to Embodiment 7 of the present invention.

The following describes, with reference to FIGS. 38 and 39, a case in which the liquid header 10 is elliptical in horizontal cross-section. FIG. 38 is a schematic cross-sectional view of another example of a liquid header, according to Embodiment 7 of the present invention. FIG. 39 explains an example of the center position of a liquid header, according to Embodiment 7 of the present invention.

FIG. 38 depicts a case in which the liquid header main tube 11 is elliptical in horizontal cross-section, and the liquid header 10 has a flow passage in an elliptical shape. In the case of such an elliptical passage as well, the branch tubes 12 to be connected to the portion of the liquid header main tube 11 below the boss centerline Ob are connected so as to penetrate the liquid layer. This configuration makes it possible to achieve distribution of refrigerant suited for the distribution of air velocity in the heat exchanger 1 of a side-flow type, leading to improved distribution.

If the flow passage in the liquid header 10 is an elliptical passage, the center position in the horizontal plane of the flow space of the liquid header 10 is defined as the intersection of the long and short axes of the ellipse as illustrated in FIG. 39. In case of a configuration in which each branch tube 12 is protruded to a point near the center position of the flow space, there is a risk of refrigerant pressure loss due to the branch tube 12 protruded into the liquid header 10. In this regard, if the liquid header 10 has an elliptical passage, this helps minimize an increase in the loss of pressure of refrigerant flowing in the liquid header 10, leading to stabilized flow pattern.

As illustrated in FIG. 38, the branch tube 12 is inserted into the liquid header 10 in a direction toward the long axis of the elliptical passage, that is, in the direction of the short axis of the elliptical passage. This configuration helps ensure that, as compared with when the liquid header 10 is circular in horizontal cross-section, the brazed joint surface between the liquid header 10 and the branch tube 12 can be made to have a small radius of curvature, thus facilitating brazing. the flow pattern in the elliptical passage shall be determined by using the diameter of the equivalent circle corresponding to the channel cross-sectional area A of the elliptical passage.

Figure 40:
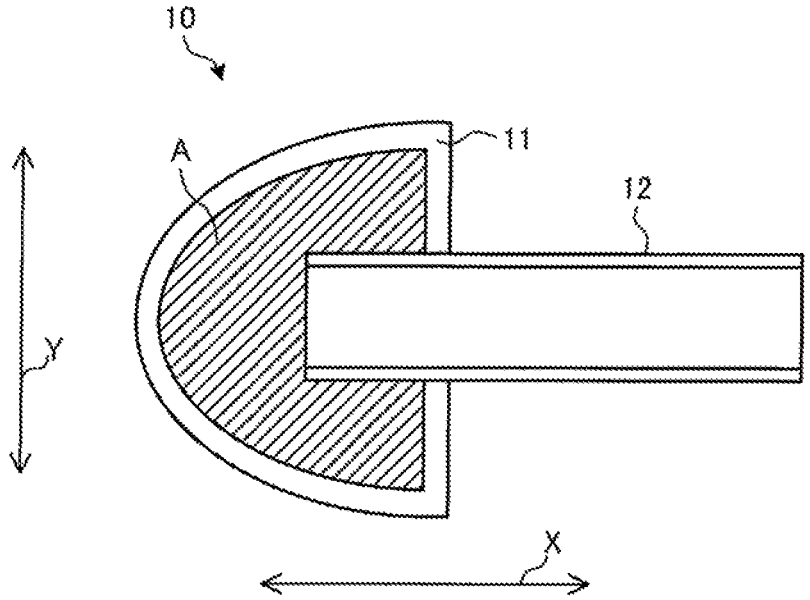
FIG. 40 is a schematic cross-sectional view of another example of a liquid header, according to Embodiment 7 of the present invention.
Figure 41:
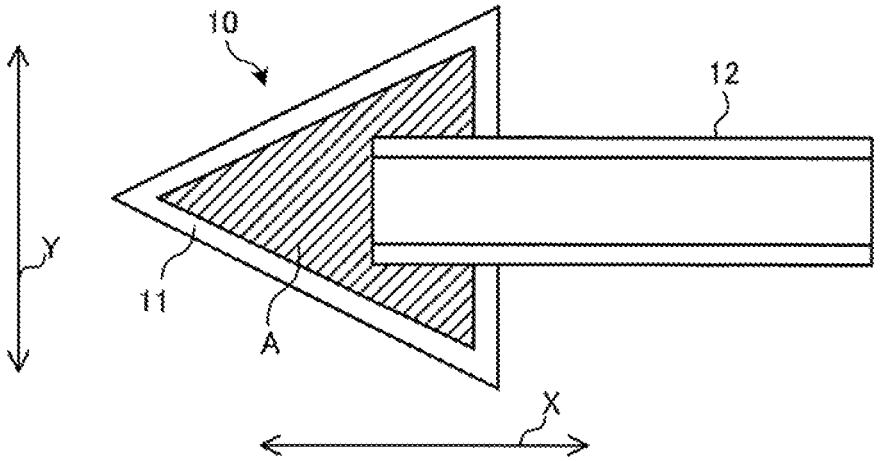
FIG. 41 is a schematic cross-sectional view of another example of a liquid header, according to Embodiment 7 of the present invention.

The liquid header 10 may not necessarily be circular, rectangular, or elliptical in horizontal cross-section. FIG. 40 is a schematic cross-sectional view of another example of a liquid header, according to Embodiment 7 of the present invention. FIG. 41 is a schematic cross-sectional view of another example of a liquid header, according to Embodiment 7 of the present invention.

FIG. 40 depicts a case in which the liquid header main tube 11 is semi-circular in horizontal cross-section, and the liquid header 10 has a flow passage in a semi-circular shape. In the case of such a semi-circular passage as well, the branch tubes 12 to be connected to the portion of the liquid header main tube 11 below the boss centerline Ob are connected so as to penetrate the liquid layer. This configuration makes it possible to achieve distribution of refrigerant suited for the distribution of air velocity in the heat exchanger 1 of a side-flow type, leading to improved distribution.

If the liquid header 10 has a semi-circular passage, the center position in the horizontal plane of the flow space of the liquid header 10 is defined as the intersection of lines joining the three closest positions to the center with the three farthest positions from the center. The flow pattern shall be determined in this case by using the diameter of the equivalent circle corresponding to the channel cross-sectional area A of the semi-circular passage.

In the case of the liquid header 10 having such a semi-circular passage, the channel cross-sectional area A can be increased while minimizing an increase in volume in the widthwise direction (arrow X direction). This proves advantageous from the viewpoint of space saving, and results in reduced pressure loss. Further, the above-mentioned configuration of the liquid header 10 allows its joint surface with the branch tube 12 to be made flat, thus facilitating brazing.

FIG. 41 depicts a case in which the liquid header main tube 11 is triangular in horizontal cross-section, and the liquid header 10 has a flow passage in a triangular shape. In the case of such a triangular passage as well, the branch tubes 12 to be connected to the portion of the liquid header main tube 11 below the boss centerline Ob are connected so as to penetrate the liquid layer. This configuration makes it possible to achieve distribution of refrigerant suited for the distribution of air velocity in the heat exchanger 1 of a side-flow type, leading to improved distribution.

If the liquid header 10 has a triangular passage, the center position in the horizontal plane of the flow space of the liquid header 10 is defined as the intersection of lines joining the three midpoints of the sides of the triangle, which are the points located closest to the center, with the vertices located farthest therefrom. The flow pattern shall be determined in this case by using the diameter of the equivalent circle corresponding to the channel cross-sectional area A of the triangular passage.

In the case of the liquid header 10 having such a triangular passage, the channel cross-sectional area A can be increased while minimizing an increase in volume in the widthwise direction (arrow Y direction). This configuration proves to be advantageous from the viewpoint of space saving, and results in reduced pressure loss. Further, the above-mentioned configuration of the liquid header 10 allows its joint surface with the branch tube 12 to be made flat, thus facilitating brazing.

For the liquid header 10 having a rectangular passage, an elliptical passage, a semi-circular passage, or a triangular passage as described above, refrigerant is preferably made to flow into the liquid header 10 in an annular or churn flow pattern. This makes it possible to achieve improved distribution performance for the liquid header 10 with various shapes in horizontal cross-section. Further, if the quality x of refrigerant entering the liquid header 10 is in the range of $0.05 \leq x \leq 0.30$, a further improvement in distribution performance can be obtained.

As described above, as in Embodiment 1, the configuration according to Embodiment 7 makes it possible to obtain, for the heat exchanger 1, a distribution of liquid refrigerant flow rate suited for the distribution of air velocity that has a peak near the height of the boss centerline Ob. This leads to enhanced performance of the heat exchanger 1.

Embodiment 8

Embodiment 8 of the present invention will be described below. In Embodiment 8, the branch tubes 12 have a flat shape. In the following, a description will not be given of features overlapping those of Embodiments 1 to 7, and features identical or corresponding to those of Embodiments 1 to 7 will be designated by the same reference signs.

Figure 42:
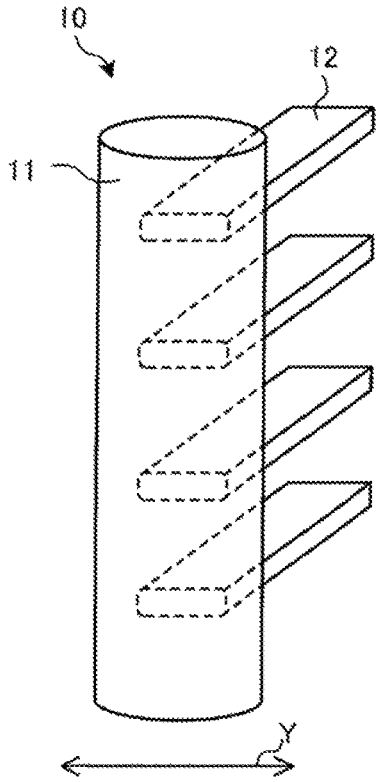
FIG. 42 schematically illustrates, in perspective view, an example of connection of branch tubes to a liquid header, according to Embodiment 8 of the present invention.
Figure 43:
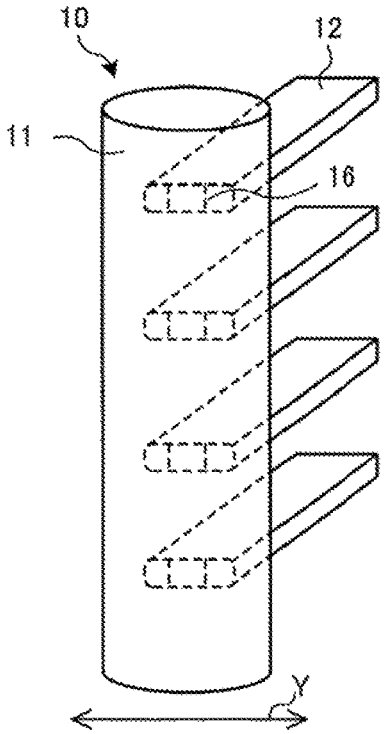
FIG. 43 schematically illustrates, in perspective view, another example of connection of branch tubes to a liquid header, according to Embodiment 8 of the present invention.

FIG. 42 schematically illustrates, in perspective view, an example of connection of branch tubes to a liquid header, according to Embodiment 8 of the present invention. FIG. 43 schematically illustrates, in perspective view, another example of connection of branch tubes to the liquid header 10, according to Embodiment 8 of the present invention. As illustrated in FIGS. 42 and 43, the branch tubes 12 have a flat shape. Using the branch tubes 12 having a flat shape as described above increases the influence of surface tension at the location where the liquid header main tube 11 branches off into the branch tubes 12. This ensures uniform flow of liquid refrigerant into each branch tube 12, leading to greater improvement in the efficiency of the heat exchanger 1.

As for the position of the center axis of each branch tube 12 in the Y-direction defined as described above, the equivalent diameter of a circular tube corresponding to the effective channel cross-sectional area of such a flat flow passage is considered, and it is considered that the center axis is located within ±50%. The branch tube 12 having a flat shape may be a portion of the heat exchanger 1. That is, a portion of a flat heat transfer tube constituting the heat exchanger 1 may be extended to form the branch tube 12 having a flat shape. Since the branch tube 12 having a flat shape is substituted for a portion of the heat transfer tube 22 in some cases, its inner surface may be machined to have a heat transfer-facilitating feature such as a groove.

As illustrated in FIG. 43, each branch tube 12 connected to the liquid header 10 may be in the form of a flat perforated tube with partitions 16 provided inside the branch tube 12. This configuration increases the strength of the branch tube 12.

As described above, as in Embodiment 1, the configuration according to Embodiment 8 makes it possible to obtain, for the heat exchanger 1, a distribution of liquid refrigerant flow rate suited for the distribution of air velocity that has a peak near the height of the boss centerline Ob. This leads to enhanced performance of the heat exchanger 1.

In Embodiment 8, the branch tubes 12 are formed by the end portions of the corresponding heat transfer tubes 22. This configuration makes it possible to substitute the heat transfer tubes 22 of the heat exchange unit 20 for the branch tubes 12, thus reducing the number of components of the heat exchanger 1.

Embodiment 9

Figure 44:
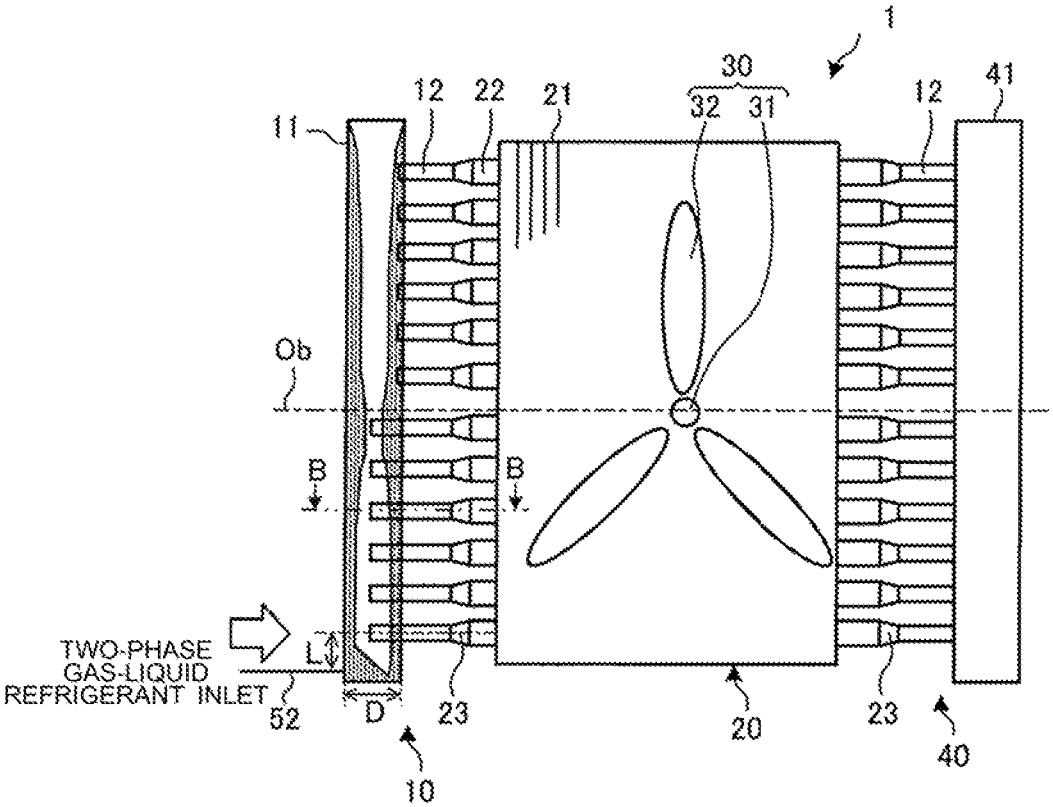
FIG. 44 schematically illustrates an example of a heat exchanger, according to Embodiment 9 of the present invention.

FIG. 44 schematically illustrates an example of a heat exchanger, according to Embodiment 9 of the present invention. In Embodiment 9, the heat exchanger 1 includes a joint tube 23 to change the shapes of the heat transfer tube 22 and branch tube 12. In the following description, features similar to those of Embodiment 1 will be designated by the same reference signs and will not be described in further detail.

As illustrated in FIG. 44, by using the joint tube 23 that transforms a tube shape, the shape of the heat transfer tube 22 of the heat exchange unit 20 can be transformed into the shape of the branch tube 12 that blocks a smaller area of the liquid header 10 than does the heat transfer tube 22. As a result, as compared with directly inserting the heat transfer tube 22 into the liquid header 10 as the branch tube 12, this configuration reduces pressure loss resulting from the protrusion of the branch tube 12 into the flow passage of the liquid header 10.

The joint tube 23 may be a tube connected to the heat transfer tube 22 at one end and connected to the branch tube 12 at the other end. Alternatively, the joint tube 23 may be a tube integrated with the branch tube 12 and connected at one end to the heat transfer tube 22.

The joint tube 23 may not necessarily be used only for the liquid header 10 but may be also used for connection between the gas header 40 and the heat exchange unit 20. As compared with connecting the heat transfer tube 22 to the gas header main tube 41, this configuration reduces pressure loss in the gas header 40 resulting from the insertion of the branch tube 12.

Figure 45:
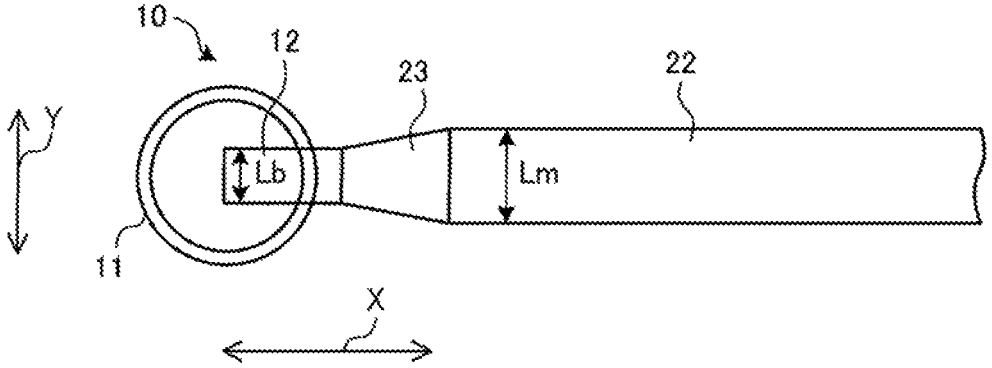
FIG. 45 is a partial view of a cross-section taken along a line B-B in FIG. 44.

FIG. 45 is a partial view of a cross-section taken along a line B-B in FIG. 44. FIG. 45 depicts, in transverse sectional view, how the heat transfer tube 22, the branch tube 12, and the liquid header main tube 11 are connected if the joint tube 23 is used. Letting Lb be the width [m] of the branch tube 12 and Lm be the width [m] of the heat transfer tube 22 in the direction of the arrow Y, if the condition Lb<Lm is satisfied, pressure loss in the liquid header 10 can be reduced.

As described above, as in Embodiment 1, the configuration according to Embodiment 9 makes it possible to obtain, for the heat exchanger 1 of a side-flow type, a distribution of liquid refrigerant flow rate suited for the distribution of air velocity that has a peak near the height of the boss centerline Ob. This leads to enhanced performance of the heat exchanger 1.

Further, in Embodiment 9, each branch tube 12 is the joint tube 23 attached to the end portion of the corresponding heat transfer tube 22. Consequently, the branch tube 12 having a smaller width than the heat transfer tube 22 is connected to the liquid header 10. This configuration makes it possible to reduce pressure loss in the liquid header 10 resulting from the protrusion of the branch tube 12 into the flow passage of the liquid header 10.

Embodiment 10

Figure 46:
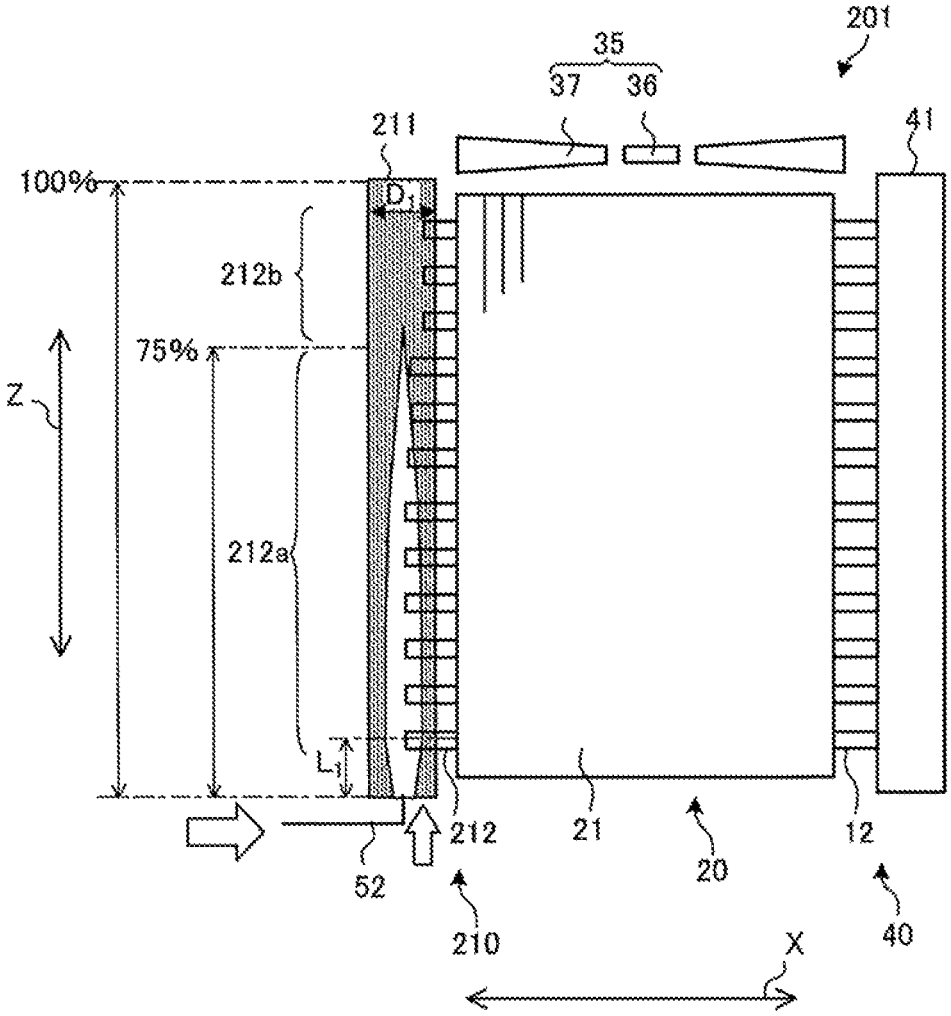
FIG. 46 schematically illustrates an example of a heat exchanger, according to Embodiment 10 of the present invention.
Figure 47:
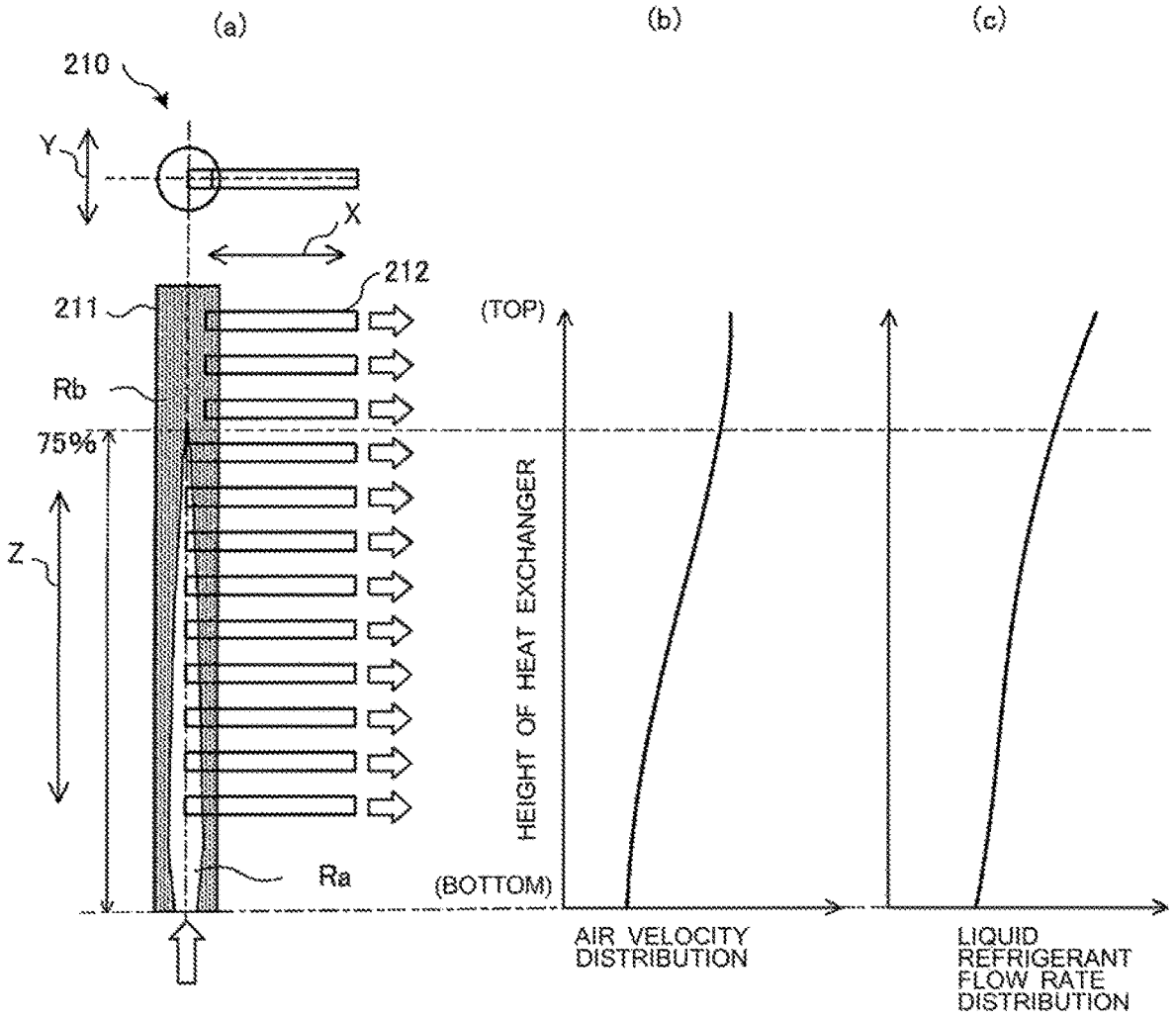
FIG. 47 schematically illustrates a liquid header, and the relationship between liquid refrigerant flow rate and airflow distribution, according to Embodiment 10 of the present invention.

FIG. 46 schematically illustrates an example of a heat exchanger, according to Embodiment 10 of the present invention. FIG. 47 schematically illustrates a liquid header, and the relationship between liquid refrigerant flow rate and airflow distribution, according to Embodiment 10 of the present invention. A heat exchanger 201 includes components such as a liquid header 210, the gas header 40, the heat exchange unit 20, and a plurality of branch tubes 12 and 212 respectively connecting the liquid header 210 and the gas header 40 to the heat exchange unit 20. The heat exchanger 201 according to Embodiment 10 is of a top-flow type in which a fan 35 is disposed over the top of the heat exchanger 201. In the following description of Embodiment 10, features similar to those of Embodiment 1 will be designated by the same reference signs and will not be described in further detail.

As illustrated in FIG. 46, the liquid header 210 is formed by connecting the branch tubes 212 to a liquid header main tube 211. The liquid header 210 is disposed upstream of the heat exchange unit 20. The heat exchange unit 20 and the liquid header 210 are connected by the branch tubes 212. The inlet pipe 52 is connected to the lower end of the liquid header 210 to allow entry of refrigerant flow in a two-phase gas-liquid state into the liquid header 210 from a refrigerant circuit.

The fan 35 includes a boss 36, and blades 37 disposed around the boss 36. The fan 35 supplies air to the heat exchanger 201 as the fan 35 rotates. With the fan 35, for example, air is allowed to pass from the side of the heat exchanger 201, and sent upward in the vertical direction (arrow Z direction). In the heat exchanger 201 of a top-flow type described above, the velocity of air is greatest near the fan 35, that is, in an upper portion of the heat exchanger 201 as illustrated in FIG. 47. Accordingly, in one exemplary configuration, all of the branch tubes 212 of the liquid header 210 may be inserted up to a point near the center of the inside diameter of the liquid header main tube 211. In FIG. 47, the vertical axis is height in the heat exchanger 201. FIG. 47(*a*) illustrates the configuration of the liquid header 210, FIG. 47(*b*) illustrates the distribution of liquid refrigerant flow rate in the liquid header 210, and FIG. 47(*c*) illustrates airflow distribution in the heat exchanger 201.

As in Embodiment 1, if the quality x of refrigerant entering the liquid header 210 is in the range of $0.05 \leq x \leq 0.30$, the resulting refrigerant distribution is optimal for the distribution of airflow in the heat exchanger 201 of a top-flow type, leading to enhanced heat exchanger performance.

In FIG. 46, when the height of the lower end of the heat exchanger 201 is defined as 0%, and the height of the upper end is defined as 100%, branch tubes 212*b*, which are upper-positioned branch tubes 212 connected at 75% to 100% of the height of the heat exchanger 201, are inserted into the liquid header main tube 211 such that the distal end portions of the branch tubes 212*b* are covered in the liquid layer. The characteristics of liquid refrigerant distribution in this case are hardly unchanged from those in the case of the above-mentioned configuration in which all of the branch tubes 212 are inserted up to a point near the center of the inside diameter of the liquid header main tube 211. Accordingly, as for the branch tubes 212*b* connected at the 75% to 100% height positions, the smaller the amount of insertion of their distal ends into the liquid header 210, the better from the viewpoint of reducing pressure loss.

In FIG. 46, branch tubes 212*a*, which are lower-positioned branch tubes connected to the liquid header main tube 211 at the 0% to 75% height positions, are inserted into the liquid header main tube 211 such that, when the quality x of refrigerant is in the range of $0.05 \leq x \leq 0.30$, the distal ends of the branch tubes 212*a* penetrate the liquid layer. As described above, at least the lower-positioned branch tubes 212*a* of the branch tubes 212 connected to the liquid header 210 are inserted so as to penetrate the liquid layer. This configuration makes it possible to achieve a distribution of liquid refrigerant suited for the heat exchanger 201 of a top-flow type as illustrated in FIG. 47, leading to enhanced performance of the heat exchanger 201 and consequently enhanced energy efficiency.

Although FIG. 46 depicts an arrangement in which the amount of insertion of the branch tubes 212 is made to differ above and below the 75% height position used as a boundary, this should not be construed restrictively. In one alternative configuration, among the branch tubes 212 connected to the liquid header 210, the majority of the branch tubes 212 may be inserted such that their distal end portions penetrate the liquid layer, and at least the uppermost branch tube is connected such that its distal end portion is covered in the liquid layer. In this regard, the majority of the branch tubes 212 means more than half of the total number of the branch tubes 212. Within this range, the height position serving as the above-mentioned boundary may be determined in accordance with the distribution of airflow in the heat exchange unit 20, the length Lt of the stagnation region in an upper portion of the liquid header 210, the flow pattern of refrigerant, or other factors.

The inlet pipe 52 may not necessarily be connected to the lower end of the liquid header 10. The inlet pipe 52 may be inserted at any position located within the space defined by the lower end of the liquid header 10 and the centerline of the branch tube 12 located closest to the lower end.

Although the foregoing description is directed to the case of using the branch tube 12, the heat transfer tube 22 of the heat exchange unit 20 may be extended and connected to the liquid header main tube 211. Alternatively, the joint tube 23 that transforms a tube shape may be used. The branch tube 12 may not necessarily be a circular tube but may be, for example, a flat tube.

As for the portion of the liquid header main tube 211 at the 0% to 75% height positions, the branch tubes 212*a* may be connected to the liquid header main tube 211 in any manner as long as the branch tubes 212*a* penetrate the liquid layer of refrigerant flowing in the liquid header main tube 211. That is, the distal end portions of the branch tubes 212*a* may be located within a certain range of area near the center of the liquid header main tube 211.

In connecting the branch tubes 212*a* to the liquid header main tube 211 at the 0% to 75% height positions, the features described above with reference to Embodiment 1, such as the range of locations of the distal end portions of the branch tubes 212*a*, the refrigerant quality range, and the characteristics of flow patterns, can be employed to thereby achieve improved distribution performance by utilizing, for example, the characteristics of an annular or churn flow pattern as illustrated in FIG. 10.

Figure 48:
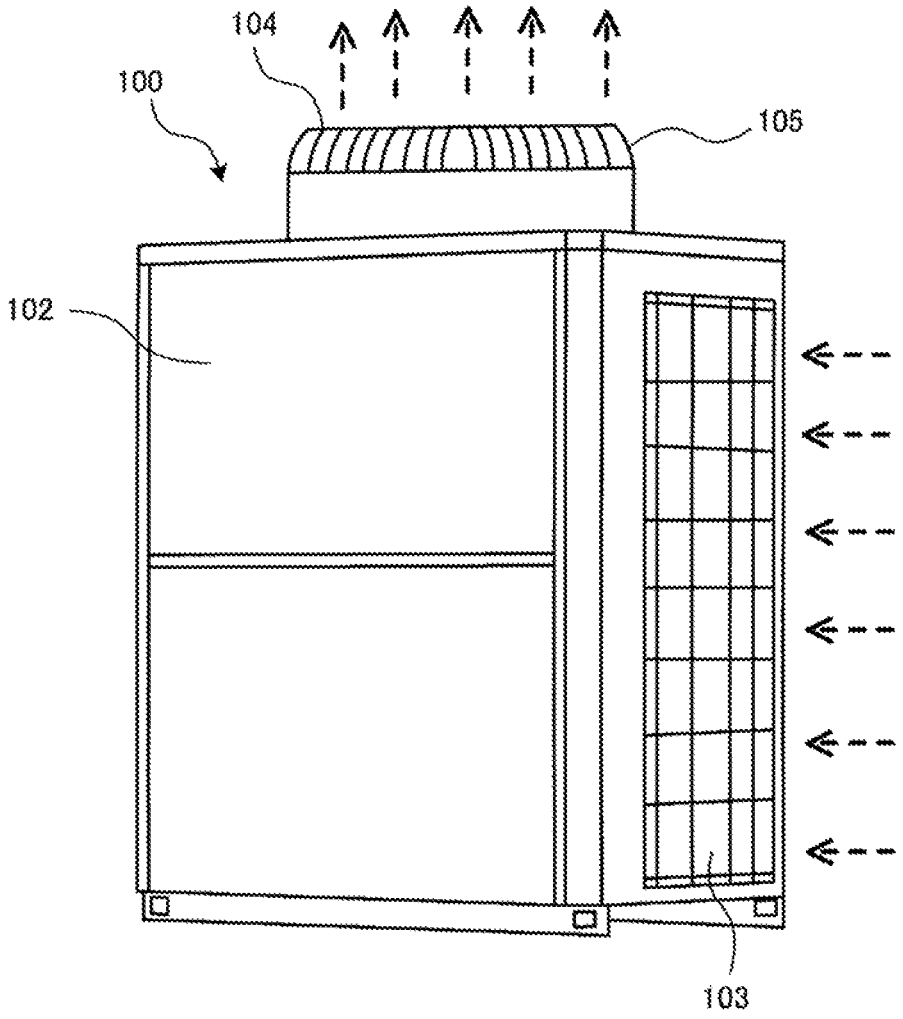
FIG. 48 illustrates the outward appearance of an example of a top-flow type outdoor unit, according to Embodiment 10 of the present invention.

FIG. 48 illustrates the external appearance of an example of an outdoor unit equipped with a top-flow type heat exchanger, according to Embodiment 10 of the present invention. The broken arrows in FIG. 48 represent the flow of air.

In the following description, words indicating directions (e.g., "upper", "lower", "right", "left, "front", or "back") are used to facilitate understanding. However, these words are for illustrative purposes only. These words are not intended to limit the scope of the present invention. In Embodiment 10, the words such as "upper", "lower", "right", "left, "front", and "back" are defined with reference to when an outdoor unit 100 is viewed from the front.

In the outdoor unit 100 illustrated in FIG. 48 equipped with the heat exchanger 201 of a top-flow type, a refrigeration cycle circuit is formed by circulating refrigerant between the outdoor unit 100 and an indoor unit (not illustrated). The outdoor unit 100 is used as, for example, the outdoor unit of a multi-air-conditioning apparatus for building applications, and installed in areas such as building rooftop.

The outdoor unit 100 includes a casing 102 formed in a box-like shape. The casing 102 has an air inlet 103 defined by an opening on the side of the casing 102, and an air outlet 104 defined by an opening on the top of the casing 102. The outdoor unit 100 includes the heat exchanger 201 disposed inside the casing 102 along the air inlet 103. The outdoor unit 100 is provided with a fan guard 105 disposed to cover the air outlet 104 in a manner that allows passage of air therethrough. The outdoor unit 100 is also provided with the fan 35 of a top-flow type disposed inside the fan guard 105 to suck in outside air from the air inlet 103 and discharge the outside air from the air outlet 104.

Figure 49:
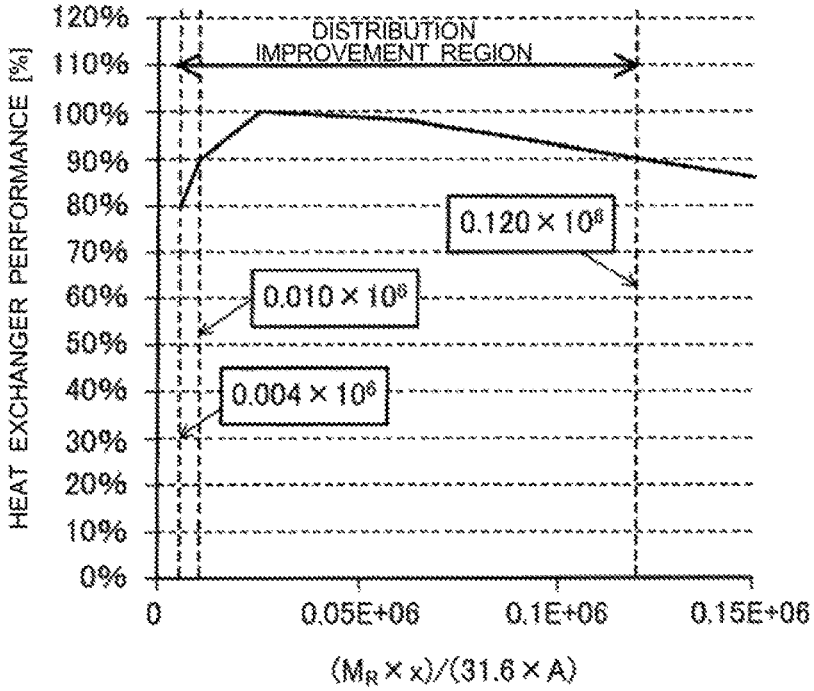
FIG. 49 illustrates the relationship between a parameter $(M_R \times x)/(31.6 \times A)$ related to the thickness of the liquid film of refrigerant, and heat exchanger performance, according to Embodiment 10 of the present invention.

FIG. 49 illustrates the relationship between a parameter $(M_R \times x)/(31.6 \times A)$ related to the thickness of the liquid phase, and heat exchanger performance, according to Embodiment 10 of the present invention. The thickness of the liquid phase is an important parameter in achieving a distribution of refrigerant that conforms to the distribution of airflow provided by the fan 35 of a top-flow type. According to an experiment conducted by the inventors, in the case of the heat exchanger 201 with the fan 35 of a top-flow type, the parameter $(M_R \times x)/(31.6 \times A)$ related to the thickness of the liquid film of refrigerant is in the range of $0.004 \times 10^6 \leq (M_R \times x)/(31.6 \times A) \leq 0.120 \times 10^6$, where $M_R$ is the maximum flow rate [kg/h] of refrigerant in the liquid header 210, x is refrigerant quality, and "A" is the effective channel cross-sectional area [$m^2$] of the liquid header main tube 211.

More preferably, the parameter $(M_R \times x)/(31.6 \times A)$ related to the thickness of the liquid film (thickness of the liquid phase) of refrigerant is in the range of $0.010 \leq (M_R \times x)/(31.6 \times A) \leq 0.120 \times 10^6$. In this case, improved distribution performance can be obtained over a wide range of operating conditions.

If the parameter $(M_R \times x)/(31.6 \times A)$ representing the thickness of the liquid film (thickness of the liquid phase) of refrigerant satisfies the range condition as illustrated in FIG. 49, refrigerant distribution characteristics suited for the distribution of airflow are obtained. The maximum refrigerant flow rate $M_R$ is defined as the flow rate of refrigerant under rated heating operation condition, and can be measured by using, for example, compressor input and indoor unit capacity, or the rotation speed of the compressor and the number of operating indoor units.

Figure 50:
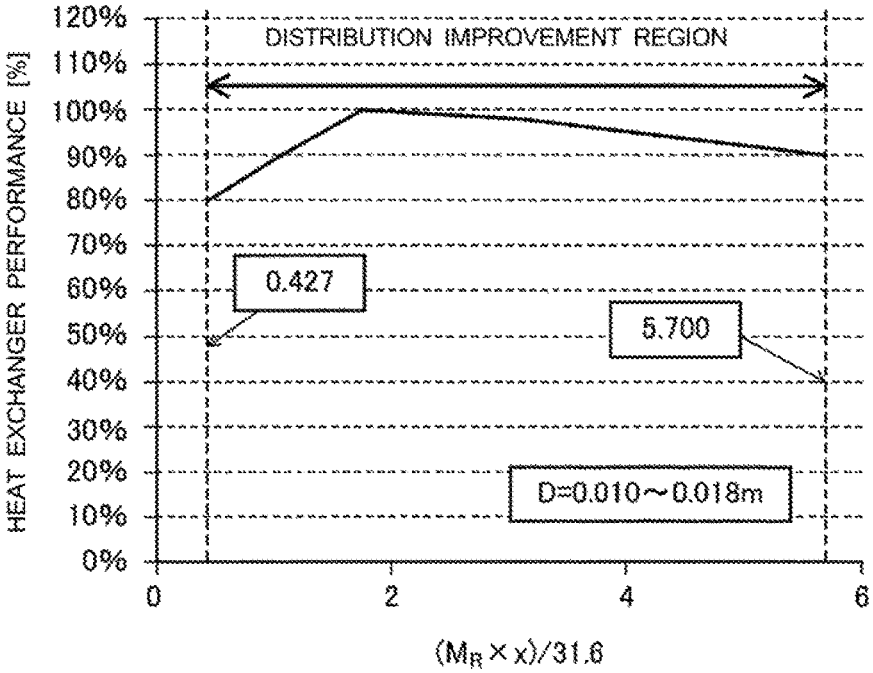
FIG. 50 illustrates the relationship between a parameter $(M_R \times x)/31.6$ related to the thickness of the liquid film of refrigerant, and heat exchanger performance, according to Embodiment 10 of the present invention.

FIG. 50 illustrates the relationship between a parameter $(M_R \times x)/31.6$ related to the thickness of the liquid film of refrigerant, and heat exchanger performance, according to Embodiment 10 of the present invention. As illustrated in FIG. 50, if the heat transfer tubes 22 are of substantially the same length, when the inside diameter D [m] of the liquid header 210 is in the range of $0.010 \leq D \leq 0.018$, the parameter $(M_R \times x)/31.6$ preferably satisfies the condition $0.427 \leq (M_R \times x)/31.6 \leq 5.700$. This results in optimized thickness of the liquid film of refrigerant flowing in the liquid header 210, leading to improved distribution performance.

Figure 51:
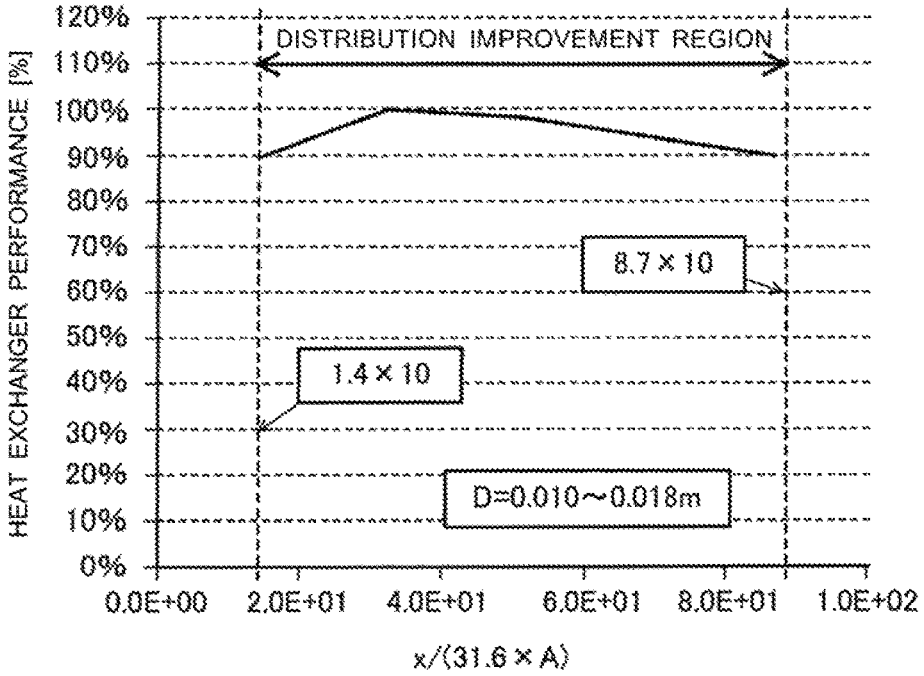
FIG. 51 illustrates the relationship between a parameter $x/(31.6 \times A)$, which is a flow pattern not dependent on the flow rate of refrigerant, and heat exchanger performance, according to Embodiment 10 of the present invention.

FIG. 51 illustrates a parameter $x/(31.6 \times A)$, which is a flow pattern not dependent on the flow rate of refrigerant, and heat exchanger performance, according to Embodiment 10 of the present invention. As illustrated in FIG. 51, desirably, the above-mentioned parameter $x/(31.6 \times A)$ satisfies the following condition: $1.4 \times 10 \leq x/(31.6 \times A) \leq 8.7 \times 10$. In this case, refrigerant distribution performance optimized for the distribution of airflow provided by the fan 35 of a top-flow type is obtained irrespective of refrigerant flow rate.

Figure 52:
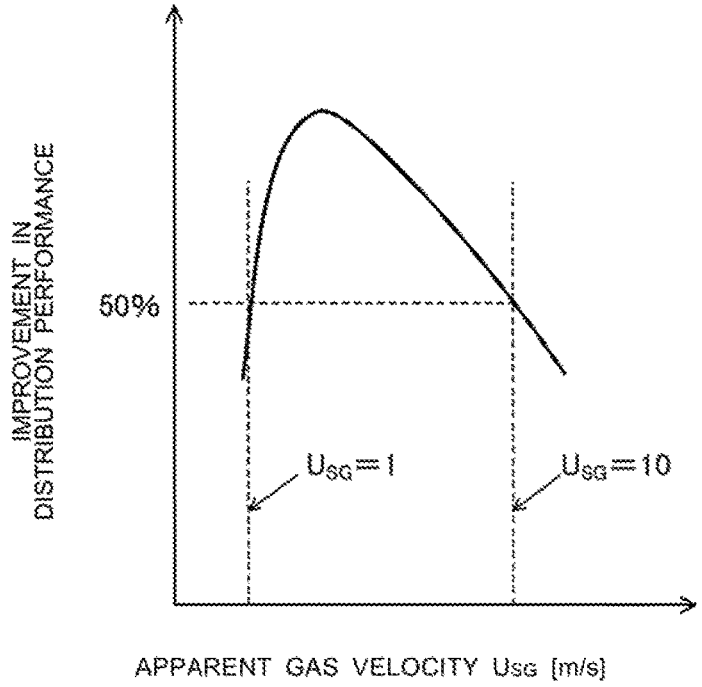
FIG. 52 illustrates the relationship between gas apparent velocity $U_{SG}$ [m/s] and improvement in distribution performance, according to Embodiment 10 of the present invention.

FIG. 52 illustrates the relationship between gas apparent velocity $U_{SG}$ [m/s] and improvement in distribution performance, according to Embodiment 10 of the present invention. As illustrated in FIG. 52, if the gas apparent velocity $U_{SG}$ satisfies the condition $1 \leq U_{SG} \leq 10$, performance degradation due to maldistribution can be reduced to ½ or less. The gas apparent velocity $U_{SG}$ [m/s] in this case is defined as $U_{SG} = (G \times x)/\rho_G$, where G is the flow velocity of refrigerant [kg/($m^2$s)] entering the liquid header 210, x is refrigerant quality, and $\rho_G$ is refrigerant gas density [kg/$m^3$]. The refrigerant flow velocity G [kg/($m^2$s)] is defined as $G = M_R/(3600 \times A)$, where $M_R$ [kg/h] is the maximum flow rate through the liquid header 210, and "A" is the effective channel cross-sectional area [$m^2$] of the liquid header 210.

As described above, in Embodiment 10, the air-conditioning apparatus includes the heat exchanger 201, the fan 35, and the refrigerant circuit. The heat exchanger 201 includes the heat transfer tubes 22 in which refrigerant flows, the heat transfer tubes 22 being arranged so as to be spaced apart from each other in the vertical direction (arrow Z direction), and the header manifold (liquid header main tube 211) that has a flow space defined inside the header manifold and extending in the vertical direction, the header manifold allowing refrigerant to flow into the heat transfer tubes 22 from the branch tubes 212 arranged so as to be spaced apart from each other in the vertical direction. The fan 35 is located above the heat transfer tubes 22. The refrigerant circuit is a circuit to direct the refrigerant into the flow space such that the refrigerant flows upward in a two-phase gas-liquid state, and to cause the refrigerant to evaporate in the heat exchanger 201. The refrigerant flows in the header manifold in an annular or churn flow pattern in which the gas-phase refrigerant Ra collects at the center of the header manifold and the liquid-phase refrigerant Rb collects on the wall surface of the header manifold. When the distance from the center of the flow space in the horizontal plane is represented on a scale of 0 to 100%, where 0% is the center of the flow space and 100% is the position of the wall surface of the header manifold, the majority (e.g., the branch tubes 212*a*) of the branch tubes 212 connected to the header manifold are inserted into the header manifold such that the distal ends of the branch tubes are positioned at 0 to 50% of the distance from the center, and at least the uppermost one (e.g., the branch tube 212*b*) of the branch tubes connected to the header manifold is connected to the header manifold such that the distal end of the branch tube is positioned at more than 50% of the distance from the center.

Consequently, in the air-conditioning apparatus, the branch tubes 212*a*, which represent the majority of the branch tubes 212 connected to the liquid header main tube 211, are inserted such that the distal ends of the branch tubes 212*a* penetrate the liquid layer, and at least the uppermost branch tube 212*b* is inserted such that the distal end of the branch tube 212*b* is covered in the liquid layer. This ensures that, in the case of an arrangement with a large amount of liquid-phase refrigerant Rb distributed along the wall surface inside the liquid header 210, in an area of the liquid header 210 connected with the branch tubes 212*a*, which represent the majority of the branch tubes 212, a large amount of liquid refrigerant is distributed to an upper portion of the area, and in an area of the liquid header 210 connected with the uppermost branch tube 212*b*, pressure loss resulting from the protrusion of the branch tube 212*b* into the flow passage of the liquid header 210 is reduced. Therefore, in the case of the heat exchanger 201 of a top-flow type with the fan 35 disposed above the heat exchanger 201, the above-mentioned configuration makes it possible to obtain a distribution of liquid refrigerant flow rate suited for the distribution of air velocity that has a peak at the location closest to the fan 35. This results in enhanced performance of the heat exchanger 201 in the air-conditioning apparatus, leading to enhanced energy efficiency.

Embodiment 11

Figure 53:
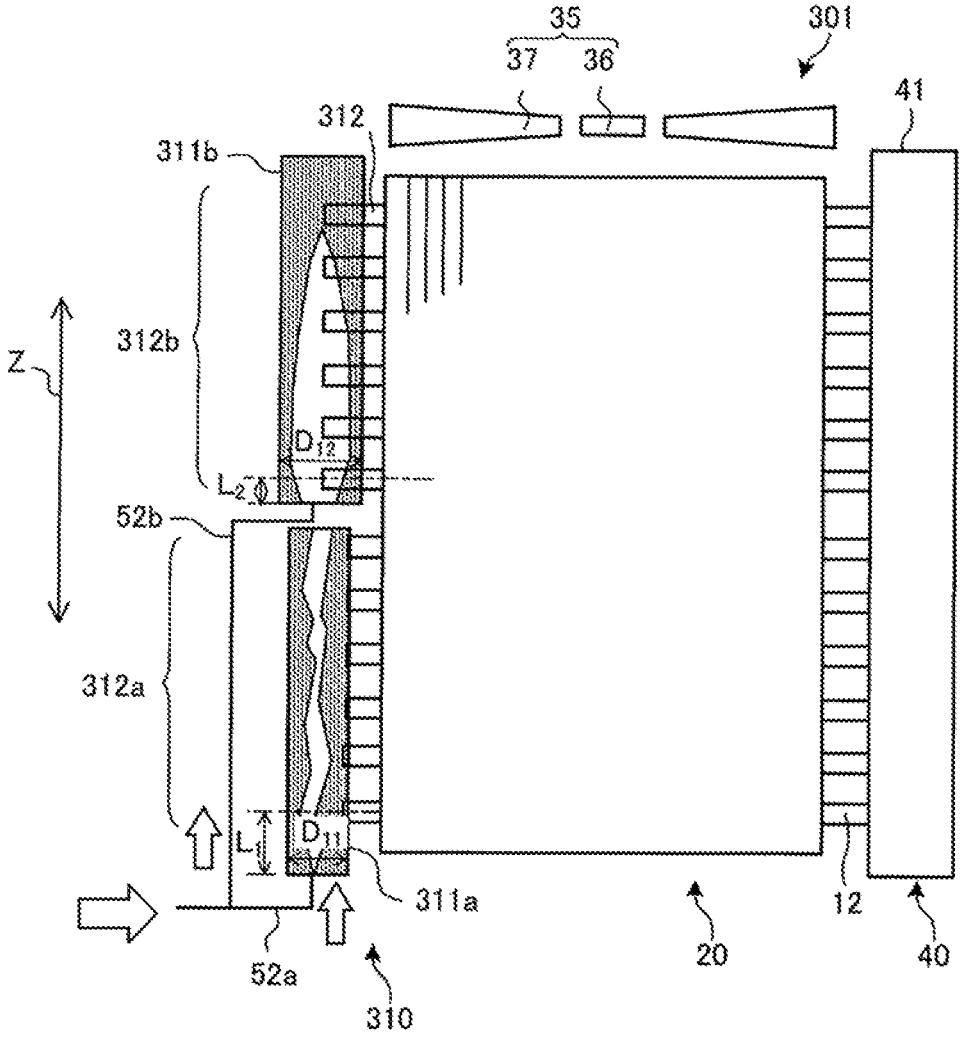
FIG. 53 schematically illustrates an example of a heat exchanger, according to Embodiment 11 of the present invention.

FIG. 53 schematically illustrates an example of a heat exchanger, according to Embodiment 11 of the present invention. In Embodiment 11, in a heat exchanger 301 of a top-flow type, a liquid header 310 is divided into at least two parts. In the following description of Embodiment 11, features identical with those of Embodiment 10 will be designated by the same reference signs and will not be described in further detail, and only features different from those of Embodiment 10 will be described.

The main tube of the liquid header 310 is divided into upper and lower parts. The liquid header 310 thus includes a first liquid header main tube 311*a*, which is the lower liquid header main tube, and a second liquid header main tube 311*b*, which is the upper liquid header main tube. That is, the second liquid header main tube 311*b* is disposed in the portion of the liquid header 310 located closest to the fan 35.

In Embodiment 11, a plurality of branch tubes 312*b* connected to the second liquid header main tube 311*b*, which is the upper liquid header main tube, are inserted so as to penetrate the liquid layer. By contrast, a plurality of branch tubes 312*a* connected to the first liquid header main tube 311*a*, which is the lower liquid header main tube, may be inserted such that the distal end portions of the branch tubes 312*a* penetrate the liquid layer, or may be connected such that the distal end portions of the branch tubes 312*a* are covered in the liquid layer. For a case in which the branch tubes 312*a* are connected so as to be covered in the liquid layer as illustrated in FIG. 53, it is preferable to make the first liquid header main tube 311*a* have an inside diameter $D_{11}$ [m] smaller than the inside diameter $D_{12}$ [m] of the second liquid header main tube 311*b*.

FIG. 53 depicts a case in which all the branch tubes 312*b* connected to the second liquid header main tube 311*b*, which is the upper liquid header main tube, penetrate the liquid film of refrigerant flowing in the liquid header 310, and all the branch tubes 312*a* connected to the first liquid header main tube 311*a*, which is the lower liquid header main tube, fall within the liquid film of refrigerant flowing in the liquid header 310. However, improved distribution in the heat exchanger 301 can be obtained as long as, for example, a half or more of the number of the branch tubes 312*b* are connected so as to penetrate the liquid layer of refrigerant flowing in the liquid header 310, and a half or more of the number of the branch tubes 312*a* are connected so as to fall within the liquid layer of refrigerant flowing in the liquid header 310.

Figure 54:
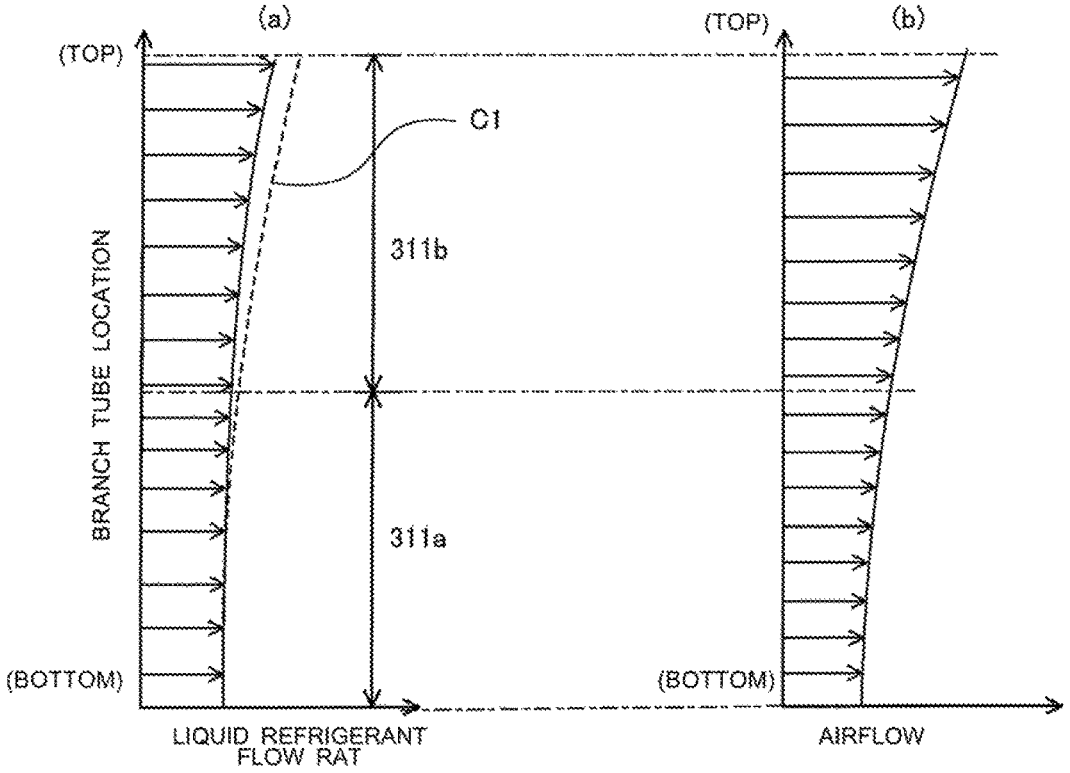
FIG. 54 schematically illustrates an example of the distribution of liquid refrigerant flow rate in a liquid header, and an example of airflow distribution in a heat exchanger, according to Embodiment 11 of the present invention.

FIG. 54 schematically illustrates an example of the distribution of liquid refrigerant flow rate in a liquid header, and an example of airflow distribution in a heat exchanger, according to Embodiment 11 of the present invention. The vertical axis is the location of each branch tube 312 in the vertical direction (arrow Z direction). FIG. 54(*a*) illustrates liquid refrigerant flow rate relative to the location of the branch tube 312, and FIG. 54(*b*) illustrates airflow relative to the location of the branch tube 312. The dashed line C1 in FIG. 54 is liquid refrigerant flow rate suited for the distribution of airflow in a top-flow arrangement.

As described above, the branch tubes 312*b* are connected to the second liquid header main tube 311*b* such that the distal end portions of the branch tubes 312*b* penetrate the liquid layer. As a result, in areas of the liquid header 310 close to the fan, a large amount of liquid refrigerant can be distributed to the upper portion of the liquid header 310.

Figure 55:
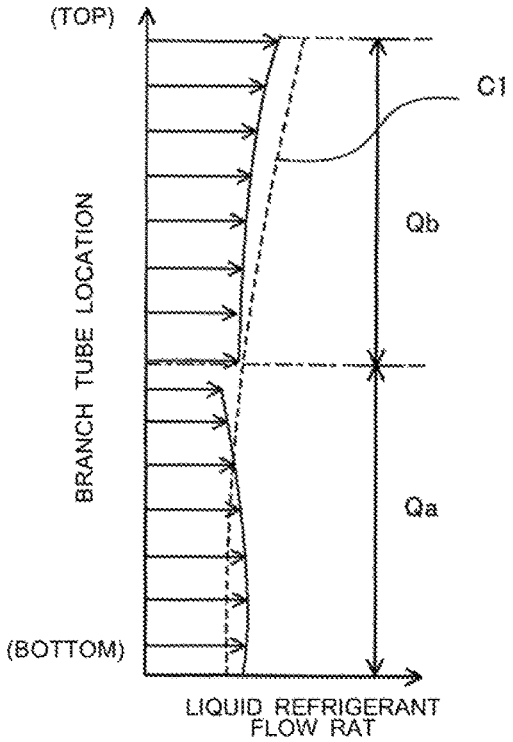
FIG. 55 illustrates another example of the distribution of liquid refrigerant flow rate in a liquid header, according to Embodiment 11 of the present invention.

FIG. 55 illustrates another example of the distribution of liquid refrigerant flow rate in a liquid header, according to Embodiment 11 of the present invention. FIG. 55 illustrates the distribution of liquid refrigerant for a case in which the distal ends of the branch tubes 312*a* connected to the first liquid header main tube 311*a* are covered in the liquid layer. As is apparent from FIG. 55, in the first liquid header main tube 311*a* located farther from the fan 35 than is the second liquid header main tube 311*b*, the location of the distal end of the branch tube 312 has a smaller influence on the distribution of liquid refrigerant than in the second liquid header main tube 311*b*. Accordingly, as long as the branch tubes 312*b* connected to the second liquid header main tube 311*b* are inserted such that their distal end portions penetrate the liquid layer, the distribution of liquid refrigerant in an upper portion of the liquid header 310 can be improved, and the resulting liquid refrigerant distribution can be made closer to a liquid refrigerant distribution suited for the distribution of airflow in a top-flow arrangement as indicated by the broken line C1. At this time, it is more desirable if the inside diameter $D_{11}$ of the first liquid header main tube 311*a* and the inside diameter $D_{12}$ of the second liquid header main tube 311*b* satisfy the condition $D_{12}>D_{11}$ as described above.

The liquid header 310 may not necessarily be divided into a plurality of main tubes. For example, as with the arrangement illustrated in FIG. 31, the flow passage inside the liquid header may be divided into a plurality of passages by the partition wall 14 or other such component.

As described above, in Embodiment 11, the air-conditioning apparatus includes the heat exchanger 301, the fan 35, and the refrigerant circuit. The heat exchanger 301 includes the heat transfer tubes 22 in which refrigerant flows, the heat transfer tubes 22 being arranged so as to be spaced apart from each other in the vertical direction (arrow Z direction), and the header manifold (the first liquid header main tube 311*a* and the second liquid header main tube 311*b*) that has a flow space defined inside the header manifold and extending in the vertical direction, the header manifold allowing refrigerant to flow into the heat transfer tubes 22 from the branch tubes 312 arranged so as to be spaced apart from each other in the vertical direction. The fan 35 is located above the heat transfer tubes 22. The refrigerant circuit is a circuit to direct the refrigerant into the flow space such that the refrigerant flows upward in a two-phase gas-liquid state, and to cause the refrigerant to evaporate in the heat exchanger 301. The refrigerant flows in the header manifold in an annular or churn flow pattern in which the gas-phase refrigerant Ra collects at the center of the header manifold and the liquid-phase refrigerant Rb collects on the wall surface of the header manifold. The header manifold includes a plurality of header manifolds (the first liquid header main tube 311*a* and the second liquid header main tube 311*b*) disposed at different heights in the vertical direction. When the distance from the center of the flow space in the horizontal plane is represented on a scale of 0 to 100%, where 0% is the center of the flow space and 100% is the position of the wall surface of the header manifold, the majority of the branch tubes 312*b* connected to the header manifold (second liquid header main tube 311*b*) located closest to the fan 35 are inserted such that the distal ends of the branch tubes 312*b* are positioned at 0 to 50% of the distance from the center, and the majority of the branch tubes 312*a* connected to the header manifold (first liquid header main tube 311*a*) disposed below the header manifold located closest to the fan 35 are connected such that the distal ends of the branch tubes 312*a* are positioned at more than 50% of the distance from the center.

Consequently, in the air-conditioning apparatus, among the branch tubes 312 connected to the liquid header 310, the majority of the branch tubes 312*b* connected to the second liquid header main tube 311*b* located closest to the fan 35 are inserted such that their distal ends penetrate the liquid layer. This ensures that, if a large amount of liquid-phase refrigerant Rb is distributed along the wall surface inside the liquid header 310, in the second liquid header main tube 311*b* located closest to the fan 35, a large amount of liquid refrigerant can be distributed to the upper portion of the second liquid header main tube 311*b*. Therefore, in the case of the heat exchanger 301 of a top-flow type with the fan 35 disposed above the heat exchanger 301, the above-mentioned configuration makes it possible to obtain a distribution of liquid refrigerant flow rate suited for the distribution of air velocity that has a peak at the position closest to the fan 35. This results in enhanced performance of the heat exchanger 301 in the air-conditioning apparatus, leading to enhanced energy efficiency.

The flow space in the header manifold (second liquid header main tube 311*b*) located closest to the fan 35 has the inside diameter $D_{12}$ greater than the inside diameter $D_{11}$ of the flow space in the header manifold (first liquid header main tube 311*a*) disposed below the header manifold located closest to the fan 35.

Consequently, in the second liquid header main tube 311*b*, which is the liquid header main tube of the liquid header 310 located closest to the fan 35, an increase in flow resistance due to the heat branch tubes 312 can be minimized, thus facilitating entry of refrigerant. As a result, in the heat exchanger 301, a large amount of liquid refrigerant can be distributed to the upper portion of the liquid header 310. This allows refrigerant to be distributed in a manner suited for the distribution of air velocity in the heat exchanger 301 in a top-flow arrangement.

Embodiment 12

Figure 56:
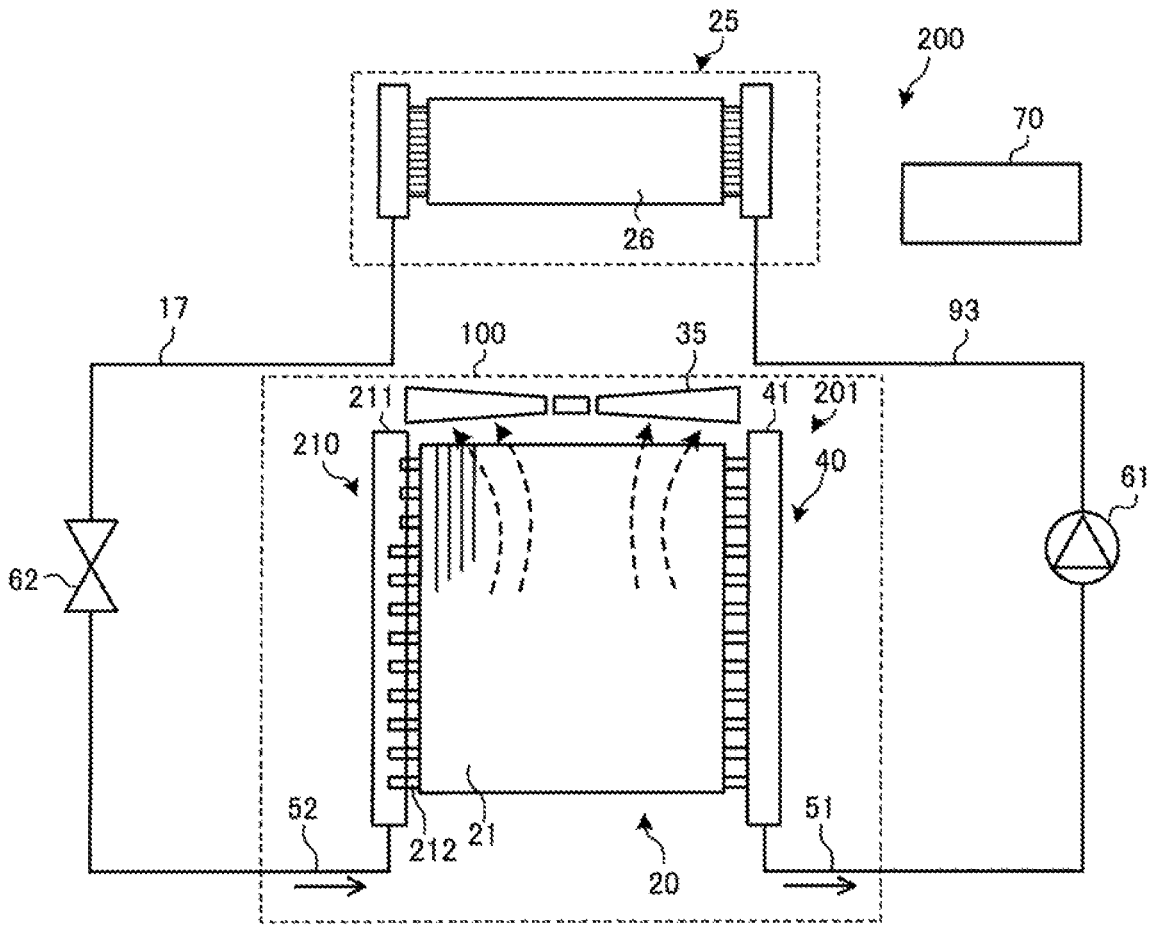
FIG. 56 is a circuit diagram illustrating an example of the refrigerant circuit of an air-conditioning apparatus, according to Embodiment 12 of the present invention.

Embodiment 12 of the present invention will be described below. FIG. 56 is a circuit diagram illustrating an example of the refrigerant circuit of an air-conditioning apparatus, according to Embodiment 12 of the present invention. In the following, a description will not be given of features overlapping those of Embodiment 10, and features identical or corresponding to those of Embodiment 10 will be designated by the same reference signs. An air-conditioning apparatus 200 according to Embodiment 12 may be equipped with any one of the heat exchangers according to Embodiments 1 to 11.

The following description of Embodiment 12 will be directed to the air-conditioning apparatus 200 capable of heating operation and in which the heat exchanger 201 (to be referred to as outdoor heat exchanger hereinafter) including the liquid header 210 described above with reference to Embodiment 10 is connected to a compressor 61, a first expansion device 62, and an indoor heat exchanger 26 by refrigerant pipes to form a refrigeration cycle circuit. In the air-conditioning apparatus 200 illustrated in FIG. 56, the outdoor unit 100 including components such as the liquid header 210 and the outdoor heat exchanger (heat exchanger 201) is connected to an indoor unit 25 including components such as the indoor heat exchanger 26. The compressor 61 compresses refrigerant. The first expansion device 62 reduces the pressure of refrigerant.

The air-conditioning apparatus 200 includes a controller 70 configured to control operation. The controller 70 is implemented by a microcomputer including a CPU, a ROM, a RAM, and an I/O port. The controller 70 is connected with various sensors via wireless or wired control signal lines in a manner that allows the controller 70 to receive information detected by these sensors.

The controller 70 controls the quality of refrigerant entering the liquid header main tube 211 in accordance with the operating condition, for example. Specifically, the controller 70 controls the first expansion device 62 in accordance with the operation mode, the number of indoor units 25 being connected, the frequency of the compressor 61, outside air temperature, indoor temperature, and other operating conditions to thereby control the quality x of refrigerant entering the liquid header 210.

The following describes the flow of refrigerant in heating operation according to Embodiment 12. Refrigerant turns into a high-temperature, high-pressure gaseous state in the compressor 61. The resulting refrigerant is then routed through a compressor discharge pipe 93 into the indoor unit 25. In the indoor unit 25, the gas refrigerant is cooled in the indoor heat exchanger 26 through heat exchange with indoor air. The resulting liquid refrigerant, which has turned into a high-pressure, low-temperature state in the indoor heat exchanger 26, is then routed through an indoor-unit outlet pipe 17 toward the first expansion device 62. In the first expansion device 62, the refrigerant is reduced in pressure, causing the refrigerant to change to two-phase gas-liquid refrigerant or liquid refrigerant at low temperature and low pressure. The refrigerant is then routed through the inlet pipe 52 into the liquid header 210. In the liquid header 210, the refrigerant is distributed to the heat transfer tubes 22. After removing heat in the heat exchange unit 20, the refrigerant is routed through the gas header 40 and the outlet pipe 51 and returned to the compressor 61. The refrigerant returned to the compressor 61 is compressed again into high-temperature, high-pressure refrigerant, which then circulates in the refrigerant circuit.

The controller 70 varies the opening degree of the first expansion device 62 in accordance with the operating condition to control the degree of pressure reduction, thus making it possible to control the quality of refrigerant in the liquid header 210. At this time, desirably, the controller 70 controls the quality x of refrigerant such that, during rated heating operation (100% heating operation), the quality x falls within the range of $0.05 \leq x \leq 0.30$. Such a control allows refrigerant to be distributed in a manner suited for the relative arrangement of the fan 35 and the heat exchanger 201, such as a top-flow arrangement or a side-flow arrangement. This helps enhance the performance of the heat exchanger 201, leading to enhanced energy efficiency of the air-conditioning apparatus 200.

Figure 57:
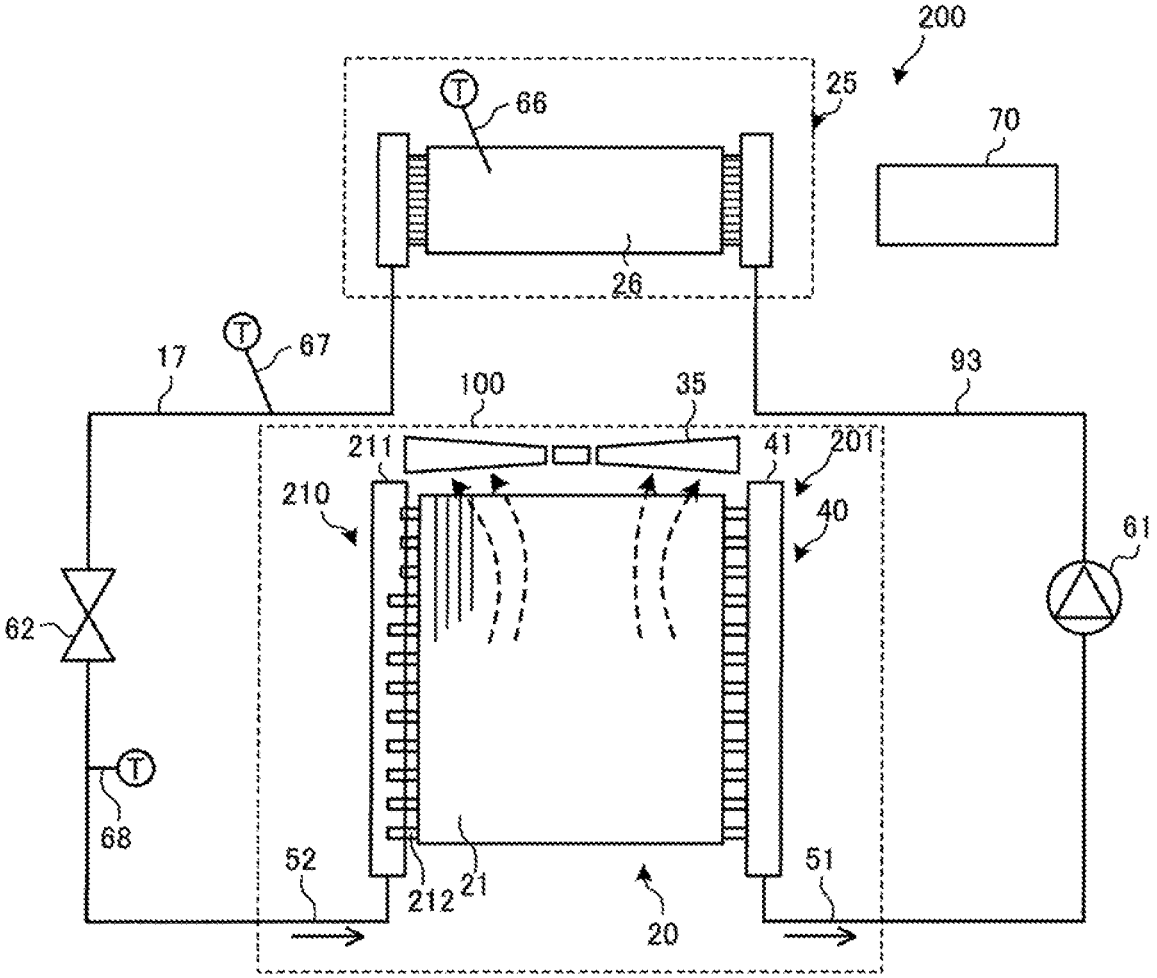
FIG. 57 is a circuit diagram illustrating an example of placement of sensors in an air-conditioning apparatus, according to Embodiment 12 of the present invention.

The air-conditioning apparatus 200 may further include a plurality of sensors. FIG. 57 is a circuit diagram illustrating an example of placement of sensors in an air-conditioning apparatus, according to Embodiment 12 of the present invention. As illustrated in FIG. 57, the air-conditioning apparatus 200 includes sensors such as a first temperature sensor 66, a second temperature sensor 67, and a third temperature sensor 68. The first temperature sensor 66 is disposed on, for example, a heat transfer tube of the indoor heat exchanger 26 to measure the saturation temperature of the indoor heat exchanger 26. The second temperature sensor 67 is installed on the indoor-unit outlet pipe 17 to measure the temperature of refrigerant entering the first expansion device 62. The third temperature sensor 68 is installed on the inlet pipe 52 to measure the saturation temperature downstream of the first expansion device 62. Information detected by these temperature sensors is transmitted to the controller 70.

In the air-conditioning apparatus 200, the controller 70 estimates the quality x of refrigerant based on information detected by the above-mentioned temperature sensors. In the air-conditioning apparatus 200, the temperature and pressure of refrigerant entering the first expansion device 62 can be estimated by using the first temperature sensor 66 and the second temperature sensor 67, thus making it possible to estimate the enthalpy of refrigerant entering the first expansion device 62. Further, in the air-conditioning apparatus 200, a change in refrigerant before and after passage through the first expansion device 62 is considered to be an isenthalpic process, and the saturation temperature downstream of the first expansion device 62 is measured by the third temperature sensor 68 to thereby estimate the pressure of refrigerant. The enthalpy and pressure of refrigerant downstream of the first expansion device 62 are thus determined. This makes it possible for the air-conditioning apparatus 200 to estimate the quality of refrigerant.

As described above, due to the presence of temperature sensors in the air-conditioning apparatus 200, the opening degree of the first expansion device 62 can be adjusted such that the refrigerant quality x falls within the range of $0.05 \leq x \leq 0.30$ under various operating conditions. This makes it possible to extend the optimization range of refrigerant distribution in the liquid header 210.

Although FIG. 57 depicts an exemplary arrangement with three temperature sensors, this should not be construed restrictively. For example, several temperature sensors may be substituted for by pressure sensors, or by information such as compressor frequency, operation mode, or the number of indoor units.

Although the foregoing description is directed to heating operation, cooling operation and heating operation may be made switchable. In this case, the direction of refrigerant flow in cooling operation is reverse to that in heating operation. That is, refrigerant gas at high temperature and high pressure flows into the outdoor heat exchanger (heat exchanger 201) where the refrigerant gas is then cooled through heat exchange with outside air.

As described above, as in Embodiment 10, the configuration according to Embodiment 12 makes it possible to obtain, for the heat exchanger 201 of the air-conditioning apparatus 200, a distribution of liquid refrigerant flow rate suited for the distribution of air velocity that has a peak at the position closest to the fan 35. This results in enhanced performance of the heat exchanger 201, leading to enhanced energy efficiency of the air-conditioning apparatus 200.

In Embodiment 12, the air-conditioning apparatus 200 includes the controller 70 that controls the quality x of refrigerant entering the header manifold (liquid header main tube 211) depending on the operating condition. In the refrigerant circuit, the first expansion device 62 is disposed at a position located upstream of the header manifold relative to the direction of refrigerant flow during heating operation. The controller 70 controls the first expansion device 62.

Consequently, in the air-conditioning apparatus 200, the quality x of refrigerant in the liquid header 210 can be controlled by controlling the first expansion device 62. Such a control allows refrigerant to be distributed in a manner suited for the relative arrangement of the fan 35 and the heat exchanger 201. This helps enhance the performance of the heat exchanger 201, leading to enhanced energy efficiency of the air-conditioning apparatus 200.

Further, the controller 70 controls, during heating operation, the quality x of refrigerant entering the liquid header manifold (liquid header main tube 211) such that the quality x falls within the range of $0.05 \leq x \leq 0.30$. This makes it possible to extend the optimization range of refrigerant distribution in the liquid header 210 of the air-conditioning apparatus 200.

Embodiment 13

Figure 58:
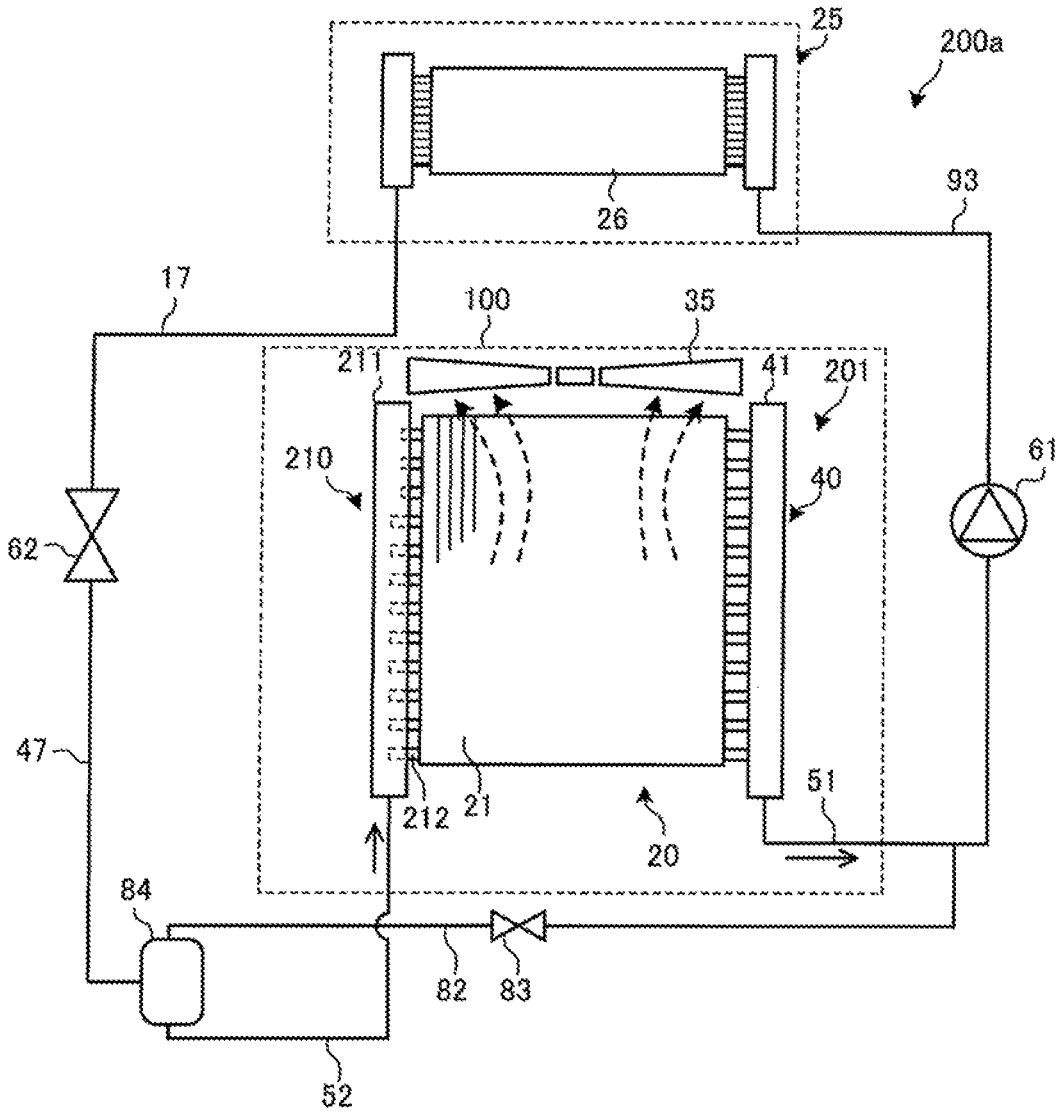
FIG. 58 is a circuit diagram illustrating an example of the refrigerant circuit of an air-conditioning apparatus, according to Embodiment 13 of the present invention.

FIG. 58 is a circuit diagram illustrating an example of the refrigerant circuit of an air-conditioning apparatus, according to Embodiment 13 of the present invention. An air-conditioning apparatus **200*a* according to Embodiment 13 includes a gas-liquid separator vessel 84 added to the air-conditioning apparatus 200** according to Embodiment 12. In the following description of Embodiment 13, features identical to those of Embodiment 12 will be designated by the same reference signs and will not be described in further detail, and only features different from those of Embodiment 12 will be described.

The gas-liquid separator vessel 84 is disposed between the liquid header 210 and the first expansion device 62. The first expansion device 62 and the gas-liquid separator vessel 84 are connected by a connecting pipe 47. The inlet pipe 52, which connects to the liquid header 210, is connected to a lower portion of the gas-liquid separator vessel 84. A bypass pipe 82, which connects to the outlet pipe 51, is connected to an upper portion of the gas-liquid separator vessel 84. A bypass control valve 83 is disposed on the bypass pipe 82. The bypass pipe 82 is used to bypass gas refrigerant separated by the gas-liquid separator vessel 84 to the compressor 61. The opening degree of the bypass control valve 83 can be changed by the controller 70.

Figure 59:
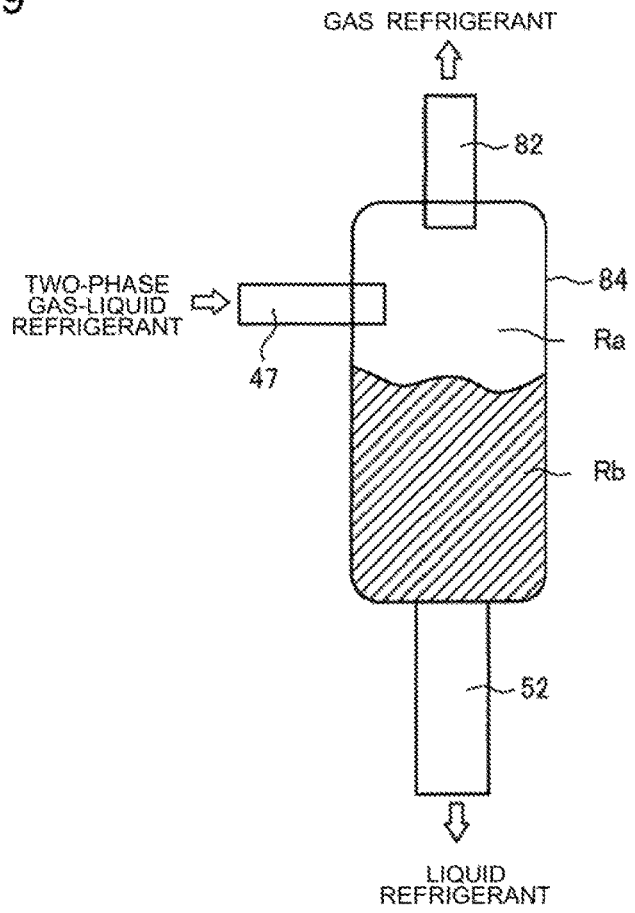
FIG. 59 schematically illustrates an example of the configuration of a gas-liquid separator vessel, according to Embodiment 13 of the present invention.

FIG. 59 schematically illustrates an example of the configuration of a gas-liquid separator vessel, according to Embodiment 13 of the present invention. As illustrated in FIG. 59, the connecting pipe 47 located upstream of the gas-liquid separator vessel 84 is connected to the side of the gas-liquid separator vessel 84. The bypass pipe 82 is connected to a portion of the gas-liquid separator vessel 84 located above the centerline of the connecting pipe 47.

Refrigerant in a two-phase gas-liquid state entering the connecting pipe 47 in the refrigerant circuit flows into the gas-liquid separator vessel 84 where the refrigerant is then separated into gas and liquid by gravity, of which gas refrigerant is directed to the bypass pipe 82 and liquid refrigerant is directed to the inlet pipe 52. At this time, the controller 70 controls the bypass control valve 83 toward the closed position if the quality x of refrigerant flowing in the inlet pipe 52 is $x<0.05$, and controls the bypass control valve 83 toward the open position if $x>0.30$. The quality x of refrigerant entering the liquid header 210 is thus controlled to be in the range of $0.05\leq x\leq 0.30$. The above-mentioned configuration of the air-conditioning apparatus 200*a* helps optimize the distribution of refrigerant to the liquid header 210, leading to enhanced efficiency of the heat exchanger 201 and consequently enhanced energy efficiency. Further, the air-conditioning apparatus 200*a* includes the gas-liquid separator vessel 84. This leads to an extended range of operating conditions over which distribution can be improved.

Figure 60:
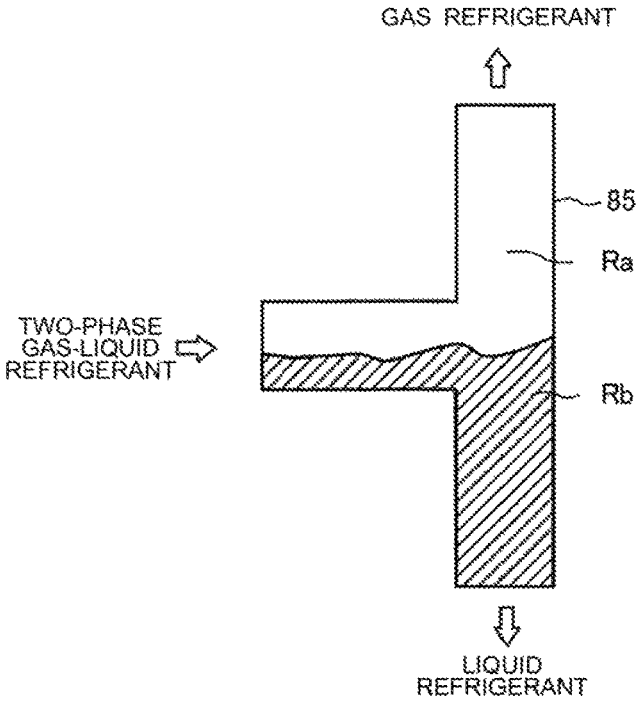
FIG. 60 schematically illustrates another example of the configuration of a gas-liquid separator vessel, according to Embodiment 13 of the present invention.

FIG. 60 schematically illustrates another example of the configuration of a gas-liquid separator vessel, according to Embodiment 13 of the present invention. In FIG. 60, the gas-liquid separator vessel 84 is formed by using a pipe 85 having a T-shape. In FIG. 60, the arrows indicate the flow of refrigerant. FIG. 60 depicts an arrangement in which two-phase gas-liquid refrigerant flows into the pipe 85, and gas refrigerant and liquid refrigerant respectively exit from upper and lower portions of the pipe 85. Employing such a simple structure for the gas-liquid separator vessel 84 makes it possible to control the quality x at low cost in the air-conditioning apparatus 200*a*.

Figure 61:
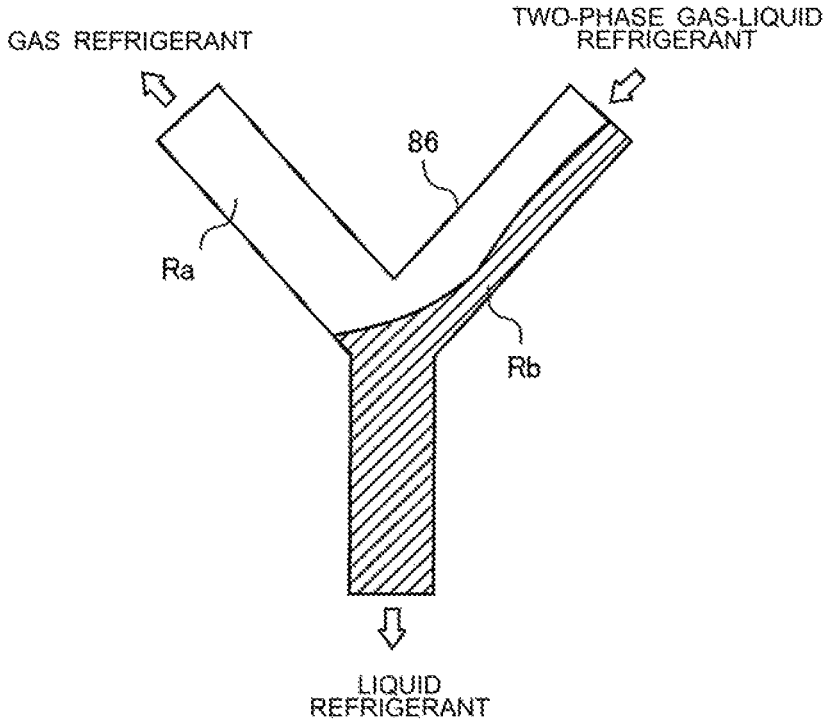

FIG. 61 schematically illustrates another example of the configuration of a gas-liquid separator vessel, according to Embodiment 13 of the present invention. In FIG. 61, the gas-liquid separator vessel 84 is formed by using a Y-shaped pipe 86. In this case, the inlet pipe 52 is connected at an angle to the Y-shaped pipe 86. As illustrated in FIG. 61, two-phase gas-liquid refrigerant flows into the Y-shaped pipe 86, and is separated into gas and liquid. The greater the density of liquid refrigerant, the greater the tendency of the liquid refrigerant to flow toward a lower portion of the pipe under the inertial force, and the higher the gas-liquid separation efficiency, thus making it possible to extend the range of operating conditions over which distribution can be improved.

The foregoing description of the gas-liquid separator vessel is specifically directed to an example of a collision-type gas-liquid separator vessel. Alternatively, for example, other types of gas-liquid separator vessels may be employed, such as another collision-type gas-liquid separator vessel, a gas-liquid separator vessel utilizing surface tension, or a gas-liquid separator vessel utilizing centrifugal force.

In the air-conditioning apparatus 200*a*, gas refrigerant is bypassed by using the gas-liquid separator vessel 84 as described above to thereby reduce the flow of gas refrigerant into the heat exchanger 201. This helps reduce pressure loss in the heat exchanger 201. This configuration of the air-conditioning apparatus 200*a* makes it possible to achieve, in addition to improved distribution of refrigerant, enhanced performance of the heat exchanger 201 due to reduced pressure loss.

As for the effect of incorporating the gas-liquid separator vessel 84, the improvement in distribution, and the reduction of pressure loss in the heat exchanger 201 are greatest in the case of rated heating operation (100% heating operation). For this reason, it is desirable for the controller 70 to, during operation under rated heating condition, control the bypass control valve 83 such that the quality x of refrigerant entering the liquid header 210 is in the range of $0.05\leq x\leq 0.30$.

Although the bypass control valve 83 has been described above as a valve whose opening degree can be adjusted, the bypass control valve 83 may be any component (bypass flow control mechanism) capable of controlling the flow rate of refrigerant through the bypass pipe 82.

Although the foregoing description is directed to the fan 35 in a top-flow arrangement, the above-mentioned configuration may be employed for any one of the heat exchangers described above with reference to Embodiments 1 to 12.

As described above, as in Embodiment 10, the configuration according to Embodiment 13 makes it possible to obtain, for the heat exchanger 201 of the air-conditioning apparatus 200*a*, a distribution of liquid refrigerant flow rate suited for the distribution of air velocity that has a peak at the position closest to the fan 35. This results in enhanced performance of the heat exchanger 201, leading to enhanced energy efficiency of the air-conditioning apparatus 200*a*.

The refrigerant circuit includes the gas-liquid separator vessel 84 (the gas-liquid separator vessel 84, the pipe 85, or the Y-shaped pipe 86) disposed between the first expansion device 62 and the header manifold (liquid header main tube 211), the bypass pipe 82 that connects the gas-liquid separator vessel 84 with an area located downstream of the heat exchanger 201 relative to the direction of refrigerant flow during heating operation, and the bypass flow control mechanism (e.g., the bypass control valve 83) disposed on the bypass pipe 82 to control the flow rate of refrigerant.

As a result, with the air-conditioning apparatus 200*a*, refrigerant in a two-phase gas-liquid state can be separated in the gas-liquid separator vessel 84, and also the quality x of refrigerant entering the liquid header 210 can be controlled by controlling the bypass control valve 83. Therefore, with the air-conditioning apparatus 200*a*, the distribution of refrigerant to the liquid header 210 can be optimized, leading to enhanced efficiency of the heat exchanger 201 and consequently enhanced energy efficiency.

Embodiment 14

Figure 62:
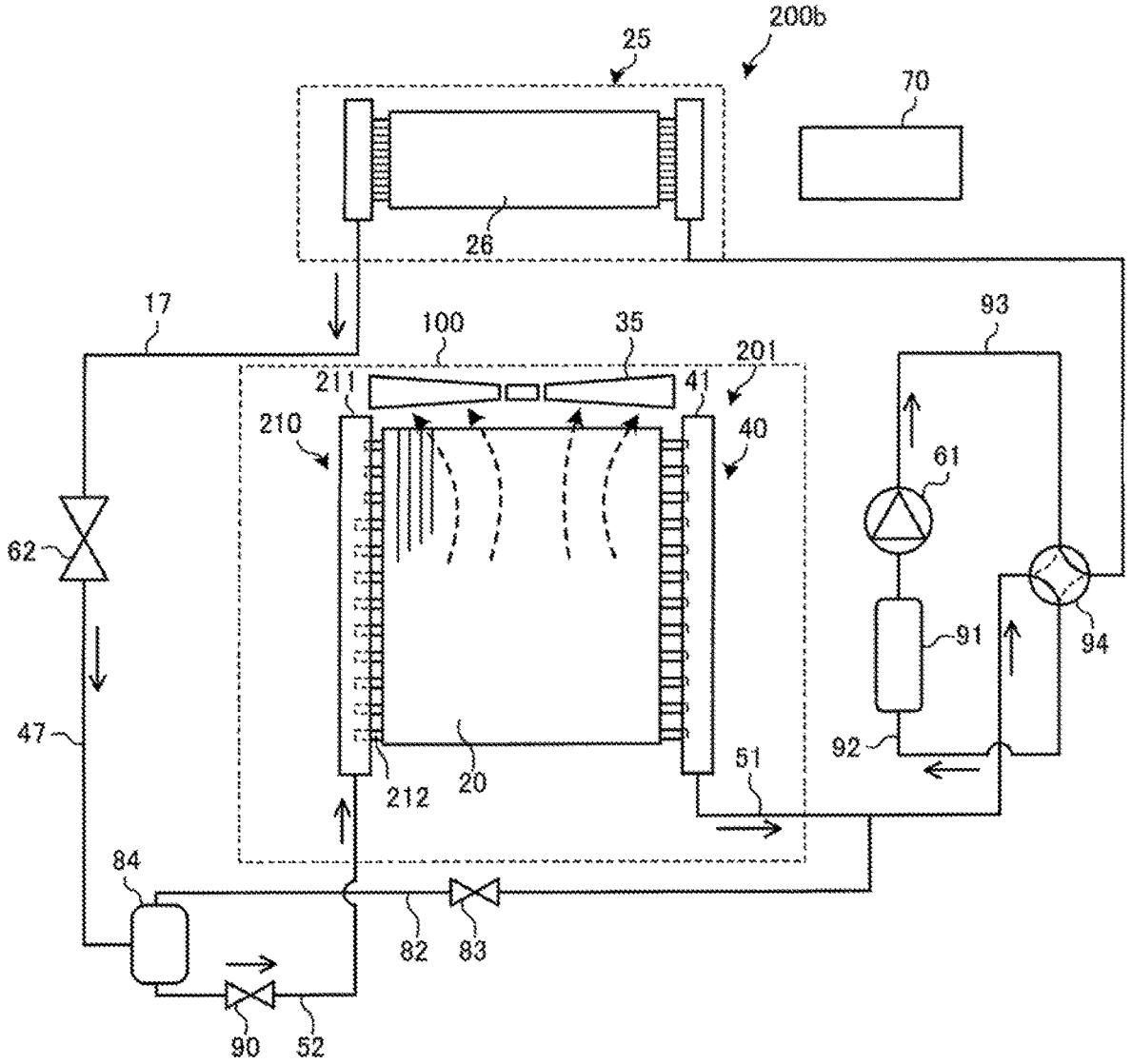
FIG. 62 is a circuit diagram illustrating an example of the refrigerant circuit of an air-conditioning apparatus, according to Embodiment 14 of the present invention.

FIG. 62 is a circuit diagram illustrating an example of the refrigerant circuit of an air-conditioning apparatus, according to Embodiment 14 of the present invention. In Embodiment 14, an air-conditioning apparatus 200*b* is capable of switching between heating operation and cooling operation. The solid arrows in FIG. 62 represent the flow of refrigerant during heating operation. In the following, a description will not be given of features overlapping those of Embodiment 13, and features identical or corresponding to those of Embodiment 13 will be designated by the same reference signs.

In Embodiment 14, the air-conditioning apparatus 200*b* further includes a flow switching device 94, an accumulator 91, and a second expansion device 90. The flow switching device 94 is implemented by, for example, a four-way valve. The flow switching device 94 switches the direction of refrigerant flow between cooling operation and heating operation. The accumulator 91 is disposed on the suction side of the compressor 61. An accumulator inlet pipe 92 is disposed upstream of the accumulator 91. The second expansion device 90 is disposed at a position between the gas-liquid separator vessel 84 and the liquid header 210, that is, on the inlet pipe 52. The opening degree of the second expansion device 90 is adjusted by means of the controller 70.

During heating operation, the quality x of refrigerant entering the liquid header 10 preferably satisfies the condition $0.05 \leq x \leq 0.30$ as this provides improved distribution. In this case, by increasing the pressure of the gas-liquid separator vessel 84 by means of the second expansion device 90, the gas density of refrigerant is increased, and the flow velocity of refrigerant entering the gas-liquid separator vessel 84 is reduced. This makes it possible to obtain high gas-liquid separation efficiency even with the gas-liquid separator vessel 84 that is small in size. When an excessive amount of gas refrigerant is being bypassed by the gas-liquid separator vessel 84 under low refrigerant flow rate conditions, the opening degree of the second expansion device 90 is controlled to a smaller value to increase the flow resistance of the second expansion device 90. This leads to an increased operating range over which the quality x of refrigerant entering the liquid header 10 can be controlled to be in the range of $0.05 \leq x \leq 0.30$.

Although the foregoing description of FIG. 62 is directed to heating operation, in the case of cooling operation, the direction of refrigerant flow is reversed by the flow switching device 94. At this time, the pressure of refrigerant is reduced in two steps by means of the second expansion device 90 and the first expansion device 62. Consequently, excess refrigerant can be accumulated in the gas-liquid separator vessel 84, thus allowing the gas-liquid separator vessel 84 to also serve as a device auxiliary to the accumulator 91. The processing capacity for excess refrigerant is determined by adjusting the opening degrees of the first expansion device 62 and second expansion device 90, and can be varied based on the pressure of the gas-liquid separator vessel 84. This facilitates the control of refrigerant flow rate also during cooling operation, leading to enhanced performance of the air-conditioning apparatus 200*b*. Further, during cooling operation, the gas-liquid separator vessel 84 can be used as a device auxiliary to the accumulator 91, thus allowing the accumulator 91 to have a reduced volume.

Although the heat exchanger 201 has been described above with reference to an exemplary arrangement related to the fan 35 of a top-flow type, any one of the heat exchangers described above with reference to Embodiments 1 to 13 may be employed.

As described above, as in Embodiment 10, the configuration according to Embodiment 14 makes it possible to obtain, for the heat exchanger 201 of the air-conditioning apparatus 200*b*, a distribution of liquid refrigerant flow rate suited for the distribution of air velocity that has a peak at the position closest to the fan 35. This results in enhanced performance of the heat exchanger 201, leading to enhanced energy efficiency of the air-conditioning apparatus 200*b*.

In Embodiment 14, the refrigerant circuit of the air-conditioning apparatus 200*b* further includes the flow switching device 94 that switches the direction of flow of refrigerant, and the second expansion device 90 disposed between the heat exchanger 201 and the first expansion device 62. The controller 70 controls the flow switching device 94, the first expansion device 62, and the second expansion device 90.

Consequently, during heating operation of the air-conditioning apparatus 200*b*, the second expansion device 90 is controlled to increase the efficiency of gas-liquid separation in the gas-liquid separator vessel 84, thus extending the operating range over which the quality x of refrigerant entering the liquid header 210 can be controlled. Further, the air-conditioning apparatus 200*b* includes the second expansion device 90 and the first expansion device 62. This facilitates the control of refrigerant flow rate also during cooling operation, leading to enhanced performance of the air-conditioning apparatus 200*b*.

Embodiments of the present invention are not limited to the above-mentioned embodiments but may include various modifications. For example, although the foregoing description of embodiments is directed to the case in which there is a single indoor unit 25, this should not be construed restrictively. Alternatively, a plurality of indoor units 25 may be connected.

REFERENCE SIGNS LIST

1, 101, 201, 301 heat exchanger 10, 110, 210, 310 liquid header 11, 211 liquid header main tube 11*a* first liquid header main tube 11*b* second liquid header main tube 12 (12*a*, 12*b*), 112 (112*a*, 112*b*, 112*c*, 112*d*), 212 (212*a*, 212*b*), 312 (312*a*, 312*b*) branch tube 13 bifurcated tube 13*a* first liquid header passage 13*b* second liquid header passage 14 partition wall 15*a* first inlet 15*b* second inlet 16 partition 17 indoor-unit outlet pipe 18*a*, 18*b* end branch tube 20 heat exchange unit 21 fin 22 heat transfer tube 22*a* flat perforated pipe 22*b* circular tube 23 joint tube 25 indoor unit 26 indoor heat exchanger 30, 30*a*, 30*b* axial fan 31, 31*a*, 31*b* boss 32, 32*a*, 32*b* blade 35 fan 36 boss 37 blade 40 gas header 41 gas header main tube 42 upper temperature sensor 43 outlet temperature sensor 47 connecting pipe outlet pipe 52 inlet pipe 52*a* first inlet pipe 52*b* second inlet pipe 52*c* third inlet pipe 52*d* fourth inlet pipe 53 first flow control mechanism 54 distributor 61 compressor 62 first expansion device 66 first temperature sensor 67 second temperature sensor 68 third temperature sensor 70 controller 82 bypass pipe 83 bypass control valve 84 gas-liquid separator vessel 85 pipe 86 Y-shaped pipe 90 second expansion device 91 accumulator 92 accumulator inlet pipe 93 compressor discharge pipe 94 flow switching device 100 outdoor unit 102 casing 103 air inlet 104 air outlet 105 fan guard 111*a* first liquid header main tube 111*b* second liquid header main tube 111*c* third liquid header main tube 111*d* fourth liquid header main tube 113*a* first liquid header passage 113*b* second liquid header passage 113*c* third liquid header passage 113*d* fourth liquid header passage 200, 200*a*, 200*b* air-conditioning apparatus 311*a* first liquid header main tube 311*b* second liquid header main tube Ob, Ob1, Ob2 boss centerline Ra gas-phase refrigerant Rb liquid-phase refrigerant x quality δ thickness of liquid layer

The invention claimed is:

1. An air-conditioning apparatus comprising:

a heat exchanger including a plurality of heat transfer tubes in which refrigerant flows, the plurality of heat transfer tubes being arranged so as to be spaced apart from each other in a vertical direction, and at least one header manifold that has a flow space defined inside the at least one header manifold and extending in the vertical direction, the at least one header manifold allowing refrigerant to flow into the plurality of heat transfer tubes from a plurality of branch tubes, the plurality of branch tubes being arranged so as to be spaced apart from each other in the vertical direction;

at least one axial fan including a blade disposed around a boss that rotates, the blade having a rotational plane that faces the plurality of heat transfer tubes in a horizontal direction; and a refrigerant circuit to direct the refrigerant into the flow space such that the refrigerant flows upward in a two-phase gas-liquid state, and to cause the refrigerant to evaporate in the heat exchanger, wherein the refrigerant flows in the at least one header manifold in an annular or churn flow pattern in which gas-phase refrigerant collects at a center of the flow space of the at least one header manifold and liquid-phase refrigerant collects on a wall surface of the at least one header manifold, and wherein among the plurality of branch tubes located within a height range that allows the blade to rotate, a first majority of the branch tubes located at or below a height of the boss are inserted into the at least one header manifold such that distal ends of the branch tubes are positioned at 0 to 50% of the distance in the horizontal direction from the center of the flow space in the horizontal direction to a wall surface of the at least one header manifold, and a second majority of the branch tubes located above the height of the boss are connected to the at least one header manifold such that distal ends of the branch tubes are positioned at more than 50% of the distance in the horizontal direction from the center of the flow space in the horizontal direction to a wall surface of the at least one header manifold.

2. The air-conditioning apparatus of claim 1, wherein, among the branch tubes located at or below the height of the boss, the branch tube whose distal end position is at 0 to 50% of the distance from the center of the flow space and which is located most upstream has a distal end that penetrates a liquid layer of a thickness δ [m] to reach the gas-phase refrigerant, the liquid layer being formed as the liquid-phase refrigerant collects on the wall surface, wherein, among the branch tubes located above the height of the boss, the branch tube whose distal end position is at more than 50% of the distance from the center of the flow space and which is located most upstream has a distal end that falls within the liquid layer, and wherein the thickness δ [m] of the liquid layer is defined as $\delta = G \times (1-x) \times D/(4\rho_L \times U_{LS})$, where G is refrigerant flow velocity [kg/(m$^2$s)], x is refrigerant quality, D is an inside diameter [m] of the at least one header manifold, $\rho_L$ is refrigerant liquid density [kg/m$^3$], and $U_{LS}$ is reference liquid apparent velocity [m/s] that is a maximum value within a variation range of gas apparent velocity of refrigerant entering the flow space of the at least one header manifold, and the reference liquid apparent velocity $U_{LS}$ [m/s] is defined as $G(1-x)/\rho_L$.

3. The air-conditioning apparatus of claim 1, wherein the refrigerant entering the at least one header manifold has a quality x that falls within a range of $0.05 \leq x \leq 0.30$.

4. The air-conditioning apparatus of claim 1, wherein in the at least one header manifold, the flow space connected to the plurality of branch tubes located within the height range that allows the blade to rotate is divided into a plurality of parts in the vertical direction.

5. The air-conditioning apparatus of claim 4, wherein the at least one header manifold includes a plurality of header manifolds disposed at different heights in the vertical direction, the plurality of header manifolds including a lower header manifold and an upper header manifold, the lower header manifold being a header manifold that is connected with the branch tubes located at or below the height of the boss among the plurality of branch tubes located within the height range that allows the blade to rotate, the upper header manifold being a header manifold that is connected with the branch tubes located above the height of the boss among the plurality of branch tubes located within the height range that allows the blade to rotate, a flow space of the lower header manifold having an inside diameter greater than an inside diameter of a flow space of the upper header manifold.

6. The air-conditioning apparatus of claim 1, wherein the plurality of branch tubes comprise respective end portions of the plurality of heat transfer tubes, or joint tubes attached to respective end portions of the plurality of heat transfer tubes.

7. The air-conditioning apparatus of claim 1, comprising a controller configured to, depending on an operating condition, control a quality of the refrigerant entering the at least one header manifold, wherein, in the refrigerant circuit, a first expansion valve is disposed at a position located upstream of the at least one header manifold relative to a direction of refrigerant flow during heating operation, and wherein the controller controls the first expansion valve.

8. The air-conditioning apparatus of claim 7, wherein the refrigerant circuit includes a gas-liquid separator vessel disposed between the first expansion valve and the at least one header manifold, a bypass pipe to connect the gas-liquid separator vessel with an area located downstream of the heat exchanger relative to the direction of refrigerant flow during heating operation, and a bypass flow control mechanism including a valve and disposed on the bypass pipe to control a flow rate of the refrigerant.

9. The air-conditioning apparatus of claim 8, wherein the refrigerant circuit further includes a flow switching device including a valve and configured to switch a direction of flow of the refrigerant, and a second expansion valve disposed between the heat exchanger and the first expansion valve, and wherein the controller controls the flow switching device, the first expansion valve, and the second expansion valve.

10. The air-conditioning apparatus of claim 1, wherein the controller controls, during heating operation, a quality x of refrigerant entering a liquid header manifold such that the quality x falls within a range of $0.05 \leq x \leq 0.30$.

11. The air-conditioning apparatus of claim 1, wherein the at least one axial fan includes a plurality of axial fans disposed at different heights in the vertical direction, and among the plurality of branch tubes located within a height range that allows the blade of each axial fan to rotate, the first majority of the branch tubes located at or below a height of a boss of one of the plurality of axial fans are inserted into the at least one header manifold such that distal ends of the first majority of the branch tubes are positioned at 0 to 50% of the distance from the center of the flow space of the at least one header manifold, and the second majority of the branch tubes located above the height of the boss of the one of the axial fans are connected to the at least one header manifold such that distal ends of the second majority of the branch tubes are positioned at more than 50% of the distance from the center of the flow space of the at least one header manifold.

12. An air-conditioning apparatus comprising:

a heat exchanger including a plurality of heat transfer tubes in which refrigerant flows, the plurality of heat transfer tubes being arranged so as to be spaced apart from each other in a vertical direction, and at least one header manifold that has a flow space defined inside the at least one header manifold and extending in the vertical direction, the at least one header manifold allowing refrigerant to flow into the plurality of heat transfer tubes from a plurality of branch tubes, the plurality of branch tubes being arranged so as to be spaced apart from each other in the vertical direction;

a fan located above the plurality of heat transfer tubes; and a refrigerant circuit to direct the refrigerant into the flow space such that the refrigerant flows upward in a two-phase gas-liquid state, and to cause the refrigerant to evaporate in the heat exchanger, wherein the refrigerant flows in the at least one header manifold in an annular or churn flow pattern in which gas-phase refrigerant collects at a center of the flow space of the at least one header manifold and liquid-phase refrigerant collects on a wall surface of the at least one header manifold, wherein the at least one header manifold includes a plurality of header manifolds disposed at different heights in the vertical direction, and wherein a majority of the branch tubes connected to a header manifold of the plurality of header manifolds located closest to the fan are inserted such that distal ends of the branch tubes are positioned at 0 to 50% of the distance in the horizontal direction from the center of the flow space in the horizontal direction to a wall surface of the header manifold, and a majority of the branch tubes connected to a header manifold of the plurality of header manifolds disposed below the header manifold located closest to the fan are connected such that distal ends of the branch tubes are positioned at more than 50% of the distance in the horizontal direction from the center of the flow space in the horizontal direction to a wall surface of the header manifold.

13. The air-conditioning apparatus of claim 12, wherein the flow space in the header manifold located closest to the fan has an inside diameter greater than an inside diameter of the flow space in the header manifold disposed below the header manifold located closest to the fan.

14. An air-conditioning apparatus comprising:

a heat exchanger including a plurality of heat transfer tubes in which refrigerant flows, the plurality of heat transfer tubes being arranged so as to be spaced apart from each other in a vertical direction, and a header manifold that has a flow space defined inside the header manifold and extending in the vertical direction, the header manifold allowing refrigerant to flow into the plurality of heat transfer tubes from a plurality of branch tubes, the plurality of branch tubes being arranged so as to be spaced apart from each other in the vertical direction;

a fan located above the plurality of heat transfer tubes; and a refrigerant circuit to direct the refrigerant into the flow space such that the refrigerant in a two-phase gas-liquid state flows upward, and to cause the refrigerant to evaporate in the heat exchanger, wherein the refrigerant flows in the header manifold in an annular or churn flow pattern in which gas-phase refrigerant collects at a center of the flow space of the header manifold and liquid-phase refrigerant collects on a wall surface of the header manifold, and wherein a majority of the branch tubes connected to the header manifold are inserted into the header manifold such that distal ends of the branch tubes are positioned at 0 to 50% of the distance in the horizontal direction from the center of the flow space in the horizontal direction to a wall surface of the header manifold, and at least uppermost one of the branch tubes connected to the header manifold is connected to the header manifold such that a distal end of the branch tube is positioned at more than 50% of the distance in the horizontal direction from the center of the flow space in the horizontal direction to a wall surface of the header manifold.

* * * * *